US007907137B2

(12) United States Patent
Shirasaki et al.

(10) Patent No.: US 7,907,137 B2
(45) Date of Patent: Mar. 15, 2011

(54) DISPLAY DRIVE APPARATUS, DISPLAY APPARATUS AND DRIVE CONTROL METHOD THEREOF

(75) Inventors: Tomoyuki Shirasaki, Higashiyamato (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 1285 days.

(21) Appl. No.: 11/391,941

(22) Filed: Mar. 29, 2006

(65) Prior Publication Data

US 2006/0221015 A1 Oct. 5, 2006

(30) Foreign Application Priority Data

Mar. 31, 2005 (JP) ..... 2005-101905
Mar. 31, 2005 (JP) ..... 2005-105373

(51) Int. Cl.
*G09G 5/00* (2006.01)

(52) U.S. Cl. ..... 345/212; 345/98; 345/99; 345/100; 345/204

(58) Field of Classification Search ..... 345/76–83, 345/87–100, 204–215, 690
See application file for complete search history.

(56) References Cited

U.S. PATENT DOCUMENTS

| | | | | |
|---|---|---|---|---|
| 7,358,941 | B2 * | 4/2008 | Ono et al. | 345/82 |
| 7,561,147 | B2 | 7/2009 | Tsuge | |
| 7,583,261 | B2 * | 9/2009 | Shirasaki et al. | 345/212 |
| 7,719,492 | B2 | 5/2010 | Childs | |
| 2004/0239596 | A1 | 12/2004 | Ono et al. | |
| 2004/0246212 | A1 | 12/2004 | Kobayashi et al. | |
| 2005/0030264 | A1 | 2/2005 | Tsuge et al. | |
| 2005/0041002 | A1 | 2/2005 | Takahara et al. | |
| 2005/0057580 | A1 | 3/2005 | Yamano et al. | |
| 2007/0146251 | A1 | 6/2007 | Tsuge et al. | |
| 2008/0030495 | A1 | 2/2008 | Shirasaki et al. | |
| 2008/0191976 | A1 | 8/2008 | Nathan et al. | |
| 2008/0225027 | A1 * | 9/2008 | Toyomura et al. | 345/204 |
| 2008/0238953 | A1 | 10/2008 | Ogura | |
| 2009/0189924 | A1 * | 7/2009 | Ogura | 345/690 |

(Continued)

FOREIGN PATENT DOCUMENTS

CN 1552052 A 12/2004

(Continued)

OTHER PUBLICATIONS

Chinese Office Action (and English translation thereof) dated Nov. 27, 2008, issued in a counterpart Chinese Applications.

(Continued)

*Primary Examiner* — Vijay Shankar
(74) *Attorney, Agent, or Firm* — Holtz, Holtz, Goodman & Chick, PC

(57) ABSTRACT

There is provided a display drive apparatus for operating, in accordance with display data, a current control type optical elements each having a display pixel provided with the optical element and a drive element which supplies a driving current to the optical element. The display drive apparatus includes a gradation signal creating circuit which generates a gradation signal corresponding to a luminance gradation of the display data and supplies the gradation signal to the display pixel, a threshold voltage detection circuit which detects a threshold voltage peculiar to the drive element of the display pixel, and a compensation voltage application circuit which generates a compensation voltage for compensating for the threshold voltage of the drive element on the basis of the threshold voltage and applies the compensation voltage to the drive element.

39 Claims, 36 Drawing Sheets

U.S. PATENT DOCUMENTS

| | | | | |
|---|---|---|---|---|
| 2009/0201231 | A1 | 8/2009 | Takahara et al. | |
| 2009/0207160 | A1 * | 8/2009 | Shirasaki et al. | 345/212 |

FOREIGN PATENT DOCUMENTS

| | | | |
|---|---|---|---|
| EP | 1 434 193 | A1 | 6/2004 |
| JP | 8-330600 | A | 12/1996 |
| JP | 2001-147659 | A | 5/2001 |
| JP | 2003-195810 | A | 7/2003 |
| JP | 2004-004675 | A | 1/2004 |
| JP | 2004-021219 | A | 1/2004 |
| JP | 2004-252110 | A | 9/2004 |
| JP | 2005-115144 | A | 4/2005 |
| JP | 2006-119180 | A | 5/2006 |
| JP | 2006-178028 | A | 7/2006 |
| JP | 2006-195477 | A | 7/2006 |
| JP | 2007-519956 | T | 7/2007 |
| JP | 2008-504576 | T | 2/2008 |
| KR | 2003-0078741 | | 10/2003 |
| KR | 10-2004-0041620 | | 5/2004 |
| KR | 10-2006-0032530 | A | 4/2006 |

OTHER PUBLICATIONS

International Preliminary Report on Patentability and Written Opinion dated Aug. 29, 2006, issued in International Application No. PCT/JP2006/307283 filed Mar. 30, 2006, 12 sheets.

Korean Office Action dated Aug. 31, 2009 and English translation thereof issued in a counterpart Korean Application No. 10-2007-0077017 of related U.S. Appl. No. 11/888,474.

Japanese Office Action dated Jun. 13, 2008 and English translation thereof issued in a counterpart Japanese Application No. 2006-209534 of related U.S. Appl. No. 11/888,474.

Japanese Office Action dated Jun. 11, 2008 and English translation thereof issued in a counterpart Japanese Application No. 2006-218805 of related U.S. Appl. No. 11/888,474.

Japanese Office Action dated Apr. 22, 2010 and English translation thereof in counterpart Japanese Application No. 2005-101905.

Japanese Office Action dated Apr. 22, 2010 and English translation thereof in counterpart Japanese Application No. 2005-105373.

* cited by examiner

DISPLAY DRIVE APPARATUS, DISPLAY APPARATUS AND DRIVE CONTROL METHOD THEREOF

CROSS-REFERENCE TO RELATED APPLICATIONS

This application is based upon and claims the benefit of priority from prior Japanese Patent Applications No. 2005-101905, filed Mar. 31, 2005; and No. 2005-105373, filed Mar. 31, 2005, the entire contents of both of which are incorporated herein by reference.

BACKGROUND OF THE INVENTION

1. Field of the Invention

The present invention relates to a display drive apparatus, a display apparatus provided with the display drive apparatus, and a drive control method thereof, and more particularly, to a display drive apparatus which is applicable to a display panel formed by arranging a plurality of current control type optical elements which are driven by being supplied with a current corresponding to display data, a display apparatus provided with the display drive apparatus, and a drive control method thereof.

2. Description of the Related Art

In recent years, light weight and thin type display devices which consume a lower amount of electric power are conspicuously prevalent as monitors and displays of personal computers and video equipment. In particular, liquid crystal display (LCD) apparatuses are widely applied as display devices for mobile phones, digital cameras, personal data assistances (PDA's), and portable devices (mobile handsets) such as electronic dictionaries.

As a next-generation display device which follows such an LCD apparatus, research and development have been briskly made toward a full-scale popularization of a self-luminous type display device (a self-luminous type display) provided with a display panel in which organic electroluminescent elements (organic EL elements), inorganic electroluminescent elements (inorganic EL elements) or optical elements such as light emitting diodes (LEDs) are arranged in a matrix.

In particular, a self-luminous type display to which an active matrix drive mode is applied has a higher display response speed than that of the above-described liquid crystal display. Further, the self-luminous type display does not have viewing angle dependency, and can achieve an increase in luminance/contrast and in fineness of a display image quality. Furthermore, the self-luminous type display does not require a backlight as different from the liquid crystal display, and hence the self-luminous type display has very advantageous characteristics in the application to portable devices that a further reduction in a thickness and a weight and/or a further decrease in power consumption is possible.

Then, in such a self-luminous type display, various driving control mechanisms and/or control methods for controlling an operation of the optical elements have been proposed.

FIG. 35 is a schematic structural diagram showing a primary part of a conventional self-luminous display which is of a voltage control active matrix type.

FIG. 36 is an equivalent circuit diagram showing a structural example of a display pixel which is applicable to the conventional self-luminous type display.

Here, FIG. 35 shows a circuit configuration of a display pixel comprising a light emitting element formed of an organic EL element OEL as the optical element.

As shown in FIG. 35, a conventional organic EL display apparatus which is of an active matrix type generally has a configuration comprising: a display panel 110P in which a plurality of display pixels EMp are arranged in a matrix in the vicinity of intersections of a plurality of scanning lines (selection lines) SLp and a plurality of data lines (signal lines) DLp arranged to respectively extend in a row direction and a column direction; and a scanning driver 120P which is connected with the scanning lines SLp; and a data driver 130P which is connected with the data lines DL.

As shown in FIG. 36, each of the display pixels EMp comprises a pixel drive circuit DCp. The circuit DCp includes a thin film transistor (TFT) Tr111 having a gate terminal connected with the scanning line SLp and source and drain terminals respectively connected with the data line DL and a contact point N111, and a thin film transistor Tr112 having a gate terminal connected with the contact point N111 and a source terminal receiving a predetermined power source voltage Vdd. An organic EL element OEL has an anode terminal connected with a drain terminal D of the thin film transistor Tr112 of the pixel drive circuit DCp and a cathode terminal receiving a ground potential Vgnd lower than the power supply voltage Vdd. In FIG. 36, reference numeral Cp denotes a capacitor formed between the gate and the source terminals of the thin film transistor Tr112.

In the display apparatus comprising the display panel 110P constituted by the display pixels EMp having such a configuration, first, an ON-level scanning signal voltage Ssel is sequentially applied to the scanning line SLp in each row from the scanning driver 120P to turn on the thin film transistor Tr111 of the display pixel EMp (the drive circuit DCp) in each row, thereby setting the display pixel EMp in a selection state.

In synchronization with this selection timing, a gradation voltage Vpix having a voltage value corresponding to display data is generated by the data driver 130P and applied to the data line DLp in each column, and the gradation voltage Vpix is thereby applied to the contact point N111 (that is, the gate terminal of the thin film transistor Tr112) through the thin film transistor Tr111 of each display pixel EMp (the drive circuit DCp).

As a result, the thin film transistor Tr112 is turned on in a conductive state (i.e., a conductive state corresponding to the gradation voltage Vpix) corresponding to the potential (in a precise sense, a potential difference between the gate and the source) of the contact point N111. Thus, a predetermined driving current flows to the ground voltage Vgnd from the power source voltage Vdd through the thin film transistor Tr112 and the organic EL element OEL. Consequently, the organic EL element OEL operates to emit light with a luminance gradation corresponding to display data (the gradation voltage Vpix).

Subsequently, an off-level scanning signal voltage Ssel is applied to the scanning line SLp from the scanning driver 120P. Thus, the thin film transistor Tr111 of the display pixel EMp in each row is turned off, the display pixel EMp is set to a non-selective state, and the data line DLp and the drive circuit DCp are electrically disconnected. At this time, the thin film transistor Tr112 maintains an ON state in such a manner that a predetermined voltage is applied between the gate and the source terminals of the thin film transistor Tr112 based on a potential which has been applied to the gate terminal (the contact point N111) and held in the capacitor Cp.

Therefore, in the same manner as the light emitting operation in the selective state, a predetermined driving current flows to the organic EL element OEL through the thin film transistor Tr112 from the power supply voltage Vdd, thereby maintaining the light emitting operation. This light emitting operation is controlled to continue for, e.g., one frame period until the gradation voltage Vpix corresponding to the next display data is applied to (written in) the display pixel EMP in each row.

Such a drive control method is referred to as a voltage gradation specification mode (or a voltage gradation specification drive) since a current value of a driving current which flows to the organic EL element OEL is controlled to perform a light emitting operation with a predetermined luminance gradation by adjusting a voltage value of the gradation voltage Vpix applied to each display pixel EMp (specifically, the gate terminal of the thin film transistor Tr112 of the drive circuit DCp).

In the drive circuit DCp as shown in FIG. 36, the current path is connected in series to the organic EL element OEL, so that the element characteristics (particularly, the threshold voltage characteristics) of the thin film transistor Trr112 for drive which allows the flow of a driving current corresponding to the display data (gradation voltage) may change (shift) depending on the usage time, the drive history and the like. In such a case, a relation between a gate voltage (a potential of the contact point 111) and a driving current (a current between the source and the drain terminals) which flows between the source and the drain terminals changes, and thereby a current value of a driving current which flows at a predetermined gate voltage fluctuates (for example, decreases). As a result, it becomes difficult to stably realize a light emitting operation for a long period with an appropriate luminance gradation corresponding to the display data.

Furthermore, in the case where variation occurs in element characteristics (the threshold voltage) of the thin film transistors Tr111 and Tr112 in the display panel 110P for each display pixel EMp (the drive circuit DCp), or in the case where variation occurs in the element characteristics of the transistors Tr111 and Tr112 for each display panel 110P depending on the manufacture lots, the current value of the driving current largely varies for each display pixel or each display panel in the drive circuit which is of a voltage gradation specification mode, so that an appropriate gradation control becomes unable to be performed.

BRIEF SUMMARY OF THE INVENTION

The present invention has advantages of compensating for change and variation in the element characteristics of the drive element and providing a favorable and uniform display image quality in a display drive apparatus and a display apparatus provided with the display drive apparatus, the display drive apparatus operating, in accordance with display data, an optical element of a display pixel provided with an optical element and a drive element for supplying a driving current to the optical element.

In order to attain the above advantages, a display drive apparatus according to the present invention comprises: a gradation signal generation circuit which generates a gradation signal corresponding to a luminance gradation of the display data and supplies the gradation signal to a display pixel; a threshold voltage detection circuit which detects a threshold voltage peculiar to a drive element of the display pixel; and a compensation voltage application circuit which generates a compensation voltage for compensating for the threshold voltage of the drive element on the basis of the threshold voltage and applies the compensation voltage to the drive element.

The display drive apparatus may further comprise: a memory circuit which stores threshold data corresponding to the threshold voltage detected by the threshold voltage detection circuit. The compensation voltage application circuit generates the compensation voltage on the basis of the threshold data store in the memory circuit.

The display drive apparatus may further comprise: a detecting voltage application circuit which applies to the drive element a voltage for threshold detection which has a higher potential than the threshold voltage. The drive element preferably comprises a current path which allows the driving current to flow to the optical element, and a control terminal which controls a supply state of the driving current. The detecting voltage application circuit applies the voltage for threshold detection to between the control terminal of the drive element and one end side of the current path. The threshold voltage detection circuit detects, as the threshold voltage, a potential difference between the control terminal of the drive element and the one end side of the current path at the time of the absence of current flow in the current path. The compensation voltage application circuit applies the compensation voltage based on the threshold data stored in the memory circuit to between the control terminal of the drive element and the one end side of the current path.

The optical element may comprise a light emitting element which performs a light emitting operation at a luminance corresponding to a current value of a current applied. The gradation signal generation circuit may comprise: a circuit which generates, as the gradation signal, a gradation current having a current value for allowing the light emitting element to perform a light emitting operation at a luminance corresponding to the luminance gradation of the display data; and a circuit which generates, as the gradation signal, a non-light emitting display voltage having a predetermined voltage value for allowing the light emitting element to perform a non-light emitting operation.

The display drive apparatus may comprise at least a signal path switching circuit which selectively switches and controls a connection between a single data line provided in correspondence to the display pixel and each of a signal path which detects the threshold voltage with the threshold voltage detection circuit, a signal path which applies the compensation voltage with the compensation voltage application circuit, and a signal path which supplies the gradation signal with the gradation signal generation circuit, and between the single data line and a signal path which applies the voltage for threshold detection with the detecting voltage application circuit.

In order to obtain the above advantages, a display apparatus according to the present invention comprises: a display panel having a plurality of display pixels arranged therein, each of the pixels comprising a current control type optical element and a drive element which supplies a driving current to the optical element at respective intersections of a plurality of selection lines and a plurality of data lines arranged to respectively extend in a row direction and in a column direction; a selection drive unit which sequentially applies a selection signal to each of the plurality of selection lines of the display panel, thereby setting the display pixel in each row sequentially in a selection state; and a data drive unit comprising: a gradation signal generation circuit which generates a gradation signal corresponding to a luminance gradation of the display data and supplies the gradation signal to said each display pixel via said each data line; a threshold voltage detection circuit which detects a threshold voltage peculiar to the drive element of said each display pixel via said each data line; and a compensation voltage application circuit which generates a compensation voltage for compensating for the threshold voltage of said each display pixel on the basis of said each threshold voltage and applies the compensation voltage to said each display pixel via said each data line.

The data drive unit may further comprise a memory circuit which stores threshold data corresponding to the threshold voltage detected by the threshold voltage detection circuit. The compensation voltage application circuit generates the compensation voltage on the basis of the threshold data stored in the memory circuit.

Preferably, the data drive unit further comprises a detecting voltage application circuit which applies a voltage for threshold detection which has a higher potential than the threshold voltage to the drive element of said each display pixel via said each data line. The drive element may comprise a current path which allows the driving current to flow to the optical element, and a control terminal which controls a supply state of the driving current. The detecting voltage application circuit applies a voltage for threshold detection to between the control terminal of the drive element and one end side of the current path. The threshold voltage detection circuit detects a potential difference between the control terminal of the drive element and the one end side of the current path at the time of the absence of current flow in the current path as the threshold voltage via said each data line. The compensation voltage application circuit applies the compensation voltage based on the threshold data stored in the memory circuit to between the control terminal of the drive element and the one end side of the current path via said each data line.

The optical element preferably comprises a light emitting element which performs a light emitting operation at a luminance corresponding to a current value of a current applied, and the optical element is, for example, an organic electroluminescent element.

The gradation signal generation circuit may comprise: a circuit which generates, as the gradation signal, a gradation current having a current value for allowing the light emitting element to perform a light emitting operation at a luminance corresponding to the luminance gradation of the display data; and a circuit which generates, as the gradation signal, a non-light emitting display voltage having a predetermined voltage value for allowing the light emitting element to perform a non-light emitting operation.

Preferably, the data drive unit further comprise: a threshold acquiring circuit which individually fetches said each threshold data corresponding to said each threshold voltage detected from each of said plurality of display pixels via said each data line and sequentially transfers said each threshold data; and a data acquiring circuit which sequentially and individually fetches and holds luminance gradation data for generating the gradation signal with respect to each of the display pixels. The memory circuit individually stores said each threshold data transferred from the threshold acquiring circuit in correspondence to each of said plurality of display pixels. The gradation signal generation circuit generates the gradation signal corresponding to the luminance gradation data held in the data acquiring circuit and supplies the gradation signal to said each display pixel via said each data line. A configuration of sequentially and individually fetching the luminance gradation data in the data acquiring circuit and a configuration of fetching the threshold data and sequentially transferring the threshold data in the threshold acquiring circuit are shared.

The data drive unit may comprise at least a signal path switching circuit which selectively switches and controls a connection between a single data line provided in correspondence to the display pixel and each of a signal path which detects the threshold voltage with the threshold voltage detection circuit, a signal path which applies the compensation voltage with the compensation voltage application circuit, and a signal path which supplies the gradation signal with the gradation signal generation circuit, and between the single data line and a signal path which applies the voltage for threshold detection with the detecting voltage application circuit.

Preferably, the display apparatus further comprises a power source drive unit which applies a predetermined power supply voltage to each of said plurality of display pixels. The power source drive unit sequentially applies the power supply voltage to the display pixel in each row of the display panel at a predetermined timing, thereby setting the display pixel in each row in an operation state. Alternatively, the power source drive unit may sequentially apply the power supply voltage at a predetermined timing to the display pixel for each group which is obtained by dividing said plurality of display pixels arranged on the display panel into sets for each of a plurality of rows, thereby setting the display pixel in each group in an operation state.

Preferably, the display apparatus further comprises a drive control unit which generates a timing control signal for controlling a timing of the operation of detecting the threshold voltage by the threshold voltage detection circuit. The drive control unit makes a control with the timing control signal so as to cause the threshold voltage detection circuit to detect the threshold voltage of the drive elements of the display pixels in different rows of the display panel for each of operation periods in which the gradation signal is supplied to all of said plurality of display pixels arranged on the display panel by means of the selection drive unit and the data drive unit. Alternatively, the drive control unit may make a control with the timing control signal so as to cause the threshold voltage detection circuit to detect the threshold voltage of the drive elements of the display pixels in adjacent rows of the display panel for each of operation periods in which the gradation signal is supplied to all of said plurality of display pixels arranged on the display panel by means of the selection drive unit and the data drive unit.

In order to attain the above advantages, a drive control method of a display apparatus according to the present invention comprises: detecting a threshold voltage peculiar to the drive element of said each display pixel on the display panel; generating a compensation voltage for compensating for the threshold voltage of the drive element on the basis of the threshold voltage, applying the compensation voltage to the drive element of said each display pixel, and holding the compensation voltage as a voltage component; supplying a gradation signal to said each display pixel, adding a voltage component based on the gradation signal to the voltage component based on the compensation voltage, and allowing the drive element of said each display pixel to hold the voltage component; and supplying the driving current created on the basis of the voltage component held in the drive element of said each display pixel to the optical element, and allowing the optical element to be operated in accordance with the gradation signal.

The operation of detecting the threshold voltage may include: an operation of applying a voltage for threshold detection which has a higher potential than the threshold voltage to the drive element of said each display pixel; and detecting, as the threshold voltage, a voltage after part of electric charges corresponding to the voltage for threshold detection is discharged and converged.

The operation of detecting the threshold voltage may include: an operation of storing threshold data corresponding to the threshold voltage. The operation of storing the threshold data by detecting the threshold voltage is performed with respect to all of said plurality of display pixels arranged on the display panel at a timing prior to the application of the compensation voltage to the drive element and the holding of the voltage component based on the gradation signal. Alternatively, the operation of storing the threshold data by detecting the threshold voltage is performed with respect to the drive elements of the display pixels in different rows of the display panel for each of operation periods in which the gradation signal is supplied to all of said plurality of display pixels arranged on the display panel. Alternatively, the operation of storing the threshold voltage by detecting the threshold voltage is performed with respect to the drive elements of the display pixels in adjacent rows of the display panel for each of operation periods in which the gradation signal is supplied to all of said plurality of display pixels arranged on the display panel.

The operation of adding a voltage component based on the gradation signal to the voltage component based on the compensation voltage and allowing the drive element of said each display pixel to hold the voltage component may be sequentially performed with respect to said plurality of display pixels for each row which are arranged on the display panel. The operation of allowing the optical element to perform a light emitting operation with a luminance gradation corresponding to the gradation signal is preferably sequentially performed from a row at which the operation of adding a voltage component based on the gradation signal to the voltage component based on the compensation voltage to be held is completed. Alternatively, the operation of adding a voltage component based on the gradation signal to the voltage component based on the gradation signal and allowing the drive element of said each display pixel to hold the voltage component may be sequentially performed for each group which is obtained by grouping said plurality of display pixels arranged on the display panel for each of the rows. The operation of allowing the optical element to perform a light emitting operation with a luminance gradation corresponding to the gradation signal may be sequentially performed from the group in which the operation of adding a voltage component based on the gradation signal to the voltage component based on the gradation signal to be held is completed.

The optical element preferably comprises a light emitting element which performs a light emitting operation at a luminance corresponding to a current value of a current applied. The operation of holding the voltage component based on the gradation signal includes: in the case where the light emitting element of said each display element is allowed to perform a light emitting operation at a luminance corresponding to a gradation luminance of display data, generating, as the gradation current, a gradation current having a current value for allowing the optical element to perform a light emitting operation at a luminance corresponding to the gradation luminance of the display data, and supplying the gradation current to the display pixel; and in the case where the light emitting element of said each display pixel is allowed to perform a non-light emitting operation, generating, as the gradation signal, a non-light emitting display voltage having a predetermined voltage for allowing the optical element to perform a non-light emitting operation, and supply the non-light emitting display voltage to the display pixel.

DETAILED DESCRIPTION OF THE INVENTION

Embodiments of a display drive apparatus, a display apparatus and a drive control method according to the present invention will be described in detail hereinafter with reference to the accompanying drawings.

First, the display drive apparatus which is applied to the display apparatus according to the present invention and a drive control method thereof will be explained with reference to the drawings.

Figure 1:
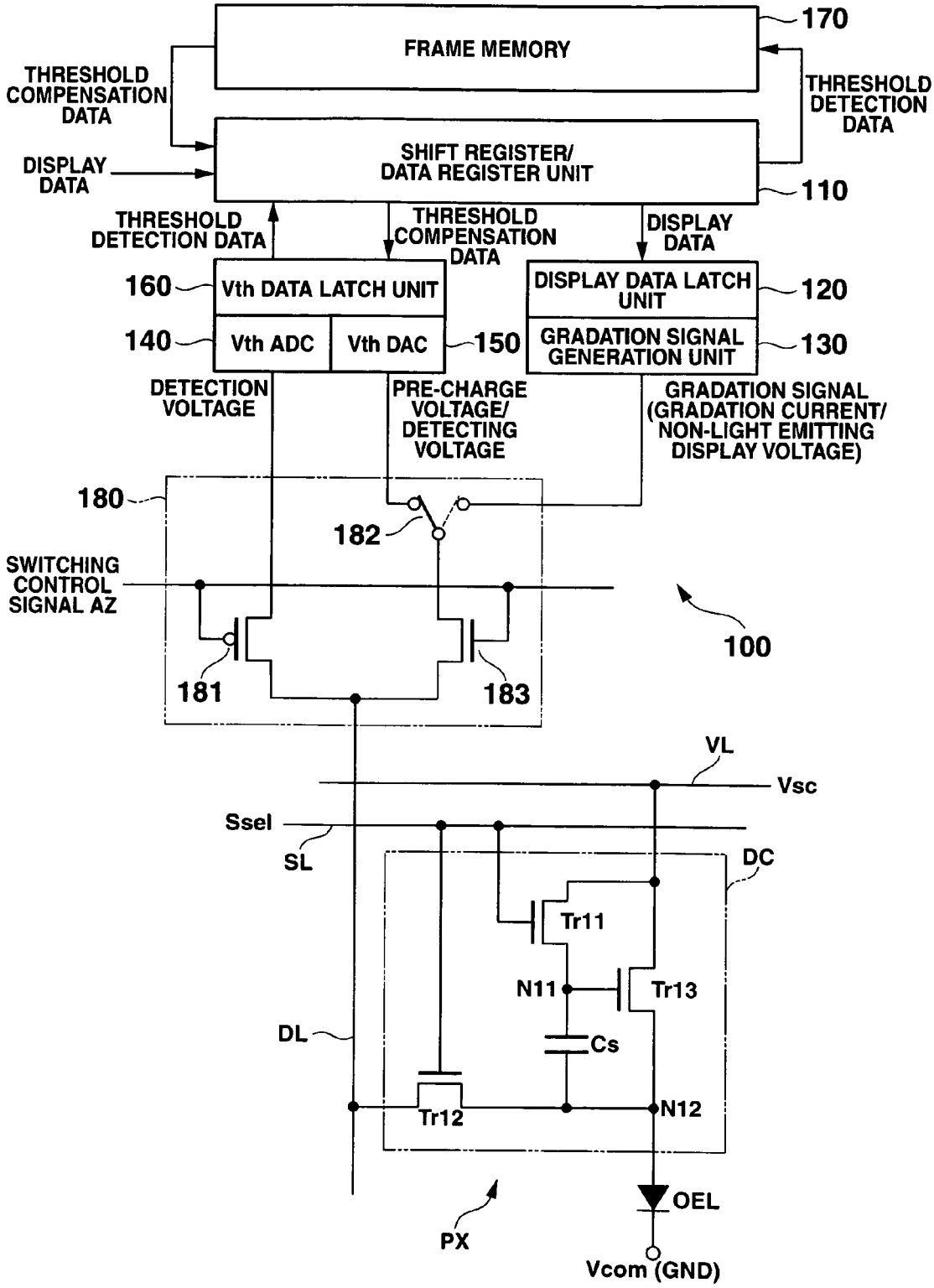
FIG. 1 is a structural diagram of a part showing one embodiment of a display drive apparatus according to the present invention, and a display pixel driven and controlled by the display drive apparatus.

FIG. 1 is a structural diagram of a part showing one embodiment of a display drive apparatus according to the invention and one of a plurality of display pixels which are driven and controlled by the display drive apparatus.

Here, there will be explained a relation between the display pixel arranged on a display panel of the display apparatus and a display drive apparatus for driving and controlling the display pixel.

<Display Drive Apparatus>

As shown in FIG. 1, a display drive apparatus 100 according to the embodiment generally comprises: a shift register/data register unit 110, a display data latch unit 120, a gradation signal generation unit (a gradation signal generation circuit) 130, a threshold detection voltage analog to digital converter (hereinafter abbreviated as "detection voltage ADC" and denoted as "VthADC" in the drawings) 140, a threshold compensation voltage digital to analog converter (hereinafter referred to as "compensation voltage DAC" and denoted as "VthDAC" in the drawings) 150, a threshold data latch unit (denoted as "Vth data latch unit" in the drawings) 160, a frame memory 170, and a data line input/output switching unit 180.

The shift register/data register unit (a data acquiring circuit and a threshold acquiring circuit) 110 includes a shift register for sequentially outputting shift signals, and a data register for sequentially fetching luminance gradation data composed of digital signals which are supplied at least from the outside, which are not shown in this figure.

More specifically, either of the following three operations is sequentially performed. The first is an operation of sequentially fetching display data (luminance gradation data) of display pixels PX in one row of the display panel and transferring the data to the display data latch unit 120. The second is an operation of sequentially fetching a threshold voltage (threshold detection data) of display pixels PX in one row held in the threshold data latch unit 160 and transferring the data to the frame memory 170. The third is an operation of sequentially fetching threshold compensation data of display pixels (PX) in specific one row from the frame memory 170 and transferring the data to the threshold data latch unit 160. Incidentally, each of the first to third operations will be described in detail later.

The display latch unit 120 holds the display data (luminance gradation data) of the display pixels PX in one row which has been fetched from the outside by the data register/data register unit 110 and transferred.

The gradation signal generation unit (the gradation signal generation circuit) 130 has a function of selectively supplying, as a gradation signal for allowing an organic EL element (a current control type optical element) OEL to perform a light emitting operation with a gradation luminance corresponding to display data or a non-light emitting operation, either of a gradation current Idata and a non-light emitting display voltage Vzero. The current Idata has a predetermined current value for allowing the organic EL element OEL to perform a light emitting operation with a predetermined luminance gradation. The display voltage Vzero has a predetermined voltage value for setting the organic EL element OEL in a state of non-light emitting operation, namely, a black display (a minimum luminance gradation) without being allowed to perform a light emitting operation.

Here, as a configuration of supplying a gradation current having a current value corresponding to display data as a gradation signal, for example, a configuration is applicable which is provided with: a digital to analog converter (a D/A converter) for converting a digital signal voltage of each display data held in the display data latch unit 120 into an analog signal voltage on the basis of a gradation reference voltage supplied from a power supply circuit (not shown); and a voltage-current converter for generating a gradation current Idata having a current value corresponding to the analog signal voltage.

In the following explanation, there will be explained a case in which a gradation display is made by supplying a gradation current having a predetermined current value to each display pixel as a gradation signal. However, the present invention is not limited thereto. Any signal is applicable as long as the signal allows the application of a gradation voltage having a voltage value corresponding to the display data as the gradation signal. In this case, for example, a configuration including only the digital to analog converter may be applied.

The detection voltage ADC (a threshold voltage detection circuit) 140 detects and fetches, as an analog signal voltage, a threshold voltage (or a voltage component corresponding to the threshold voltage) of a switching element (a thin film transistor Tr13) for supplying a driving current to a light emitting element (for example, an organic EL element OEL) provided on each display pixel PX which will be described later, and converts the threshold voltage into threshold detection data including a digital signal voltage.

The compensation voltage DAC (a compensation voltage application circuit, a detecting voltage application circuit) 150 converts threshold compensation data including a digital signal voltage for compensating for the threshold voltage of the switching element provided on each display pixel PX into a pre-charge voltage (a threshold compensation voltage) including an analog signal voltage. Furthermore, as shown in a drive control method which will be described later, an operation (a threshold voltage detection operation) of measuring a threshold voltage of a switching element by the detection voltage ADC 140 is configured as follows. A predetermined detecting voltage can be output such that a high potential difference is set (the voltage component is held), the difference being higher than the threshold voltage of the switching element, between a gate and a source (both ends of the capacitor Cs) of a thin film transistor constituting the switching element.

Further, the threshold data latch unit 160 selectively performs either of the following two operations. One is an operation of fetching and holding threshold detection data converted and generated by the detection voltage ADC 140 for each of the display pixels PX in one row and sequentially transferring the threshold detection data to the frame memory 170 which will be described later via the shift register/data register unit 110. The other is an operation of sequentially fetching and holding threshold compensation data for each of the display pixels PX in one row corresponding to the threshold detection data from the frame memory 170 and transferring the threshold compensation data to the compensation voltage DAC 150.

Furthermore, prior to an operation of writing display data (luminance gradation data) to each of display pixels PX, the frame memory (a memory circuit) 170 sequentially fetches via the shift register/data register unit 110 threshold detection data based on the threshold voltage detected for each of the display pixels PX in one row by the detection voltage ADC 140 and the threshold data latch unit 160 and individually stores the data for each of the display pixels PX in one screen (one frame) of the display panel while the frame memory sequentially outputs the threshold detection data as the threshold compensation data or the threshold compensation data corresponding to the threshold detection data via the shift register/data register unit 110 and transfers the data to the threshold data latch unit 160 (the compensation voltage ADC 150).

In addition, the data line input/output switching unit (a signal path switching circuit) 180 comprises: a voltage detection side switch 181 for fetching into the detection voltage ADC 140 the threshold voltage of the switching element (thin film transistor) provided on each display pixel PX via each of data lines DL provided in a column direction of the display panel and measuring the threshold voltage; an input selection switch 182 for selecting a mode of supplying to the data line DL at least either a pre-charge voltage for compensating for the threshold voltage of the switching element provided on each display pixel PX, or a gradation signal (a gradation current or a non-light emitting display voltage) for allowing each display pixel PX to perform a light emitting operation with a luminance gradation corresponding to the display data; and a writing side switch 183 for supplying to each display pixel PX the pre-charge voltage or gradation signal selected by the input signal selection switch 182 via the data line DL.

Here, the voltage detection side switch 181 and the writing side switch 183 can be constituted of, for example, thin film transistors (field effect transistors) having different channel polarities. As shown in FIG. 1, a p-channel type thin film transistor can be applied as the voltage detection side switch 181 while an n-channel type thin film transistor can be applied as the writing side switch 183. Gate terminals (control terminals) of these thin film transistors are connected with a same signal line, so that the ON and OFF states are controlled on the basis of a signal level of a switching control signal AZ which is applied to the signal line.

<Display Pixel>

As shown in FIG. 1, the display pixel PX according to the embodiment comprises: an organic EL element OEL which is a current control type optical element; and a driving circuit DC for supplying to the organic EL element OEL a driving current having a current value corresponding to display data. The optical element and driving circuit are arranged in the vicinity of each intersection of selection lines SL arranged in a row direction (a horizontal direction in the figure) of the display panel and data lines arranged in a column direction (a vertical direction in the drawing).

The drive circuit DC includes the thin film transistors Tr11, Tr12, Tr13 and a capacitor C5. The transistor (a second switch circuit) Tr11 has a gate terminal (a control terminal) connected with a selection line SL, and drain and source terminals (one end and the other end of a current path) respectively connected with a power supply voltage line VL receiving a predetermined voltage Vsc and a contact point N11. The transistor (a third switch circuit) Tr12 has a gate terminal (a control terminal) connected with the selection line SL, and source and drain terminals (one end and the other end of a current path) respectively connected with a data line DL and a contact point N12. The transistor (a drive element, a first switch circuit) Tr13 has a gate terminal (a control terminal) connected with the contact point N11, and drain and source terminals (one end and the other end of a current path) respectively connected with the power supply voltage line VL and the contact point (a connection contact point) N12. The capacitor Cs is connected between the contact point N11 and the contact point N12 (between the gate and source terminals of the thin film transistor Tr13). Here, the thin film transistor Tr13 corresponds to a switching element for drive in which a threshold voltage becomes an object to be measured by the detection voltage ADC 140 and the threshold data latch unit 160 in the above-described display drive apparatus 100.

The organic EL element OEL has an anode terminal connected with the contact point N12 of the drive circuit DC, and a cathode terminal to which a common voltage Vcom is applied. Here, the common voltage Vcom has a potential equal to or higher than a power supply voltage Vsc set to a low potential (Vs) in a writing operation period in which a gradation signal (a gradation current or non-light emitting display voltage) corresponding to display data is supplied to the drive circuit DC in a display drive operation which will be described later. Moreover, the common voltage Vcom is set to an arbitrary potential (for example, a ground potential GND) which is lower than the power supply voltage Vsc set to a high potential (Ve) in a light emitting operation period in which a light emitting operation is performed with a predetermined luminance gradation with the supply of a driving current to the organic EL element (optical element) OEL ($Vs \leqq Vcom < Ve$).

Here, the capacitor Cs may be a parasitic capacitance formed between the gate terminal and the source terminal of the thin film transistor Tr13 or may be a capacitance in which capacitance elements are further connected in parallel between the contact point N11 and the contact point N12 in addition to the parasitic capacitance.

The thin film transistor Tr11 to Tr13 are not particularly limited to any specific type. For example, n-channel type amorphous silicon thin film transistors can be favorably applied by constituting the thin film transistors Tr11 to Tr13. In this case, the already established amorphous silicon manufacturing technology can be applied to relatively inexpensively manufacture a drive circuit including amorphous silicon thin film transistors having stable element characteristics (electron movement degree or the like).

In the following explanation, there will be explained a case in which the thin film transistors Tr11 to Tr13 are all formed of n-channel type thin film transistors. Further, the optical element which is driven by the drive circuit DC is not limited to the organic EL element OEL, but may be other optical elements such as a light emitting diode as long as they are current control type optical elements.

<Display Drive Apparatus and Drive Control Method of Display Pixel>

Next, with respect to the display drive apparatus having the above configuration, there will explained with reference to the drawings a drive control method (a drive control operation) in the case where a gradation display is made by allowing an optical element of a display pixel to perform a light emitting operation.

The drive control operation in the display drive apparatus 100 according to the embodiment roughly comprises: a threshold voltage detection operation (a threshold voltage detection period; a first step) of measuring and storing a threshold voltage of the driving thin film transistor Tr13 (a switching element; a drive element) provided on each of the display pixels PX (the drive circuit DC) arranged on the display panel at an arbitrary timing prior to a display drive operation (a pre-charge operation, a writing operation and a light emitting operation) which will be described later; and a display drive operation (a display drive period) of allowing the driving thin film transistor Tr13 provided on each of the display pixels PX to hold a voltage component (compensate for a threshold voltage) corresponding to a threshold voltage after the termination of the threshold voltage detection operation, further writing a gradation signal (a gradation current having a predetermined current value) corresponding to display data, and allowing the organic EL element OEL to perform a light emitting operation with a desired luminance gradation corresponding to the gradation signal.

Now, the respective control operations will be explained.

(Threshold Voltage Detection Operation)

Figure 2:
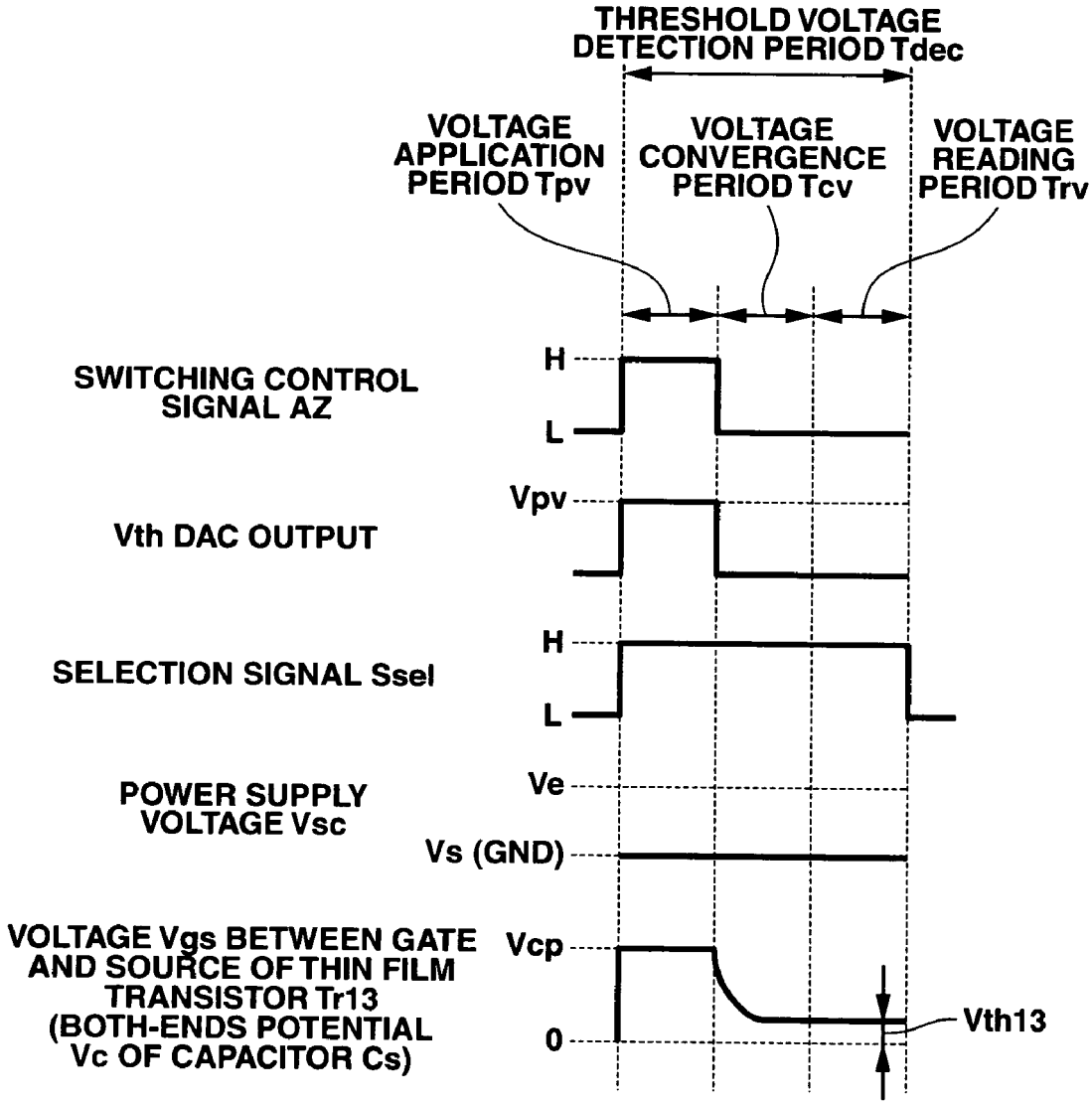
FIG. 2 is a timing chart showing a threshold voltage detection operation in the display drive apparatus according to the embodiment.

FIG. 2 is a timing chart showing a threshold voltage detection operation in the display drive apparatus according to the embodiment.

Figure 3:
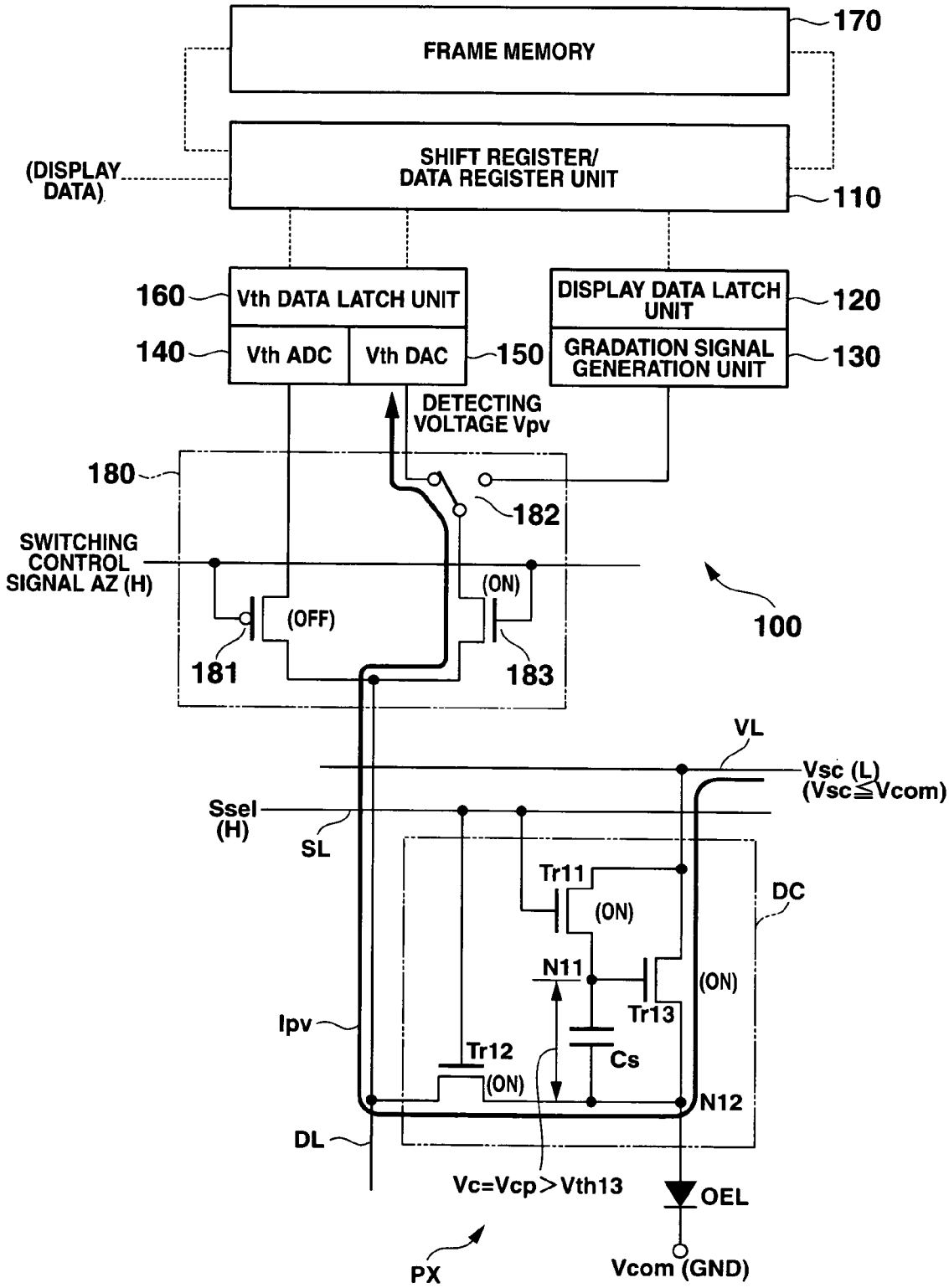
FIG. 3 is a conceptual diagram showing a voltage application operation in the display drive apparatus according to the embodiment.

FIG. 3 is a conceptual diagram showing a voltage application operation in the display drive apparatus according to the embodiment.

Figure 4:
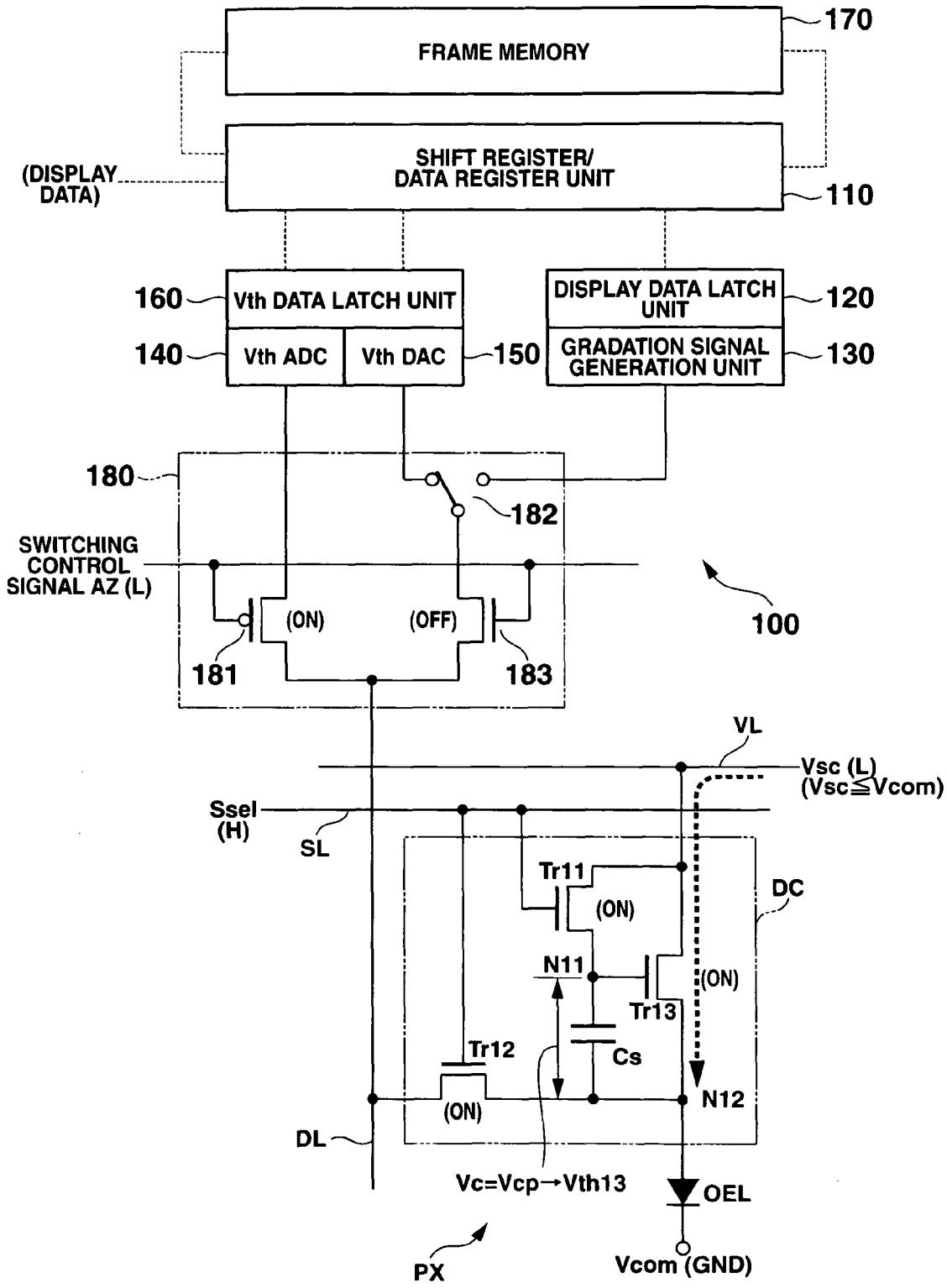
FIG. 4 is a conceptual diagram showing a voltage convergence operation in the display drive apparatus according to the embodiment.

FIG. 4 is a conceptual diagram showing a voltage convergence operation in the display drive apparatus according to the embodiment.

Figure 5:
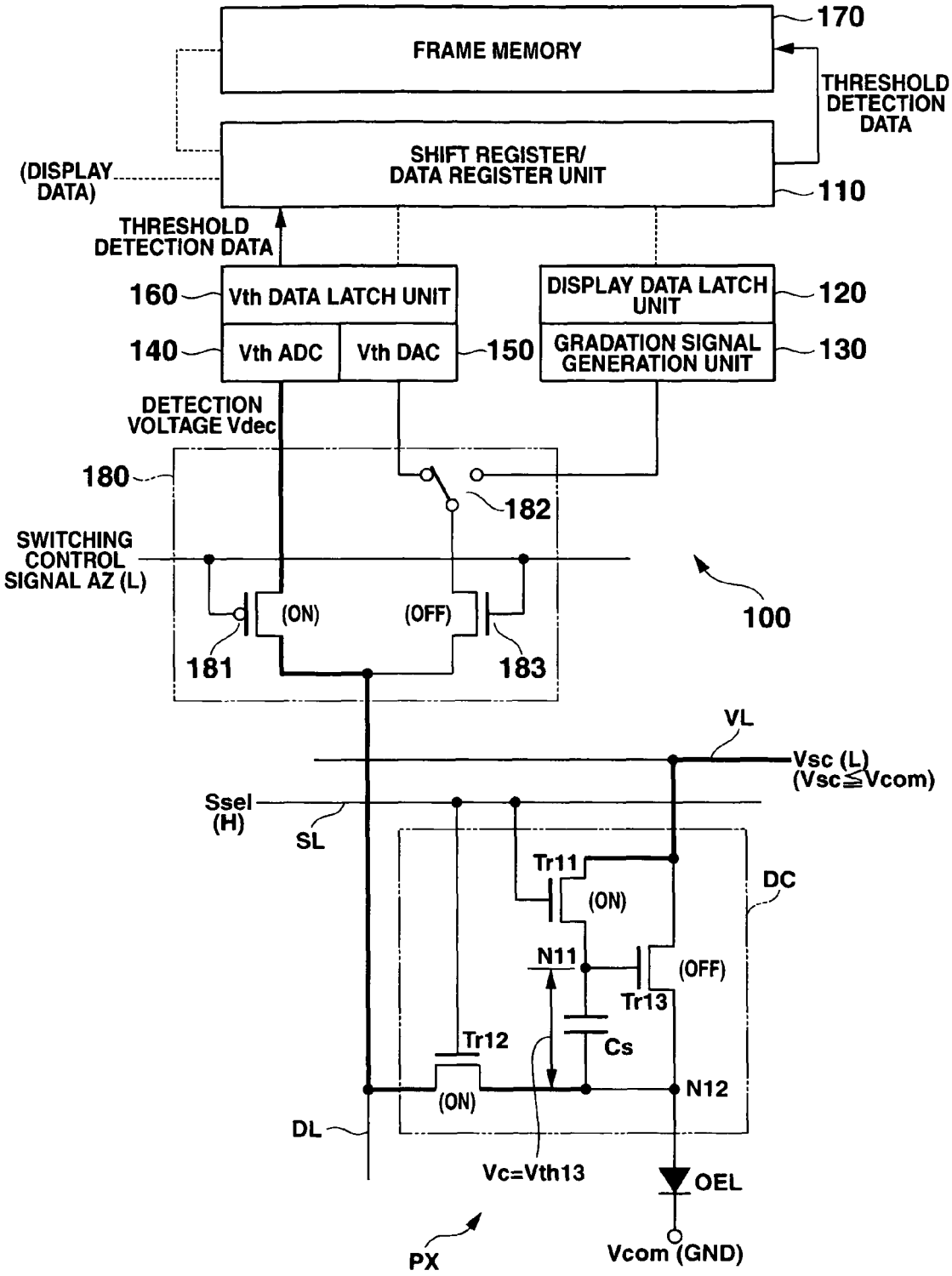
FIG. 5 is a conceptual diagram showing a voltage reading operation in the display drive apparatus according to the embodiment.

FIG. 5 is a conceptual diagram showing a voltage reading operation in the display drive apparatus according to the embodiment.

Figure 6:
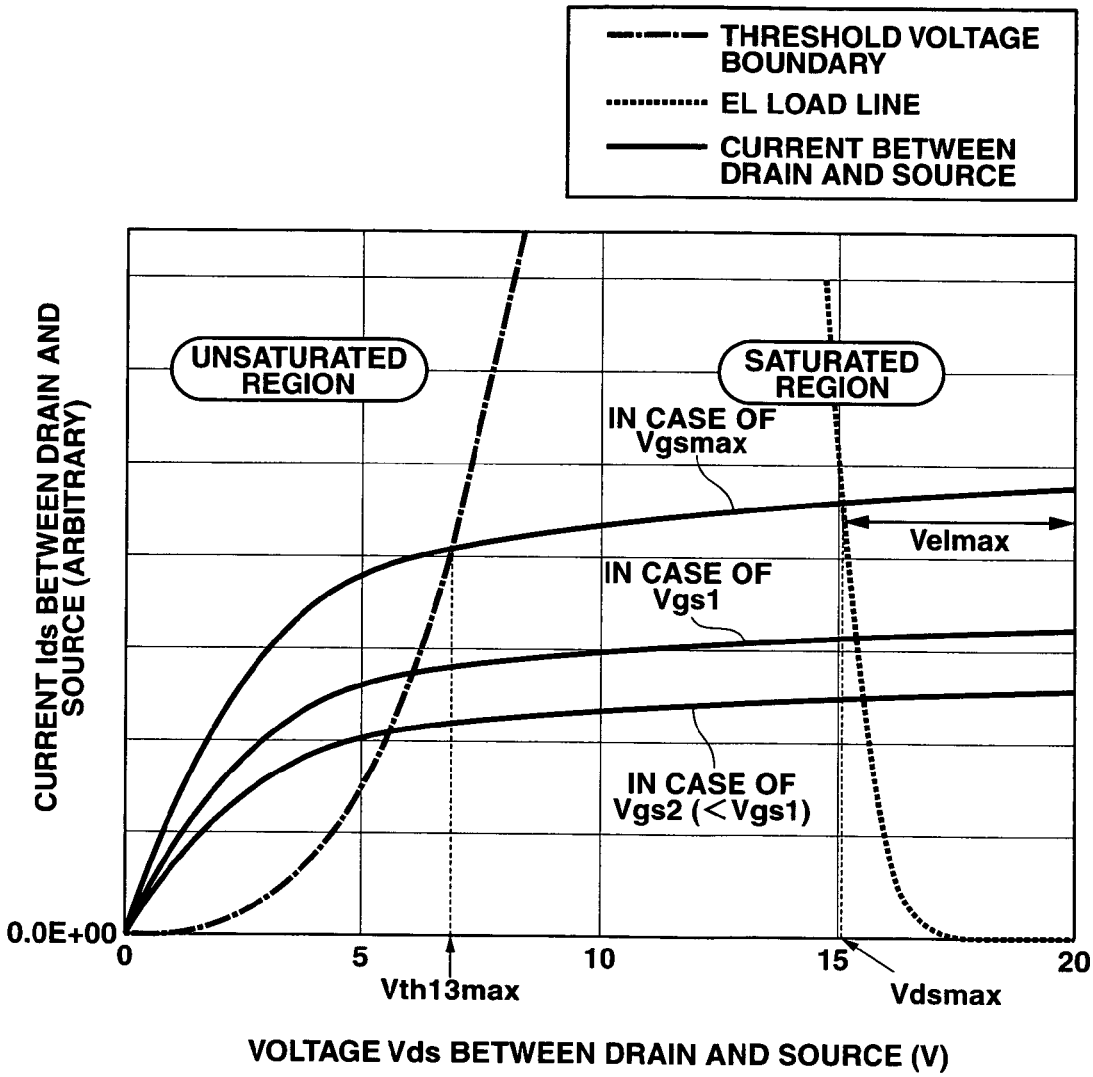
FIG. 6 is a view showing one example of current characteristics between a drain and a source at the time when a voltage between a gate and the source is set to a predetermined condition and a voltage between the drain and the source is modulated in an n-channel type thin film transistor.

FIG. 6 is a view showing one example of current characteristics between a drain and a source at the time when a voltage between a gate and the source is set to a predetermined condition and a voltage between the drain and the source is modulated in an n-channel type thin film transistor.

The threshold voltage detection operation in the display drive apparatus according to the embodiment is set, as shown in FIG. 2, to include: a voltage application period (a detecting voltage application step) Tpv of applying a voltage for threshold voltage detection (a detecting voltage Vpv) to the display pixel PX via the data line DL from the display drive apparatus 100 within a predetermined threshold voltage detection period Tdec, and holding a voltage component corresponding to the detecting voltage Vpv in between the gate and the source of the driving thin film transistor Tr13 provided on the drive circuit DC of the display pixel PX (accumulating electric charges corresponding to the detecting voltage Vpv in the capacitor Cs); a voltage convergence period Tcv of discharging part of the voltage component (electric charges accumulated in the capacitor Cs) held in between the gate and the source of the thin film transistor Tr13 in the voltage application period Tpv, and holding only the voltage component (electric charges) corresponding to a threshold voltage of a current Ids between the drain and the source of the thin film transistor Tr13 (allowing the voltage component (electric charges) to remain in the capacitor Cs); and a voltage reading period (a threshold voltage detection step) Trv of measuring the voltage component (a voltage value based on the electric charges which remain in the capacitor Cs; a threshold voltage Vth13) held in between the gate and the source of the thin film transistor Tr13 after a lapse of the voltage convergence period Tcv, and converting the measurement value into digital data to store the data in a predetermined memory area of the frame memory 170 ($Tdec \geqq Tpv+Tcv+Trv$).

Here, the threshold voltage Vth13 of the current Ids between the source and the drain of the thin film transistor Tr13 refers to a voltage Vgs between the gate and the source of the thin film transistor Tr13 which forms an operation boundary where the current Ids between the drain and the source of the thin film transistor Tr13 begins to flow by further applying a little voltage between the drain and the source. In particular, the threshold voltage Vth13 measured in the voltage reading period Trv according to the embodiment shows a threshold voltage at the time of executing the threshold voltage detection operation after a change (Vth shift) occurs in a threshold voltage in the initial manufactured state of the thin film transistor Tr13 owing to a drive history (luminance history), usage time or the like.

Hereinafter, the respective operation periods associated with the threshold voltage detection operation will be further explained in detail.

(Voltage Application Period)

First, in the voltage application period Tpv, as shown in FIGS. 2 and 3, an ON-level (a high-level) selection signal Ssel is applied to the selection line SL of the drive circuit DC while a low-potential power supply voltage Vsc (=Vs) is applied to the power supply voltage line VL. Here, the low-potential power supply voltage Vsc (=Vs) may be a voltage equal to or lower than the common voltage Vcom, and may be, for example, a ground potential GND.

In synchronization with this timing, on the other hand, the switching control signal AZ is set to a high level, so that the writing side switch 183 is set to an ON state and the voltage detection side switch 181 is set to an OFF state while the input selection switch 182 is switched to the side of the compensation voltage DAC (circuit) 150. As a result, the detecting voltage Vpv of the threshold voltage output from the compensation voltage DAC 150 is applied to the data line DL via the data line input/output switching unit 180 (the input selection switch 182 and the writing side switch 183).

As a consequence, the thin film transistors Tr11 and Tr12 provided on the drive circuit DC constituting the display pixel PX are turned on. Thus, the power supply voltage Vsc is applied to the gate terminal of the thin film transistor Tr13 and one end side (the contact point N11) of the capacitor Cs via the thin film transistor Tr11, and the detecting voltage Vpv applied to the data line DL is applied to the source terminal of the thin film transistor Tr13 and the other end side (the contact point N12) of the capacitor Cs via the thin film transistor Tr12.

Here, when the change characteristics of the current between the drain and the source are verified in the case where the voltage Vds between the drain and the source is modulated at the time of a predetermined voltage Ids between the source and the drain with respect to the n-channel type thin film transistor Tr13 for supplying a driving current to the organic EL element OEL in the display pixel PX (the drive circuit DC), the change characteristics can be represented in the characteristics view shown in FIG. 6.

In FIG. 6, a horizontal axis shows a divided voltage of the thin film transistor Tr13 and a divided voltage of the organic EL element OEL connected in series therewith whereas a vertical axis shows a current value of the current Ids between the drain and the source of the thin film transistor Tr13. A chain line in FIG. 6 show a boundary line of the threshold voltage between the gate and the source of the thin film transistor Tr13, the left side of the boundary line showing an unsaturated region and the right side of the boundary line showing a saturated region. Solid lines show the change characteristics of the current Ids between the drain and the source at the time of the modulation of the voltage Vds between the drain and the source of the thin film transistor Tr13 when the voltage Vgs between the gate and the source of the thin film transistor Tr13 is fixed respectively to a voltage Vgsmax at the time of the light emitting operation with the maximum luminance gradation and voltages Vgs1 (<Vgsmax) and Vgs (<Vgs1) at the time of the light emitting operation with arbitrary (different) luminance gradations which are the maximum luminance gradation or less. A broken line shows a load characteristics line (EL load line) in the case where the organic EL element OEL is allowed to perform a light emitting operation. The voltage on the right side of the EL load line becomes a divided voltage of the organic EL element OEL in the voltage between the power supply voltage Vsc and the common voltage Vcom (as one example, 20 V in FIG. 6). The voltage on the left side of the organic EL element OEL corresponds to the voltage Vds between the drain and the source of the thin film transistor Tr13. The divided voltage of the organic EL element OEL gradually increases with an increase in the gradation luminance, that is, an increase in the current value of the current Ids (the driving current≈gradation current) between the drain and the source of the thin film transistor Tr13.

In FIG. 6, even in the case where the voltage Vgs between the gate and the source of the thin film transistor Tr13 is set to a definite level, a current value of the current Ids between the drain and the source becomes conspicuously high (changes) with an increase in the voltage Vds between the drain and the source of the thin film transistor Tr13, in the unsaturated region. On the other hand, in the case where the voltage Vgs between the gate and the source of the thin film transistor Tr13 is set to a definite level, the current Ids between the drain and the source of the thin film transistor Tr13 does not increase so much but is settled on a definite level even with an increase in the voltage Vds between the drain and the source, in the saturated region.

Here, in the voltage application period Tpv, the detecting voltage Vpv which is applied from the compensation voltage DAC (circuit) 150 to the data line DL (and further to the source terminal of the thin film transistor Tr13 of the display pixel PX (the drive circuit DC)) is sufficiently lower than the power supply voltage Vsc (=Vs) which is set to a low potential while in the characteristic view shown in FIG. 6, the voltage Vgs between the gate and the source of the thin film transistor Tr13 is set to a voltage value at which the voltage Vds between the drain and the source of the area showing a saturated characteristics can be obtained. In the present embodiment, as the detecting voltage Vpv, for example, the maximum voltage may be set which can be applied to the data line DL from the compensation voltage DAC 150.

The detecting voltage Vpv is set so as to satisfy the following mathematical expression (1).

$$|Vs-Vpv|>Vth12+Vth13 \quad (1)$$

In the mathematical expression (1), reference symbol Vth12 denotes a threshold voltage between the drain and the source of the thin film transistor Tr12 at the time when an ON-level selection signal Ssel is applied to the gate terminal of the transistor Tr12. Furthermore, a low-potential power supply voltage Vsc is applied to both the gate and drain terminals of the thin film transistor Tr13 so that the both potentials become equal to each other. Accordingly, the Vth13 is a threshold voltage of the voltage between the drain and the source of the transistor Tr13 and is also a threshold voltage between the gate and the source of the thin film transistor Tr13. Here, although Vth12+Vth13 becomes gradually higher with the lapse of time, the potential difference of (Vs−Vpv) is set to a high level so as to always satisfy the mathematical expression (1).

In this manner, a potential difference Vcp (potential Vc between both ends) which is larger than the threshold voltage Vth13 of the thin film transistor Tr13 is applied between the gate and the source of the transistor Tr13 (that is, both ends of the capacitor Cs), whereby a detecting current Ipv having a large current corresponding to the voltage Vcp forcedly flows toward the compensation voltage (circuit) DAC 150 via the drain and the source of the thin film transistor Tr13 from the power supply voltage line VL. Therefore, electric charges which correspond to a potential difference based on the detecting current Ipv are quickly accumulated in the both ends of the capacitor Cs (that is, the voltage Vcp is accumulated in the capacitor Cs). Incidentally, in the voltage application period Vpv, not only electric charges are accumulated in the capacitor Cs, but also electric charges are accumulated for the flow of the detecting current Ipv in other capacitance components in a current route which leads to the data line DL from the power supply voltage line VL.

At this time, since the common voltage Vcom (=GND) equal to or larger than the low-potential power supply voltage Vsc (=Vs) which is applied to the power supply voltage line VL is applied to the cathode terminal of the organic EL element OEL, a location between the anode and the cathode of the organic EL element OEL is set to a non-electric field state or a reverse bias state, so that a driving current does not flow in the organic EL element OEL and no light emitting operation is performed.

(Voltage Convergence Period)

Next, in the voltage convergence period Tcv after the termination of the voltage application period Tpv, as shown in FIGS. 2 and 3, an ON-level selection signal Ssel is applied to the selection line SL. Further, the switching control signal AZ is set to a low level in a state in which the low-potential power supply voltage Vsc (=Vs) is applied to the power supply voltage line VL, and consequently, the voltage detection side switch 181 is set to an ON state while the writing side switch 183 is set to an OFF state. Furthermore, an output of the detecting voltage Vpv from the compensation voltage DAC 150 is suspended. As a consequence, the thin film transistors Tr11 and Tr12 are kept in an ON state, and thus, the display pixel PX (the drive circuit DC) is kept in an electric connection state with the data line DL. However, the other end side (the contact point N12) of the capacitor Cs is set to a high impedance state since the application of the voltage to the data line DL is blocked.

At this time, the gate voltage of the thin film transistor Tr13 is kept with the electric charges (both ends potential Vc=Vcp>Vth13) accumulated in the capacitor Cs in the voltage application period Tpv. Thus, that the thin film transistor Tr13 is kept in an ON state and the current continues to flow between the drain and the source thereof. Consequently, the potential on the side of the source terminal (the contact point N12; the other end side of the capacitor Cs) of the thin film transistor Tr13 gradually rises as the potential approaches the potential of the side of the drain terminal (the side of the power supply voltage line VL).

In this manner, part of the electric charges accumulated in the capacitor Cs is discharged, so that the voltage Vgs between the gate and the source of the thin film transistor Tr13 decreases. Finally, the voltage Vgs changes so as to be converged to the threshold voltage Vth13 of the thin film transistor Tr13. Along with this, the current Ids between the drain and the source of the thin film transistor Tr13 decreases, and finally, the flow of the current is suspended.

In this voltage convergence period Tcv as well, a potential at the anode terminal (the contact point N12) of the organic EL element OEL has a potential equal to or lower than the common voltage Vcom on the side of the cathode terminal. For this reason, no voltage is applied to the organic EL element OEL, or a reverse bias voltage is applied to the organic EL element OEL. Therefore, the organic EL element OEL performs no light emitting operation.

(Voltage Reading Period)

Next, in the voltage reading period Trv after the lapse of the voltage convergence period Tcv, as shown in FIGS. 2 and 5, an ON-level selection signal Ssel is applied to the selection line SL, a low-potential power supply voltage Vsc (=Vs) is applied to the power supply voltage line VL, the switching control signal AZ is set to a low level, as in the voltage convergence period Tcv in this state, and the potential (detection voltage Vdec) of the data line DL is measured by the detection voltage ADC 140 and the threshold data latch unit 160 electrically connected with the data line DL.

Here, the data line DL after the lapse of the voltage convergence period Tcv is set to a state of being connected with the side of the source terminal (the contact point N12) of the thin film transistor Tr13 via the thin film transistor Tr12 which is set to the ON state. Further, as described above, the potential on the side of the source terminal (the contact point N12) of the thin film transistor Tr13 corresponds to the potential on the other end side of the capacitor Cs in which the electric charges corresponding to the threshold voltage Vth13 of the thin film transistor Vth13 have been accumulated.

The potential on the side of the gate terminal (the contact point N11) of the thin film transistor Tr13 is a potential on one end side of the capacitor Cs in which the electric charges corresponding to the threshold voltage Vth13 of the thin film transistor Tr13 have been accumulated. At this time, the potential is set to a state of being connected with the low-potential power supply voltage Vsc via the thin film transistor Tr11 which is set to an ON state.

As a consequence, the potential of the data line DL which is measured by the detection voltage ADC 140 corresponds to the potential on the side of the source terminal of the thin film transistor Tr13, or the potential corresponding thereto. Accordingly, it is possible to detect the voltage Vgs between the gate and the source of the thin film transistor Tr13 (the both-ends potential Vc of the capacitor Cs), namely, the threshold voltage Vth13 of film transistor Tr13, or the voltage corresponding to the threshold voltage Vth13, on the basis of a difference (a potential difference) between the detection voltage Vdec and the low-potential power supply voltage Vsc (for example, ground potential GND) with which the set voltage is previously made clear.

The threshold voltage Vth13 (the analog signal voltage) of the thin film transistor Tr13 which is detected in this manner is converted into threshold detection data comprising the digital signal voltage by the detection voltage ADC 140, and is temporarily held in the threshold data latch unit 160 followed by sequentially reading the threshold detection data of each of the display pixels PX in one row to be stored (memorized) in a predetermined memory area of the frame memory 170. Here, since the threshold voltage Vth13 of the thin film transistor Tr13 provided on the drive circuit DC of each display pixel PX has a different degree of change (Vth shift) owing to the drive history (luminance history) or the like, the threshold detection data peculiar to each display pixel PX is stored in the frame memory 170.

(Display Drive Operation: Gradation Display Operation)

Figure 7:
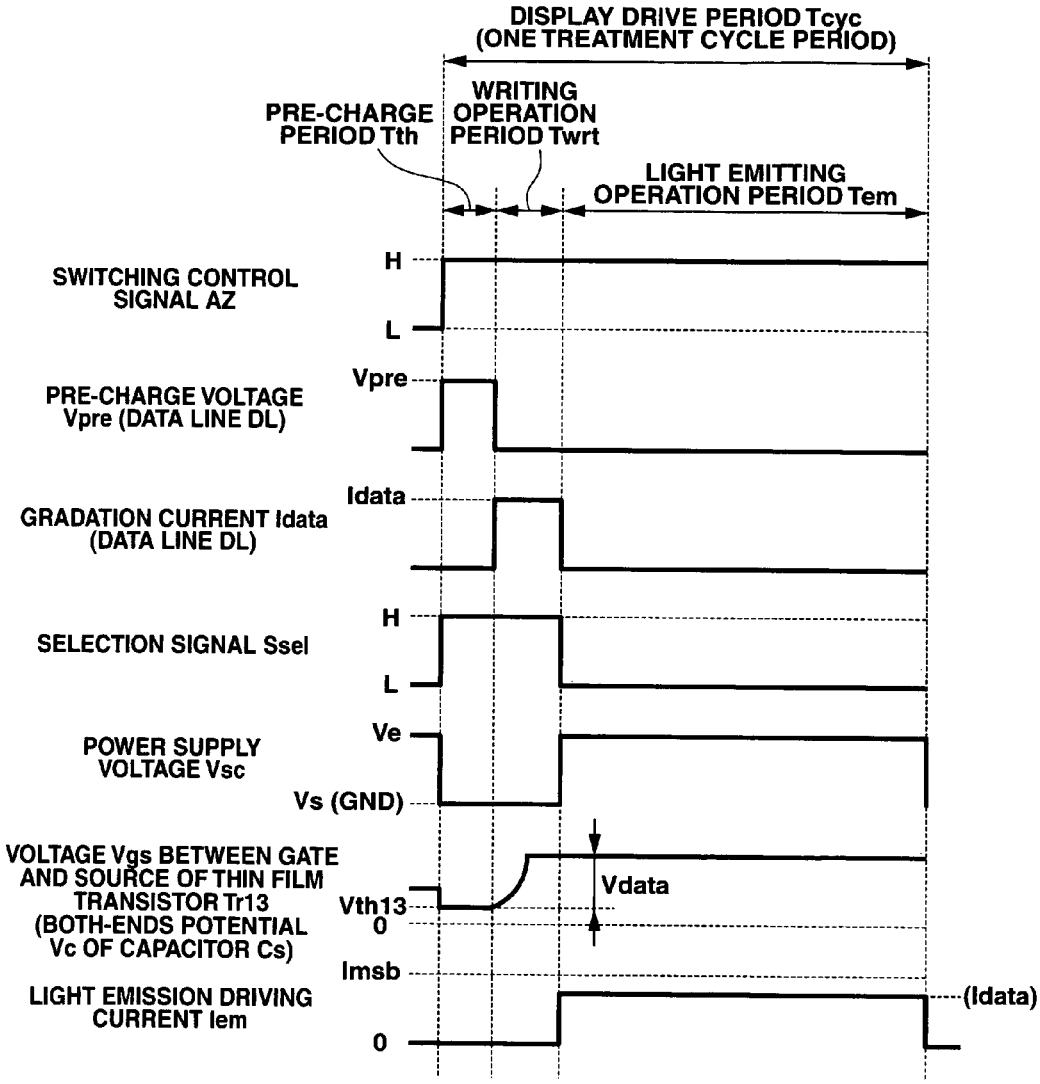
FIG. 7 is a timing chart showing a drive control method in the display drive apparatus according to the embodiment.

FIG. 7 is a timing chart showing a drive control method in the display drive apparatus according to the embodiment.

Figure 8:
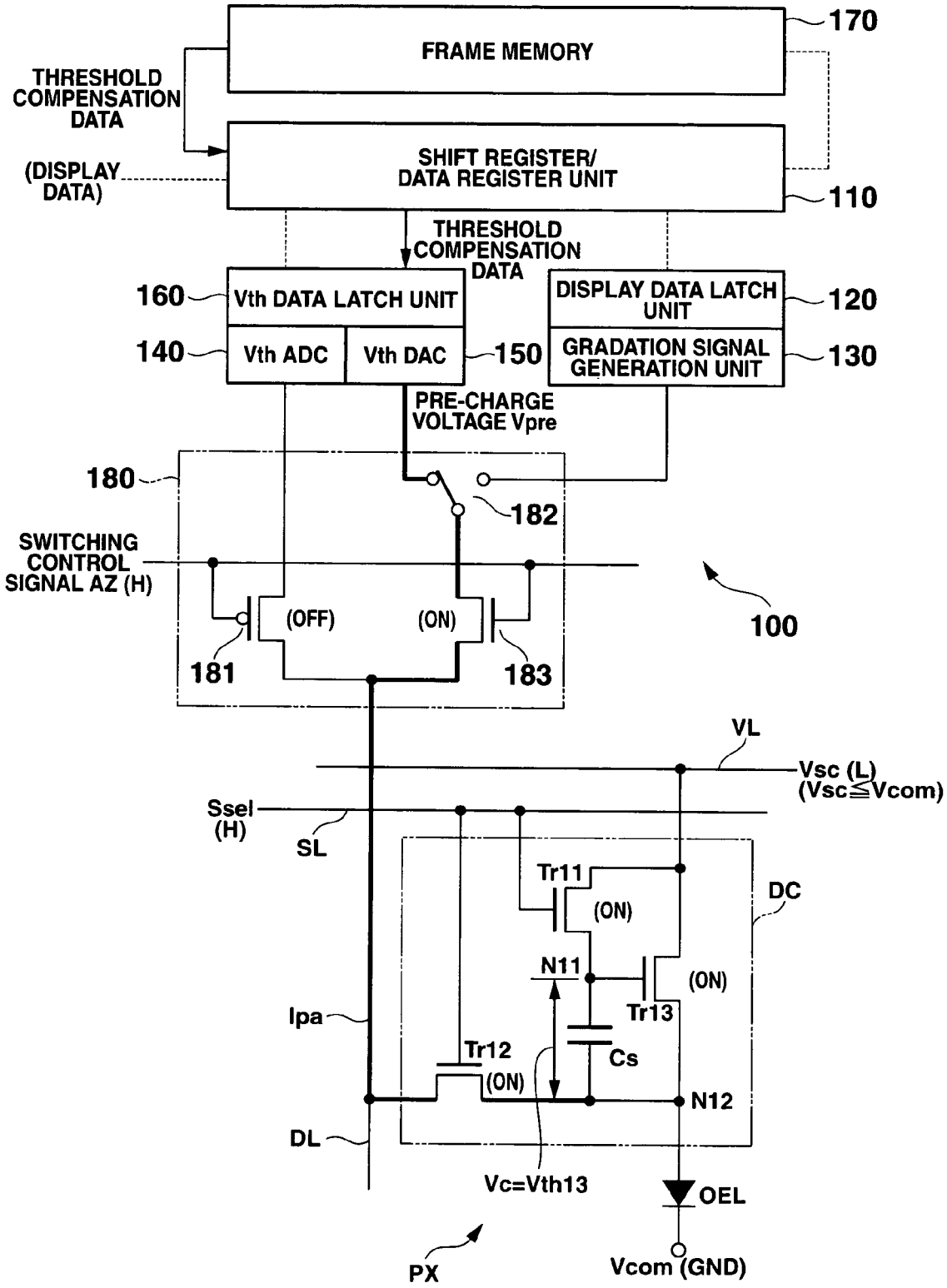
FIG. 8 is a conceptual diagram showing a pre-charge operation in the display drive apparatus according to the embodiment.

FIG. 8 is a conceptual diagram showing a pre-charge operation in the display drive apparatus according to the embodiment.

Figure 9:
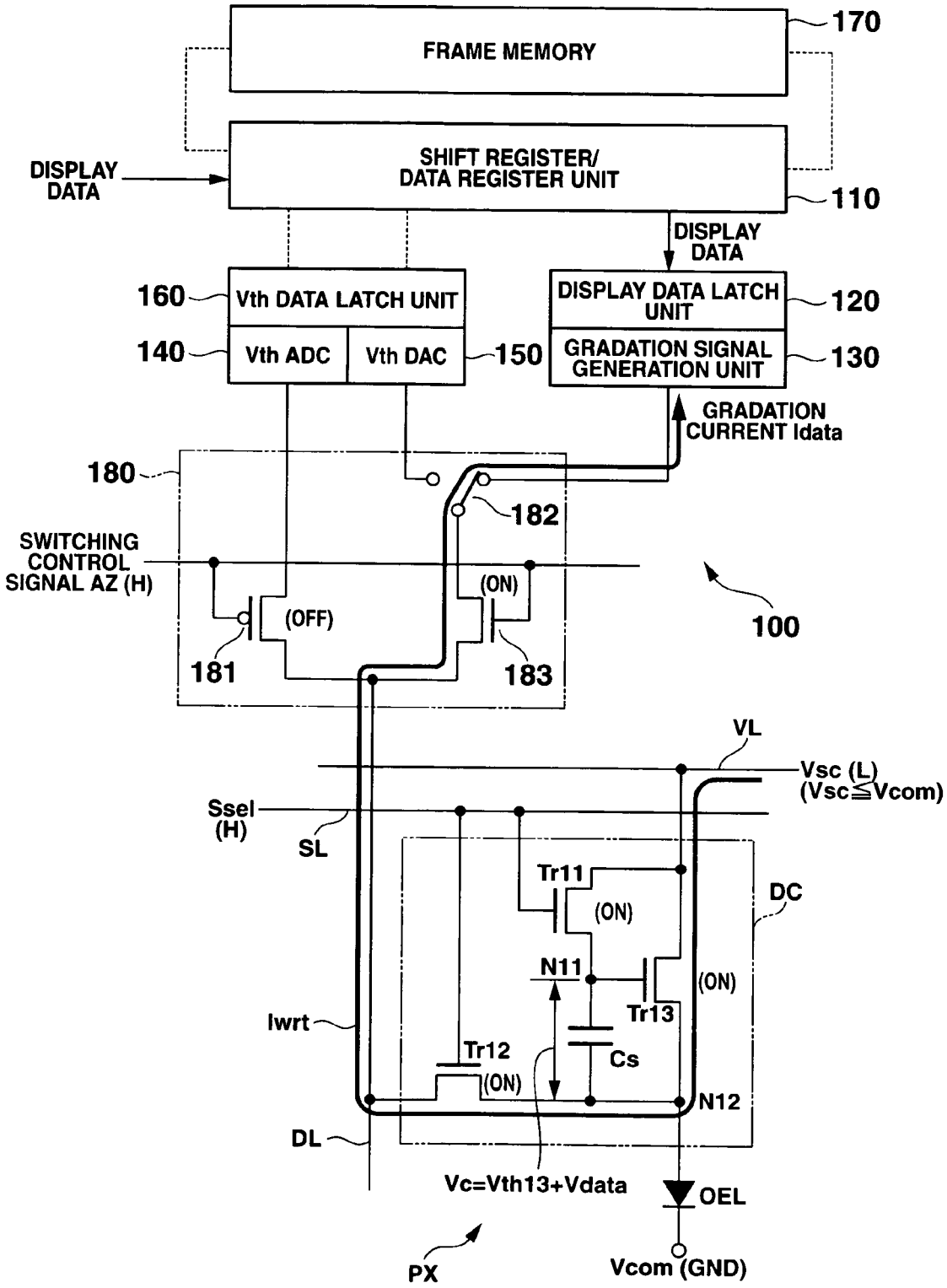
FIG. 9 is a conceptual diagram showing a data writing operation in the display drive apparatus according to the embodiment.

FIG. 9 is a conceptual diagram showing a data writing operation in the display drive apparatus according to the embodiment.

Figure 10:
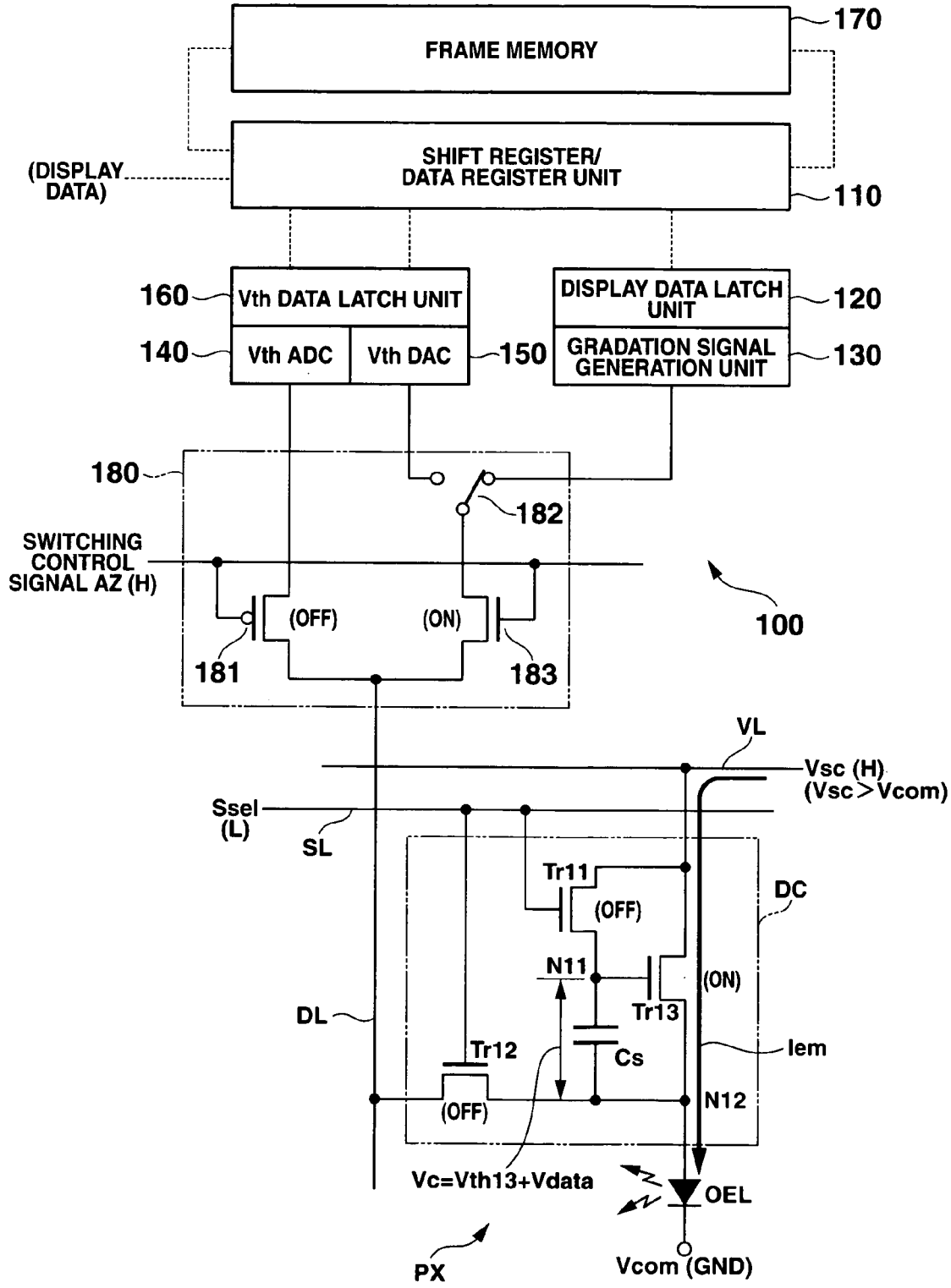
FIG. 10 is a conceptual diagram showing a light emitting operation in the display drive apparatus according to the embodiment.

FIG. 10 is a conceptual diagram showing a light emitting operation in the display drive apparatus according to the embodiment.

The display drive operation in the display drive apparatus according to the embodiment is set, as shown in FIG. 7, to include: a pre-charge period (a second step; a compensation voltage application step) Tth of applying a predetermined pre-charge voltage Vpre to a display pixel PX via a data line DL from the display drive apparatus 100 within the display drive period (one treatment cycle period), holding the voltage component (accumulating and discharging electric charges in the capacitor Cs) corresponding to the threshold voltage Vth13 of the current Ids between the drain and the source of the thin film transistor Tr13 in between the gate and the source of the driving thin film transistor Tr13 provided on the drive circuit DC of the display pixel PX, and compensating for a threshold voltage; a writing operation period (a third step; a data writing step) Twrt of applying a gradation signal (a gradation current) corresponding to display data, adding the voltage component corresponding to the gradation signal to the voltage component corresponding to the threshold voltage Vth13 held in the pre-charge period Tth to the voltage component corresponding to the gradation signal, and writing the gradation signal in between the gate and the source of the thin film transistor Tr13; and a light emitting operation period (gradation luminous step) Tem of performing a light emitting operation with a predetermined luminance gradation by allowing a driving current having a current value corresponding to the display data to flow in the organic EL element OEL on the basis of all the voltage components (total electric charges accumulated in the capacitor Cs) held in between the gate and the source of the thin film transistor Tr13 (Tcyc≧Tth+Twrt+Tem).

Here, one treatment cycle period which is applied to the display drive period Tcyc according to the embodiment is set to a period which is required for the display pixel PX to display image information of one pixel out of one frame image. That is, as explained in the drive control method of the display apparatus which will be described later, the one treatment cycle period is set to a period which is required for display pixels PX in one row to display an image of one row out of one frame image in the case where one frame image is displayed on a display panel wherein a plurality of display pixels PX are arranged in a matrix form in a row direction and in a column direction.

Hereinafter, the respective operation periods associated with the display drive operation will be further explained in detail.

(Pre-Charge Period)

First, in the pre-charge period Tth, as shown in FIGS. 7 and 8, an ON-level (a high level) selection signal Ssel is applied to the selection line SL of the drive circuit DC, and a low-potential power supply voltage Vsc (=Vs; for example, ground potential GND) is applied to the power supply voltage line VL, in the same manner as the voltage application period Tpv.

As a consequence, the thin film transistors Tr11 and Tr12 provided on the drive circuit DC are turned on, so that the power supply voltage Vsc is applied to the gate terminal (the contact point N11; one end side of the capacitor Cs) of the thin film transistor Tr13 via the thin film transistor Tr11 while the source terminal (the contact point N12) of the thin film transistor Tr13 is electrically connected with the data line DL via the thin film transistor Tr12.

In synchronization with this timing, on the other hand, the switching control signal AZ is set to a high level, so that the writing switch 183 is set to an ON state, and the voltage detection switch 181 is set to an OFF state while the input selection switch 182 is switched and set to the side of the compensation voltage DAC 150.

In this manner, the pre-charge voltage Vpre which is output from the compensation voltage DAC 150 is applied to the data line DC via the data line input/output switching unit 180 (the input selection switch 182 and writing side switch 183). Further, the pre-charge voltage Vpre is applied to the source terminal (the contact point N12) of the thin film transistor Tr13 via the thin film transistor Tr12 provided on the drive circuit DC.

Here, in the pre-charge period Tth, the pre-charge voltage Vpre which is applied to the source terminal (the contact point N12) of the thin film transistor Tr13 of the display pixel PX (the drive circuit DC) via the data line DL from the compensation voltage DAC 150 is detected for each of the display pixels PX in the threshold voltage detection operation by the detection voltage ADC 140 and the threshold data latch unit 160. On the basis of the threshold detection data which are individually stored for each display pixel PX in the frame memory 170, the pre-charge voltage has a current value for compensating for the threshold voltage Vth13 peculiar to the thin film transistor Tr13 of each display pixel PX (the drive circuit DC). The application of the pre-charge voltage Vpre allows setting a voltage value which allows holding the voltage component corresponding to the threshold voltage Vth13 in between the gate and the source of the thin film transistor Tr13 (on the both ends of the capacitor Cs).

When more specific explanation is made with respect to the threshold voltage Vth13 of the thin film transistor Tr13, there is provided an advantage in that in the case where the n-channel type amorphous thin film transistor is applied as the thin film transistors Tr11 to Tr13 constituting the drive circuit DC provided on the display pixel PX as described above, the already established amorphous silicon manufacturing technique is applied so that the thin film transistor having uniform element characteristics can be formed, and a drive circuit having stable operation characteristics can be manufactured in a relatively easy manufacturing process.

However, the amorphous silicon thin film transistor is known in that generally a change (Vth shift) in threshold voltage conspicuously occurs owing to a drive history. As a drive control method for suppressing an influence of the change in threshold voltage, there is known a drive control method of a current gradation specification mode (or, a current gradation specification drive) of directly flowing a current component (a gradation current) of a gradation signal corresponding to display data via a data line DL toward a drive circuit DC provided on a display pixel PX. In this drive control method, even a capacitance element formed (parasitic) on a channel which is supplied with the gradation current is charged by the gradation current to a predetermined voltage in addition to a location between the gate and the source of the driving thin film transistor Tr13 (the both ends of the capacitor Cs). For this reason, there is a possibility that the light emitting operation is not performed with a desired luminance gradation because, in the case where a light emitting operation (low gradation display) is performed with a low luminance gradation, the gradation current becomes minute with the result that the charging operation takes a considerable time, the writing operation of the gradation signal is not completed in a predetermined time, and a writing insufficiency is generated in which the voltage component held in between the gate and the source of the thin film transistor Tr13 (the both ends of the capacitor Cs) becomes insufficient with respect to the display data.

More specifically, in the drive control method of the current control specification mode, many voltage components out of the voltage Vgs between the gate and the source of the thin film transistor Tr13 which is required for flowing between the drain and the source of the thin film transistor Tr13 the gradation current corresponding to the display data at the time of the writing operation which will be described later contribute toward the threshold voltage Vth13 of the thin film transistor Tr13. Particularly, it has been clarified as a result of each kind of experiment made by the inventors of the application that in the voltage Vgs (=V1*sb*) between the gate and the source of the thin film transistor Tr13 which voltage is required for allowing the organic EL element OEL to perform a light emitting operation with the minimum luminance gradation (LSB), a ratio of the voltage components which contribute toward the threshold voltage Vth13 out of the held voltage components (all the electric charges) largely exceeds 50%.

There has been a possibility that a disadvantage is generated in that when an attempt is made to charge the voltage component (an electric charge capacitance) corresponding to this threshold voltage Vth13 in between the source and the gate (in the capacitor Cs) only in the writing operation of a gradation signal (a gradation current having a minute current value) without applying the pre-charge operation (application of the pre-charge voltage Vpre) according to the embodiment, the writing operation period Twrt which will be described later is largely prolonged with the result that the image information cannot be displayed in a favorable state in a predetermined treatment period (a frame period).

Therefore, in the present embodiment, prior to the writing operation of the gradation signal which will be described later, the pre-charge period Tth is provided to apply the pre-charge voltage Vpre. Consequently, the voltage component corresponding to the threshold voltage Vth13 at the current point of the thin film transistor Tr13 (the threshold voltage at the time of the threshold voltage detection operation after the Vth shift by the drive history) is set to a state of being held in between the gate and the source of the thin film transistor Tr13 (the both ends of the capacitor Cs). In addition, only the voltage component (substantial voltage components for a gradation display corresponding to the display data except for a portion of the threshold voltage Vth13; effective voltage Vdata) is added to the voltage component corresponding to the threshold voltage Vth13 to enable being held in between the gate and the source of the thin film transistor Tr13 without charging the voltage component corresponding to the threshold voltage Vth13 in between the gate and the source of the thin film transistor Tr13 with the gradation signal even with a minute gradation current at the time of the low gradation display.

In this pre-charge period Tth, the voltage component corresponding to the threshold voltage Vth13 peculiar to the thin film transistor Tr13 is controlled to be set in a state of being held in between the gate and the source of the thin film transistor Tr13. For this reason, a current scarcely flows between the drain and the source of the thin film transistor Tr13. Furthermore, the potential on the side of the anode terminal (the contact point N12) of the organic EL element OEL is equal to or less than the common voltage Vcom on the side of the cathode terminal. Therefore, no voltage or a reverse bias voltage is applied to the organic EL element OEL, so that the organic EL element OEL does not perform a light emitting operation.

In this manner, in order to hold voltage component corresponding to the threshold voltage Vth13 in between the gate and the source of the thin film transistor Tr13, the pre-charge voltage Vpre having a voltage value corresponding to the threshold voltage Vth13 peculiar to each thin film transistors Tr13 is directly applied to the side of the source terminal (the contact point N12) without flowing a current based on the voltage component in the drive circuit DC and the data line DL. Accordingly, the voltage component corresponding to the threshold voltage Vth13 can be swiftly charged in the driving thin film transistor Tr13 (the capacitor Cs) of each display pixel PX (the drive circuit DC).

(Writing Operation Period)

Next, in the writing operation period Twrt after the completion of the pre-charge period Tth, as shown in FIGS. 7 and 9, an ON level selection signal Ssel is applied to the selection line SL and a low-potential power supply voltage Vsc (=Vs) is applied to the power supply voltage line VL. Consequently, in a state in which the switching control signal AZ is set to a high level, the input selection switch 182 is switched and set to the side of the gradation signal generation unit 130, so that a gradation signal (a gradation current Idata having a negative polarity) output from the gradation signal generation unit 130 in accordance with the display data is supplied to the data line DL via the data line input/output switching unit 180 (the input selection switch 182 and writing side switch 183). Here, the gradation current Idata having a negative polarity is supplied as a negative signal, whereby the current flows from the side of the data line DL in the direction of the gradation signal generation unit 130 via the data line input/output switching unit 180 to be drawn in a direction of the gradation signal generation unit 130.

As a consequence, the thin film transistor Tr11 provided on the display pixel PX is turned on, so that the low-potential power supply voltage Vsc (=Vs) is applied to the gate of the thin film transistor Tr13 and one end side (the contact point N11) of the capacitor Cs via the thin film transistor Tr11. In addition, the thin film transistor Tr12 is turned on and the gradation current Idata is drawn via the data line DL, whereby a voltage having a potential lower than the power supply voltage Vsc is applied to the side of the source terminal (the contact point N12; the other end side of the capacitor Cs) of the thin film transistor Tr13. As a consequence, the thin film transistor Tr13 is turned on in a predetermined conductive state, and as shown in FIG. 9, a writing current Iwrt which corresponds to the current value of the gradation current Idata swiftly flows from the power supply voltage line VL to the display drive apparatus 100 (the gradation signal generation unit 130) via the thin film transistor Tr13, the contact point N12, the thin film transistor Tr12 and the data line DL.

Here, the capacitor Cs connected between the gate and the source of the thin film transistor Tr13 is set to a state in which voltage component corresponding to the threshold voltage Vth13 peculiar to the thin film transistor Tr13 is held (electric charges are accumulated) in the pre-charge period Tth. Therefore, electric charges of the capacitance which is required for the writing current Iwrt based on the gradation current Idata to be set to a stationary state between the drain and the source of the thin film transistor Tr13 does not include the threshold voltage Vth13. The electric charges may be the gradation current Idata (the writing current Iwrt) having a current value for charging only the effective voltage Vdata for providing a gradation display in accordance with the display data, and the electric charges may be charged in between the gate and the source of the thin film transistor Tr13 in a relatively short time.

Accordingly, even in the case where the threshold voltage Vth13 of the thin film transistor Tr13 is Vth shifted with the light emission history (the drive history) or the like, the voltage component Vdata appropriately corresponding to the gradation signal (display data) can be swiftly and sufficiently written in the writing operation period Twrt. Incidentally, in this writing operation period Twrt, the voltage Vgs between the gate and the source of the thin film transistor Tr13, namely a quantity of electric charges accumulated in the capacitor Cs is definitely set by the current (the writing current Iwrt) between the source and the drain of the thin film transistor Tr13. As a result, the voltage Vc charged in the capacitor Cs specifically becomes a sum total (Vth13+Vdata) of the voltage components (the effective voltage) Vdata corresponding to the threshold voltage Vth13 peculiar to the thin film transistor Tr13 and the gradation current Idata.

At this time, since the low-potential power supply voltage Vsc (=Vs) is applied to the power supply voltage line VL, and further the writing current Iwrt is controlled in such a manner that the current Iwrt flows in a direction of the data line DL via the drive circuit DC from the power supply voltage line VL, the potential applied to the anode terminal (the contact point N12) of the organic EL element OEL is equal to or less than the potential Vcom (GND) of the cathode terminal. For this reason, a reverse bias voltage is applied to the organic EL element OEL, so that a driving current does not flow in the organic EL element OEL and no light emitting operation is performed.

(Light Emitting Operation Period)

Next, in the light emitting operation period Tem after the completion of the writing operation period Twrt, as shown in FIGS. 7 and 10, an OFF level (a low level) selection signal Ssel is applied to the selection line SL and a high-potential power supply voltage Vsc (=Vs) is applied to the power supply voltage line VL. Furthermore, in synchronization with this timing, an operation of drawing the gradation current Idata by the gradation signal generation unit 130 is suspended.

As a consequence, the thin film transistors Tr11 and Tr12 provided on the drive circuit DC are turned on, so that the application of the power supply voltage Vsc to the gate terminal (the contact point N11; one end side of the capacitor Cs) of the thin film transistor Tr13 and the drain terminal is blocked while an electric connection between the data line DL and the source terminal (the contact point N12; the other end of the capacitor Cs) is disconnected. Therefore, the electric charges accumulated in the capacitor Cs in the writing operation period Twrt are held.

In the light emitting operation period Tem, the high-potential power supply voltage Vsc (=Ve) which is applied to the power supply voltage line VL is set in such a manner that the power supply voltage Vsc becomes a voltage value (a positive voltage which becomes a forward bias with respect to the voltage Vcom connected with the cathode side of the organic EL element OEL) not less than the anode voltage which value is required at the time of allowing the organic EL element OEL to perform the light emitting operation with the maximum luminance gradation (MSB).

Specifically, the high-potential power supply voltage Vsc (=Ve) is set to a voltage value which satisfies the following mathematical expression (2).

$$|Ve-Vcom|>Vds\max+Vel\max \quad (2)$$

In the mathematical expression (2), reference symbol Vdsmax denotes a maximum voltage value between the drain and the source of the thin film transistor Tr13 such that the voltage between the drain and the source reaches a saturated region shown in FIG. 6 in the light emitting operation Tem in the case where the gradation current Idata is allowed to flow at the time of the light emitting operation with the maximum luminance gradation. In addition, reference symbol Velmax denotes a divided voltage of the organic EL element OEL at the time of the maximum luminance gradation.

In this manner, a sum total of the voltage components (Vth13+Vdata) charged in the capacitor Cs at the time of the pre-charge operation and the writing operation is held as the both-end potential Vc of the capacitor Cs. Consequently, the voltage Vgs (that is, the potential of the contact point N11) between the gate and the source of the thin film transistor Tr13 is held with the result that the thin film transistor Tr13 maintains the ON state.

Accordingly, in the light emitting operation period Tem, as shown in FIG. 10, a driving current Iem flows in a direction of the organic EL element OEL via the thin film transistor Tr13 and the contact point N12 from the power supply voltage line VL, and the organic EL element OEL emits light with a predetermined luminance gradation corresponding to the current value of the driving current Iem. Here, the electric charges (both-end potential Vc) held in the capacitor Cs in the light emitting operation period correspond to the potential difference in the case where the writing current Iwrt which corresponds to the gradation current Idata is allowed to flow in the thin film transistor Tr13 as described above. Thus, the driving current Iem which flows in the organic EL element OEL has a current value (Iem≈Iwrt=Idata) which is equal to the writing current Iwrt (the gradation current Idata). Consequently, the driving current Iem corresponding to a predetermined light emitting state (a luminance gradation) is supplied on the basis of the voltage component (the effective voltage Vdata) written in the writing operation period Twrt, and the organic EL element OEL continuously emits light with a luminance gradation corresponding to the display data (the gradation signal).

In this manner, according to the display drive apparatus and the display pixel according to the embodiment, the voltage component corresponding to the threshold voltage Vth13 is held in between the gate and the source of the thin film transistor Tr13 in the pre-charge period. Furthermore, the gradation current Idata (the writing current Iwrt) for which a current value corresponding to the light emitting state (the gradation luminance) of the organic EL element OEL is specified in the writing operation period is forcedly allowed to flow between the drain and the source of the thin film transistor Tr13 to hold the voltage component Vdata corresponding to the current value in between the gate and the source of the thin film transistor Tr13. Consequently, the drive control method of current gradation specification mode for performing a light emitting operation with a predetermined luminance gradation is applied by controlling the driving current Iem which is allowed to flow in the organic EL element (the optical element) OEL on the basis of the voltage component (the effective voltage Vdata) substantially corresponding to the gradation current Idata. Furthermore, there are realized a function (a current/voltage conversion function) of converting a current level of a gradation current Idata corresponding to desired display data (a luminance gradation) into a voltage level by a single switching element (thin film transistor Tr13) for drive, and a function (a drive function) of supplying a driving current Iem having a predetermined current value to the organic EL element OEL. This makes it possible to realize desired light emitting characteristics free from an influence of a variation in the respective element characteristics of the thin film transistors constituting a drive circuit DC and a change with the lapse of time.

In addition, in the display drive apparatus and the display pixel according to the embodiment, the pre-charge operation is performed prior to the writing operation of the display data (the gradation signal) to the display pixel PX and the light emitting operation of the organic EL element OEL. Consequently, it is possible to set to a state in which the pre-charge voltage Vpre is applied to the capacitor Cs connected between the gate terminal and the source terminal of the driving thin film transistor Tr13 provided on the drive circuit DC to hold the voltage component corresponding to the threshold voltage Vth13 peculiar to the thin film transistor Tr13 (the electric charges are accumulated).

Therefore, even in the case where the threshold voltage Vth13 of the switching element (the thin film transistor Tr13) for drive provided on each display pixel PX (the drive circuit DC) is changed (shifted) owing to the change with the lapse of time, the drive history or the like, it is possible to set, in the pre-charge operation, to a state in which electric charges corresponding to the threshold voltage Vth13 peculiar to the individual thin film transistor TR13 can be appropriately accumulated. As a consequence, in the writing operation of the display data, it is not required to charge the capacitor Cs with the gradation current Idata based on the display data to a capacitance corresponding to the threshold voltage Vth13. The capacitor Cs may be charged by adding only the voltage component (the effective voltage) Vdata corresponding to the display data (the luminance gradation). Therefore, the electric charges based on the display data may be swiftly accumulated in the capacitor Cs and the generation of the writing insufficiency is suppressed, so that the organic EL element OEL can be allowed to perform a light emitting operation with an appropriate luminance gradation corresponding to the display data.

In the present embodiment, there is shown the configuration of the display drive apparatus and the drive control method thereof wherein the detecting voltage Vpv which is applied to the drive circuit DC (the side of the source terminal of the thin film transistor Tr13) of each display pixel PX in the voltage application period Tpv is applied to the data line DL via the input selection switch 182 and the writing side switch 183 from the compensation voltage DAC 150 in the threshold voltage detection operation which is performed prior to the display drive operation. However, the present invention is not limited thereto. For example, as shown in the following description, a dedicated power source for applying the detecting voltage Vpv to the data line DL may be provided.

Figure 11:
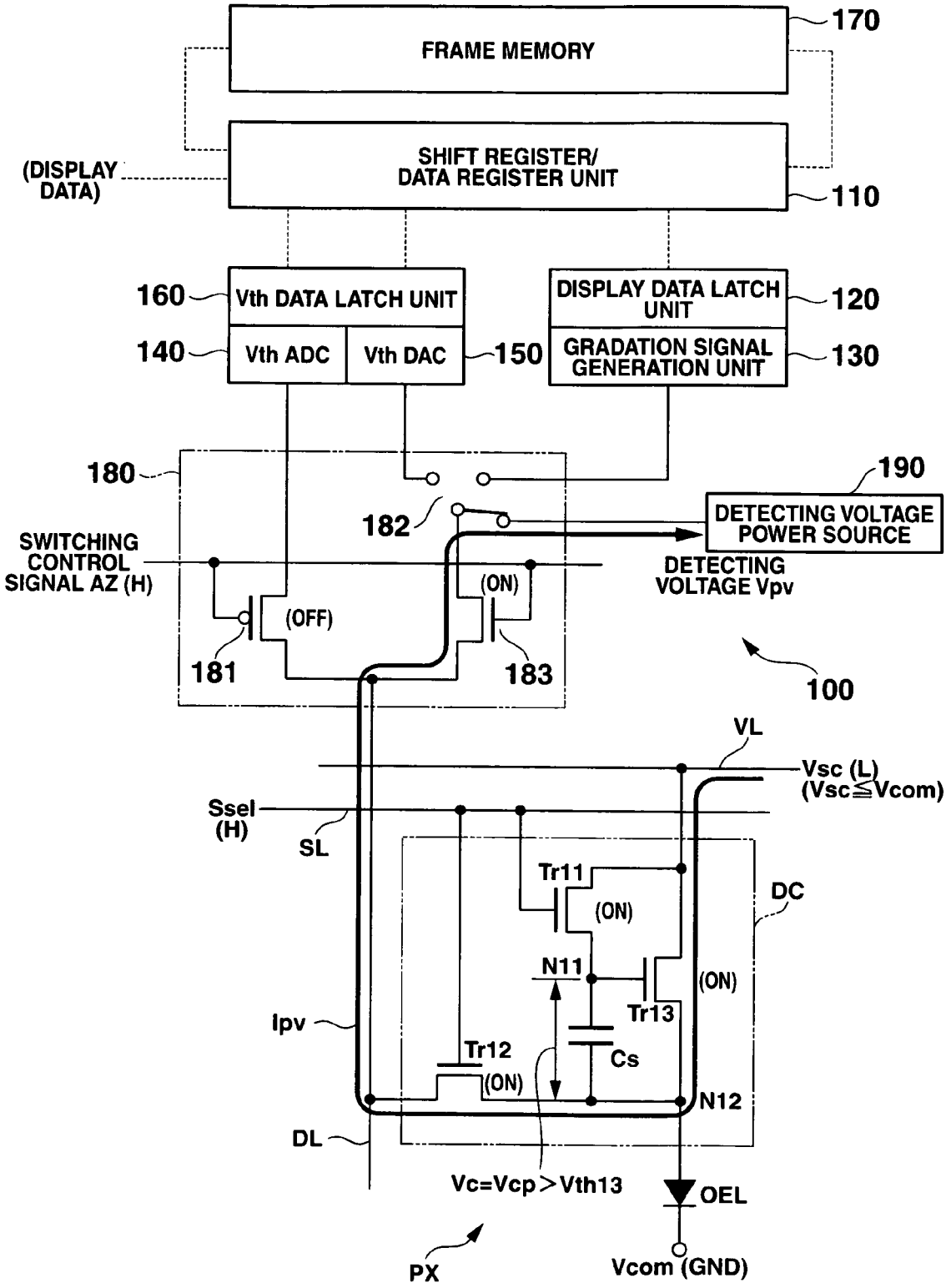
FIG. 11 is a structural diagram of a primary part showing another structural example of the display drive apparatus according to the embodiment.

FIG. 11 is a structural diagram of a primary part showing another structural example of the display drive apparatus according to the embodiment. An explanation on the configuration same as that of the above-described embodiment will be omitted.

The display drive apparatus according to the present structural example is configured, as shown in FIG. 11, to have, independently of the compensation voltage DAC 150, a detecting voltage power source 190 for outputting a detecting voltage Vpv in addition to the configuration (refer to FIG. 11) of the display drive apparatus 100. In addition, the display drive apparatus is constituted in such a manner that the input selection switch 182 provided on the data line input/output switching unit 180 is capable of selectively connecting any of the compensation voltage DAC 150 (the pre-charge voltage Vpre), the gradation signal generation unit 130 (the gradation current Idata) and the detecting voltage power source 190 (the detecting voltage Vpre) to the data line DL.

With this configuration, it is possible to apply a detecting voltage Vpv which has an arbitrary voltage value the data line DL only with the control of switching the input selection switch 182 and the writing side switch 183 of the data line input/output switching unit 180 to the side of the detecting voltage power source 190 in the voltage application period Tpv described above, so that a treatment load for the operation of outputting the detecting voltage Vpv in the compensation voltage DAC 150 can be alleviated.

(Display Drive Operation: Non-Light Emitting Operation)

Next, by referring to the drawings, there will be explained a drive control method in the case where a non-light emitting operation (a black display) is performed wherein the optical element is not allowed to perform a light emitting operation in the display drive apparatus and display pixel having the above-described configuration.

Figure 12:
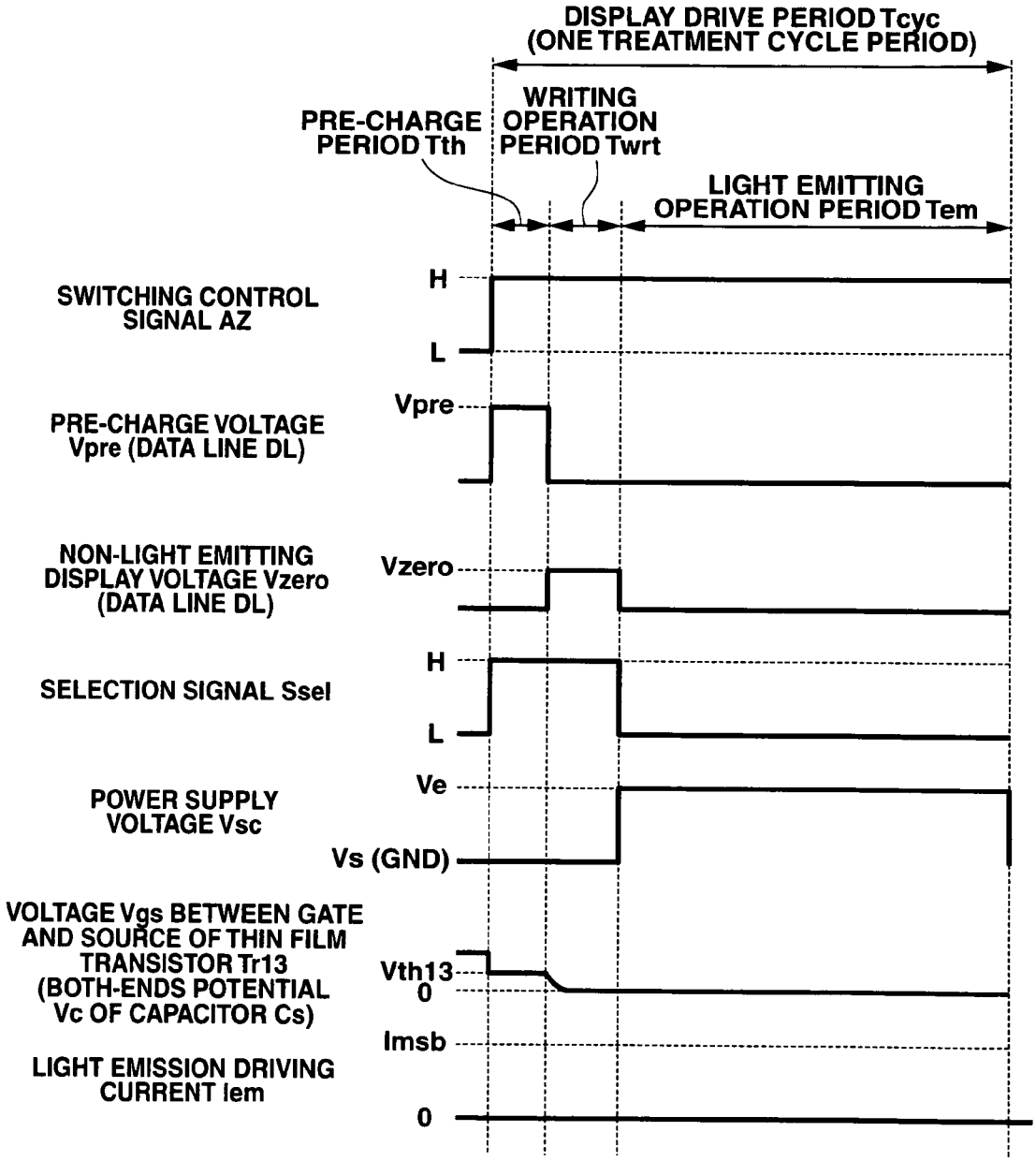
FIG. 12 is a timing chart showing a drive control method (a non-light emitting operation) in the display drive apparatus according to the embodiment.
Figure 13:
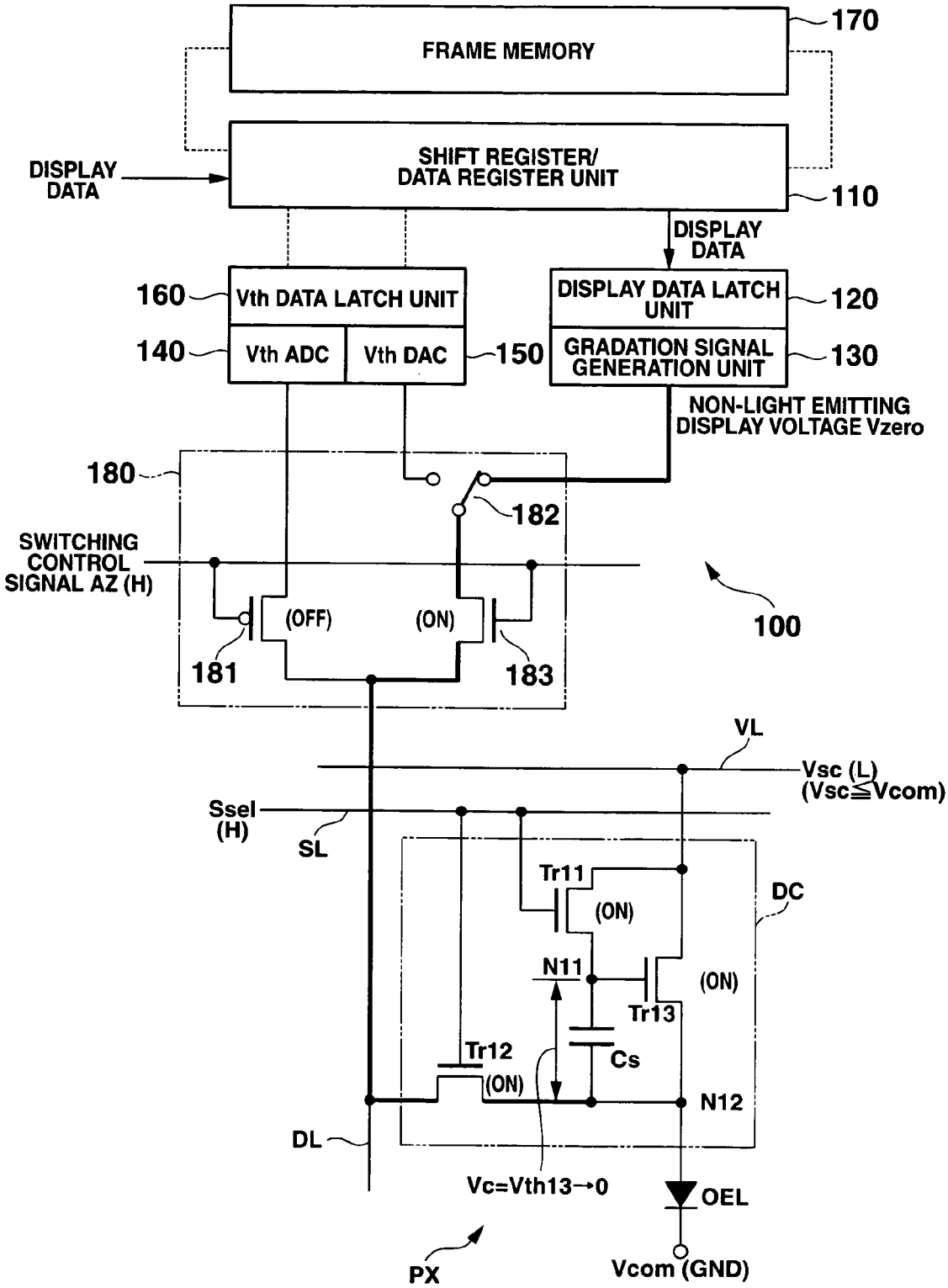
FIG. 13 is a conceptual diagram showing another example of the data writing operation in the display drive apparatus according to the embodiment.
Figure 14:
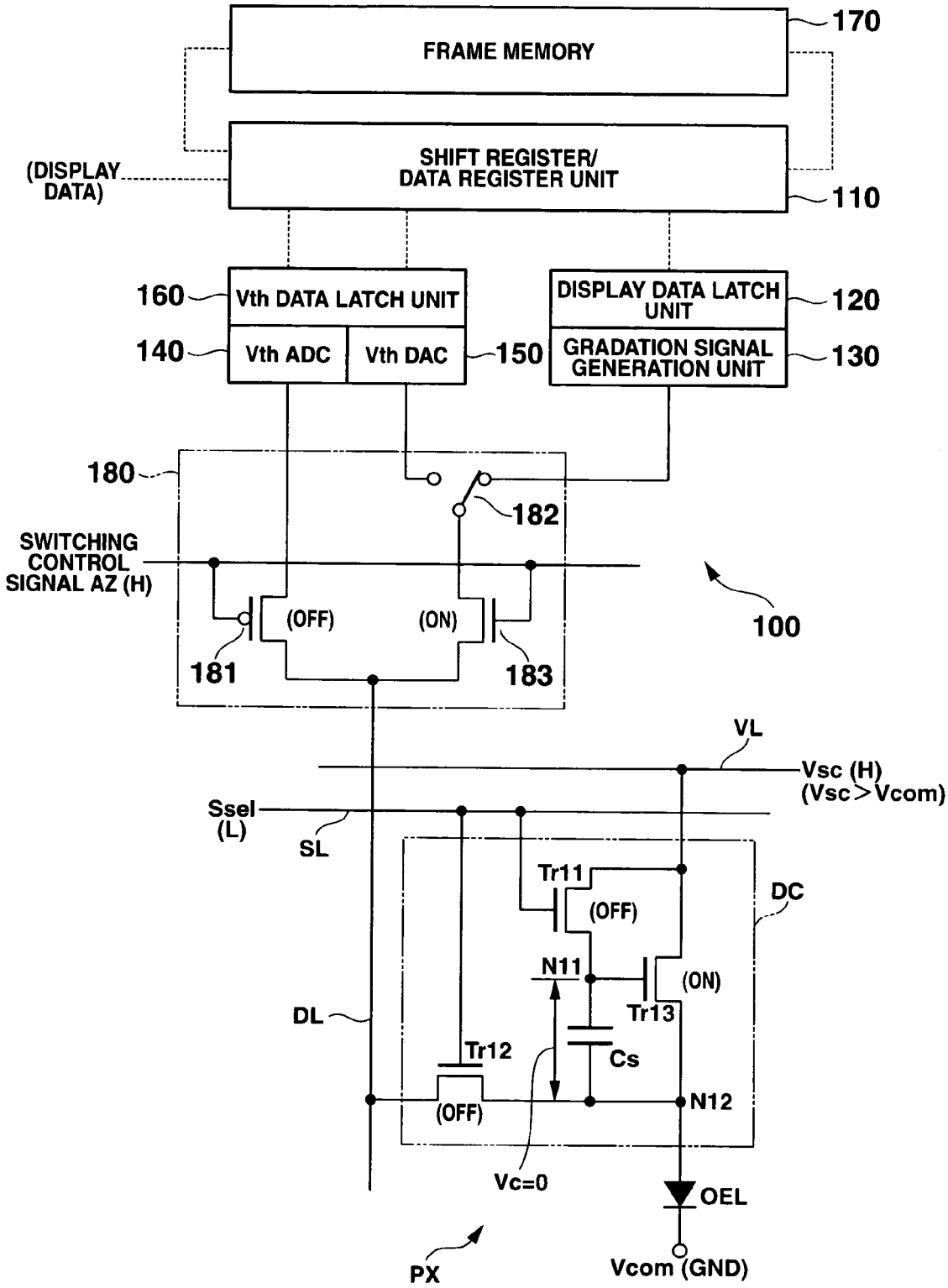
FIG. 14 is a conceptual diagram showing a non-light emitting operation in the display drive apparatus according to the embodiment.

FIG. 12 is a timing chart showing a drive control method (a non-light emitting operation) in the display drive apparatus according to the embodiment. FIG. 13 is a conceptual diagram showing another example of the data writing operation in the display drive apparatus according to the embodiment. FIG. 14 is a conceptual diagram showing a non-light emitting operation in the display drive apparatus according to the embodiment. Here, an explanation on the drive control which is the same as that of the gradation luminance operation will be simplified or omitted.

The drive control operation in the display drive apparatus according to the embodiment is configured, as shown in FIG. 12, to includes a display drive operation (a display drive period) of allowing the driving thin film transistor Tr13 provided on each display pixel PX to hold a voltage component corresponding to the threshold voltage Vth13 to compensate for the threshold voltage Vth13 followed by writing a gradation signal (a non-light emitting display voltage Vzero) corresponding to display data to set the organic EL element OEL to a non-light emitting state.

That is, in the drive control operation at the time of performing the gradation display operation described above, the power supply voltage Vsc is set so as to be shifted from the low potential (Vs) to the high potential (Ve) at the time of moving from the writing operation period Twrt set at the time of the display drive operation (the display drive period) to the light emitting operation period Tem. For this reason, there appears a phenomenon in which a potential (a gate potential) which is applied to the gate terminal (the contact point N11) of the thin film transistor TR13 rises owing to a change of the electric charges held in the capacitance components or the like which are parasitic on the thin film transistor Tr11.

Here, in the case where the luminance gradation based on the display data is set to the minimum gradation (a black display state), the current value of the gradation current Idata is set to a minute state or 0 (namely, the state in which the gradation current Idata does not flow). However, the voltage (the both-end potential Vc) which is charged in the capacitor Cs in the pre-charge period Tth is set to a value in the vicinity of the threshold voltage Vth13 peculiar to the thin film transistor Tr13. Therefore, there is a possibility that in the case where a slight change in the gate potential occurs due to the movement from the writing operation period Twrt to the light emitting operation period Tem, the thin film transistor Tr13 is turned on and a driving current flows, so that the non-light emitting operation (a black display) according to the display data cannot be realized (becomes unstable).

In order to stabilize the non-light emitting display operation, it is preferable that the voltage component (the accumulated electric charges) applied in the capacitor Cs is discharged in the light emitting operation Tem, the voltage Vgs between the gate and the source of the thin film transistor Tr13 (the both-end potential Vc of the capacitor Cs) is set to a level sufficiently lower than the threshold voltage Vth13 of the transistor Tr13. It is more preferable that the voltage Vgs is set to 0 V (that is, both the contact point N11 and the contact point N12 have an equal potential).

A writing operation is performed by using the gradation current Idata having a minute current value as described above in order to realize such a voltage state. In this case, it takes a relatively long time to discharge the electric charges accumulated in the capacitor Cs to set the voltage Vgs between the gate and the source to a desired electric charge capacitance (a voltage value). In particular, the electric charge capacitance which is accumulated in the capacitor Cs becomes larger as the voltage component (the both-end potential Vc) applied in the capacitor Cs in the writing operation Twrt of the previous display drive period (one treatment cycle period) Tcyc approaches the maximum luminance gradation voltage. Consequently, it takes longer time to discharge the electric charges so that the voltage is set to a desired voltage value.

Accordingly, the display drive apparatus according to the embodiment is configured, as shown in FIG. 1, in such a manner that the gradation signal generation unit 130 comprises means for generating and supplying a gradation current Idata for allowing the organic EL element (the optical element) OEL to perform a light emitting operation with a predetermined luminance gradation corresponding to the display data; and means for generating and supplying a non-light emitting display voltage Vzero for allowing the organic EL element OEL to perform a non-light emitting operation (a black display) without allowing the organic EL element OEL to perform the light emitting operation, wherein the non-light emitting display voltage Vzero is applied to the data line DL at the time of the lowest gradation luminance (black display state).

Incidentally, in the present embodiment, there is shown a case in which the non-light emitting display voltage Vzero is applied to the drive circuit DC (the source terminal side of the thin film transistor Tr13; the contact point N12) via the data line DL by the gradation signal generation unit 130. However, the present invention is not limited thereto. For example, a dedicated power source for applying the non-light emitting display voltage Vzero to the data line DL may be provided therein.

As shown in FIG. 12, the drive control method in the display drive apparatus having such a configuration is set, in the display drive operation after the completion of the threshold voltage detection operation described above, so as to include: a pre-charge period Tth of applying a predetermined pre-charge voltage Vpre to the display pixels PX within a predetermined display drive period (one treatment cycle period) Tcyc, and holding the voltage component corresponding to the threshold voltage Vth13 peculiar to the drive thin film transistor Tr13 in between the gate and the source of the transistor Tr13 (the both ends of the capacitor Cs) provided on the drive circuit DC (allowing the capacitor Cs to accumulate or discharge the electric charge); a writing operation period Twrt of applying a gradation signal (a non-light emitting voltage Vzero) corresponding to the display data (non-light emitting data) to each display pixel PX (the drive circuit DC) via the data line DL and discharging substantially all the electric charges held in between the gate and the source of the thin film transistor Tr13 (in the capacitor Cs) to set the voltage Vgs between the gate and the source of the thin film transistor Tr13 to 0 V; and a light emitting operation Tem of allowing the organic EL element OEL not to perform a light emitting operation (a non-light emitting operation) ($Tcyc \geqq Tth+Twrt+Tem$).

That is, in the same manner as the drive control operation at the time of performing the gradation display operation described above, in the pre-charge operation prior to the writing operation period Twrt, the voltage component corresponding to the threshold voltage Vth13 peculiar to the drive thin film transistor Tr13 is held (the electric charges are accumulated) in between the gate and the source (in the capacitor Cs) of the transistor Tr13 followed by, in the writing operation of the gradation signal, as shown in FIG. 13, directly applying, for example, a non-light emitting display voltage Vzero which has an equal potential to the low-potential power supply voltage Vsc (=Vs) to the side of the source terminal (the contact point N12) of the drive transistor Tr13 provided on the display pixel PX (the drive circuit DC) via the data line input/output switching unit 180 and the data line DL from the display drive apparatus 100 (the gradation signal generation unit 130), so that the voltage Vgs between the gate and the source (the both-end potential Vc of the capacitor Cs) is set to 0 V.

In this manner, substantially all the electric charges accumulated in the capacitor Cs are discharged, so that the voltage Vgs between the gate and the source of the thin film transistor Tr13 is set to a voltage value (approximately 0 V) which is sufficiently lower than the threshold voltage Vth13 peculiar to the thin film transistor Tr13. Consequently, even if the power supply voltage Vsc is changed from the low potential (Vs) to the high potential (Ve) at the time of moving from the writing operation period Twrt to the light emitting operation period Tem so that the gate potential (the potential of the contact point N11) of the thin film transistor Tr13 slightly rises, the transistor Tr13, as shown in FIG. 14, is not turned on (the off state is held), no driving current Iem is supplied to the organic EL element OEL, and no light emitting operation is performed (the non-light emitting state is provided).

As a consequence, compared with the case in which at the time of the non-light emitting operation, a gradation current corresponding to the non-light emitting display data is supplied via the data line DL to discharge substantially all the electric charges accumulated in the capacitor Cs connected between the gate and the source of the drive transistor Tr13, it is possible to favorably realize the non-light emitting state (the non-light emitting display operation) of the organic EL element OEL while shortening the time required for the writing operation of the non-light emitting display data. Accordingly, in addition to a display drive operation of performing the normal gradation display, a display drive operation of performing non-light emitting display is switched and controlled in accordance with the display data (the luminance gradation data) with the result that a light emitting operation having a desired number of gradations (for example, 256 gradations) can be clearly realized at a relatively high luminance.

In the display pixel PX according to the embodiment, as shown in FIG. 1, there is shown a configuration in which an n-channel amorphous silicon thin film transistor is applied in any case as the thin film transistors Tr11 to Tr13 provided on the drive circuit DC. However, a poly-silicon thin film transistor may be applied therein. Furthermore, the p-channel amorphous silicon thin film transistors may be applied to all the thin film transistors Tr11 to Tr13. Here, in the case where the p-channel thin film transistors are applied thereto, the signal is set in such a manner that the high and low of the ON level and the OFF level thereof are reversed.

Furthermore, in the present embodiment, as shown in FIG. 1, an explanation is made by showing a circuit configuration provided with three thin film transistors Tr11 to Tr13 as the drive circuit DC provided on each of the display pixels PX. However, the present invention is not limited thereto. That is, it goes without saying that a different circuit configuration may be provided on condition that the drive circuit realizes a current/voltage conversion function of converting into a voltage component a gradation current supplied in accordance with the display data by using a single thin film transistor to accumulate the voltage component in the capacitor connected between the gate and the source of the transistor or the parasitic capacitance, and a drive function of controlling a driving current which is supplied to the optical element (the organic EL element) on the basis of the accumulated voltage component.

Furthermore, in the display drive apparatus and the drive control method of the display pixel, there is explained a case in which a pre-charge voltage Vpre having a voltage value based on the threshold compensation data is applied to each of the display pixels PX via the data line DL from the compensation voltage DAC 150, as the pre-charge operation. However, the present invention is not limited thereto. In short, the apparatus and the method will do only if the apparatus and the method enable holding the voltage component (the voltage component corresponding to the threshold voltage Vth13 peculiar to the drive transistor Tr13) for compensating for the threshold voltage of the current Ids between the drain and the source of each drive transistor Tr13 provided on the drive circuit DC of each of the display pixels PX. For example, there may be provided a configuration in which a pre-charge current having a current value based on the threshold compensation data is applied to each of the display pixels PX via the data line DL from the display drive apparatus 100.

<Display Apparatus>

Next, there will be explained a display apparatus and a drive control method thereof according to the present invention with reference to the drawings.

Figure 15:
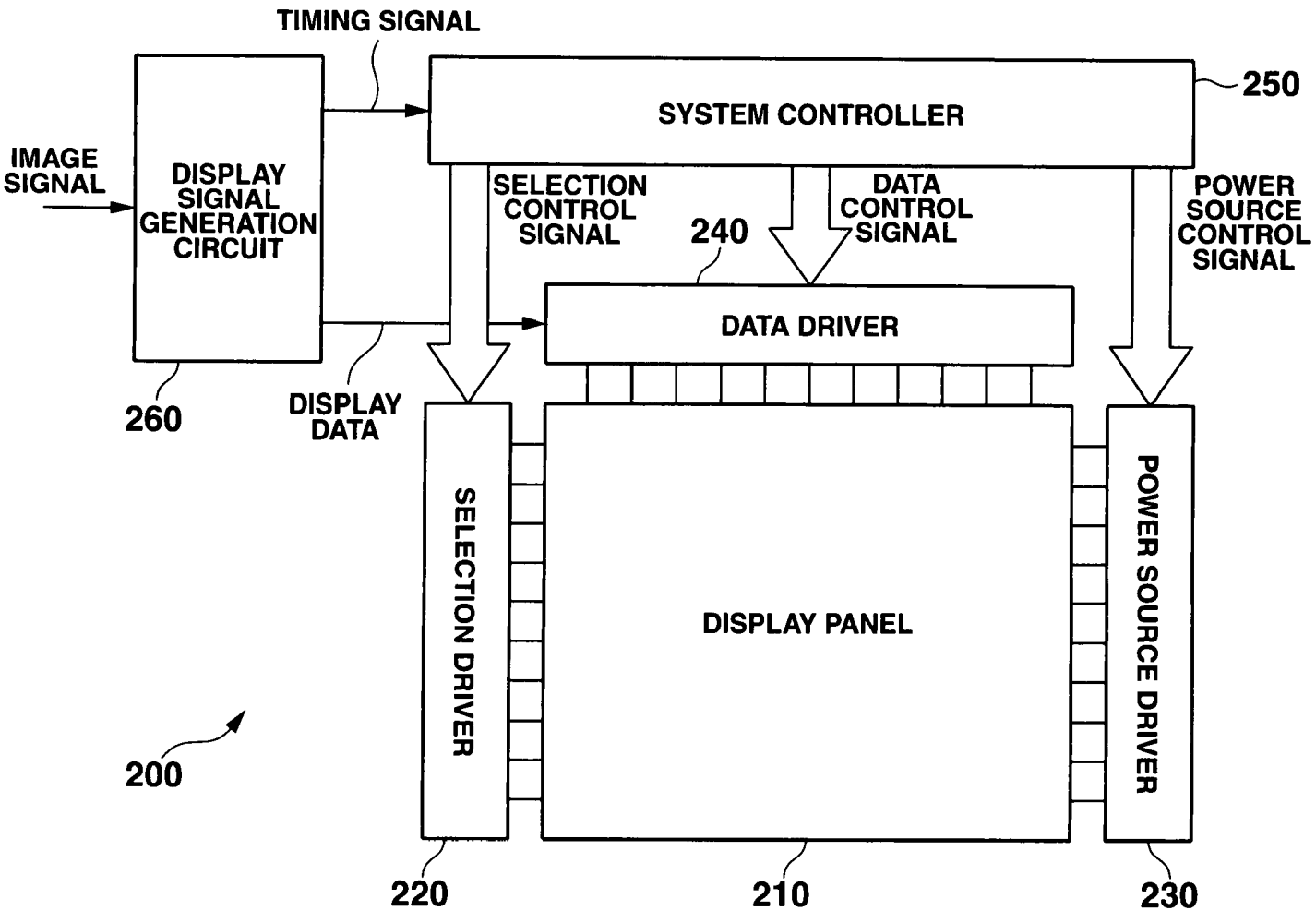
FIG. 15 is a schematic block diagram showing one example of an entire configuration of a display apparatus according to the present invention.
Figure 16:
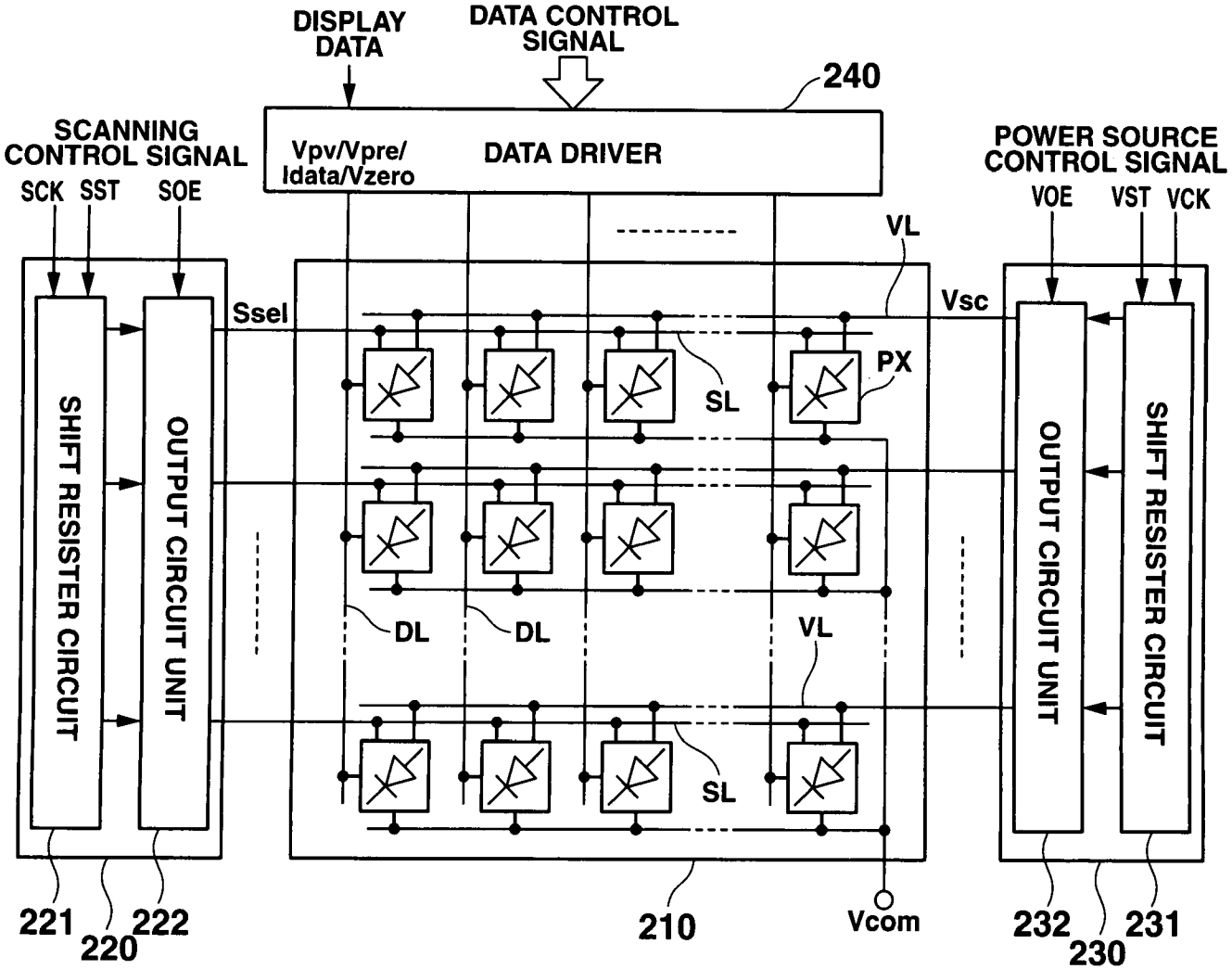
FIG. 16 is a schematic structural diagram showing one example of a display panel which is applied to the display apparatus according to the embodiment and a peripheral circuit (a selection driver, a power source driver) thereof.

FIG. 15 is a schematic block diagram showing one example of an entire configuration of the display apparatus according to the present invention, and FIG. 16 is a schematic structural diagram showing one example of a display panel which is applied to the display apparatus according to the embodiment and a peripheral circuit (a selection driver, a power source driver) thereof. Here, the same components as those of the display drive apparatus and the display pixel (the drive circuit) described above in the present embodiment are denoted by the same or equivalent reference numerals, and explained with reference to the drawings.

As shown in FIGS. 15 and 16, a display apparatus 200 according to the embodiment generally comprises: a display panel 210 having a plurality of display pixels arranged in a matrix form of n rows×m columns (n and m are arbitrary integer numbers), each of the plurality of display pixels comprising a driving current DC having the same circuit configuration EM as the above-described embodiment and an organic EL element (an optical element) OEL in the vicinity of each intersection of a plurality of selection lines SL arranged in a row direction and a plurality of data lines DL arranged in a column direction; a selection driver (a selection drive unit) 220 connected with the selection lines SL of the display panel 210, for sequentially applying a selection signal Ssel at a predetermined timing for each of the selection lines SL; a power source driver (a power source drive unit) 230 connected with power supply voltage lines VL arranged in a row direction in parallel with each of the selection lines SL, the power source driver sequentially applying a power supply voltage Vsc on a predetermined voltage level at a predetermined timing for each power supply voltage line VL; a data driver (a data drive unit) 240 connected with the data lines DL of the display panel 210, the data driver detecting a threshold voltage at the time concerned of a switching element (a thin film transistor) for drive provided on a display pixel PX (a drive circuit DC) in each column via each of the data lines DL in the above-described threshold voltage detection period Tdec while applying to a display pixel PX in each column a pre-charge voltage Vpre corresponding to the threshold voltage peculiar to the switching element of the display pixel PX via each of the data lines DL in the display drive period Tcyc followed by supplying a gradation signal (a gradation current Idata, or a non-light emitting display voltage Vzero) corresponding to each display data; a system controller 250 for generating and outputting a selection control signal, a power source control signal and a data control signal for controlling an operation state of at least the selection driver 220, the power source driver 230, and the data driver 240 on the basis of a timing signal which is supplied from a display signal generation circuit 260 which will be described later; and a display signal generation circuit 260 for generating display data (luminance gradation data) including digital signals on the basis of an image signal supplied from the outside of the display apparatus 200 to supply the data to the data driver 240 while extracting or generating a timing signal (a system clock or the like) for displaying predetermined image information on the display panel 210 on the basis of the display data to supply the timing signal to the system controller 250.

Hereinafter, there will be concretely explained each of the configurations.

(Display Panel)

In the same manner as in the display pixel shown in the above embodiment (refer to FIG. 1), each of the display pixels PX arranged on the display panel 210 shown in FIG. 6 comprises: a drive circuit DC for generating a driving current Iem corresponding to display data on the basis of the selection signal Ssel applied via the selection lines SL from the selection driver 220, the power supply voltage Vsc applied via the power supply voltage lines VL from the power source driver 230, and the gradation signal (the gradation current Idata, or the non-light emitting display voltage Vzero) supplied via the data lines DL from the data driver 240; and an organic EL element (an optical element) OEL for performing a light emitting operation with a predetermined luminance gradation in accordance with a current value of the driving current Iem supplied from the drive circuit DC. In the present embodiment, there is shown a case in which the organic EL element OEL is applied as an optical element as in the above embodiment (refer to FIG. 1). Other optical elements may be applied as long as they are current control type optical elements for performing a light emitting operation with a predetermined luminance gradation in accordance with the current value of the driving current.

(Selection Driver)

The selection driver 220 sets the display pixels PX in each row in a selection state by applying an ON level (a high level in the display pixel described above) selection signal Ssel to each of the selection lines SL on the basis of the selection control signal supplied from the system controller 250. Specifically, the display pixels PX in each row are sequentially set in a selection state by sequentially performing for each row at a predetermined timing an operation of applying the selection signal Ssel to the selection line SL of the row in a period in which a threshold voltage detection operation, and a display drive operation (a pre-charge operation and a writing operation) except for a light emitting operation are performed with respect to the display pixels PX in each row.

Here, for example, as shown in FIG. 16, the selection driver 220 comprises: a known shift register 221 for sequentially outputting a shift signal corresponding to the selection line SL of each row on the basis of a selection clock signal SCK and a selection start signal SST supplied as the selection control signal from the system controller 250 which will be described later; and an output circuit unit (an output buffer) 222 for converting the shift signal output from the shift register 221 into a predetermined signal level and outputting the signal as the selection signal Ssel to each selection line SL on the basis of an output control signal SOE supplied as the selection control signal from the system controller 250.

(Power Source Driver)

The power source driver 230 applies, on the basis of the power source control signal supplied from the system controller 250, a high-potential power supply voltage Vsc (=Ve) to the power supply voltage line VL of the row only in the light emitting operation period with respect to the display pixels PX in each row, and applies a low-potential power supply voltage Vsc (=Vs) thereto in an operation period except for a light emitting operation period (a threshold voltage detection period Tdec, and a pre-charge period Tth and a writing operation period Twrt in the display drive period Tcyc).

Here, in the same manner as the selection driver 220, the power source driver 230 comprises, for example, as shown in FIG. 16: a known shift register 231 for sequentially outputting a shift signal corresponding to the power supply voltage line VL of each row on the basis of a clock signal VCK and a start signal VST supplied as the power source control signal from the system controller 250; and an output circuit unit 232 for converting the shift signal into a predetermined voltage level (voltage values Ve, Vs) and outputting the shift signal to each power supply voltage line VL as the power supply voltage Vsc on the basis of an output control signal VOE supplied as the power source control signal.

(Data Driver)

The data driver 240 has, in the same manner as the display drive apparatus 100 shown in the above embodiment: the shift register data register portion 110, the display data latch unit 120, the gradation signal generation unit 130, the detection voltage ADC 140, the compensation voltage DAC 150, the frame memory 170 and the data line input/output switching unit 180 which are shown in FIG. 1.

In FIG. 1, there is shown a configuration corresponding to a single display pixel PX. In the data driver 240 according to the embodiment, the data line input/output switching unit 180 is provided for each of the data lines DL arranged in a column direction on the display panel 210. Consequently, either an operation of applying any one of a detecting voltage Vpv, a pre-charge voltage Vpre, and a gradation signal (a gradation current Idata, or a non-light emitting display voltage Vzero) simultaneously in parallel or sequentially for each row, or an operation of measuring the detection voltage Vdec is selectively performed with respect to the display pixels PX in each row by switching and controlling the voltage detection side switch 181, the input selection switch 182, and the writing side switch 183 which constitute the data line input/output switching unit 180 on the basis of the drive control method described above.

That is, the shift register/data register unit 110 provided on the data driver (display drive apparatus) 240 according to the embodiment sequentially fetches one row portion of display data supplied from the display signal generation circuit 260 on the basis of the output timing of the shift signal generated in accordance with one row portion of display pixels PX in each column (or the data line DL of each column) on the basis of the data control signal (a shift clock signal, and a sampling start signal) supplied from the system controller 250.

In the display data latch unit 120, one row portion of the display data fetched in the shift register/data register unit 110 is transferred on the basis of the data control signal (the data latch signal), and the display data are held for each the display pixels PX in each column.

The gradation signal generation unit 130, on the basis of each of the display data held in the data latch unit 120, generates a gradation current Idata having a current value corresponding to the display data or a non-light emitting display voltage Vzero having a predetermined voltage value, and applies the current or the voltage either simultaneously in parallel (in a package) or sequentially as the gradation signal.

Specifically, in the case where the display data are gradation display data for performing a normal gradation display which is accompanied by the light emitting operation of the organic EL element OEL, for example, the voltage is converted (a digital to analog conversion) into an analog signal voltage having a predetermined voltage value on the basis of a gradation reference voltage. Furthermore, a gradation current Idata having a current value corresponding to the display data is generated (a voltage-current conversion process), and output to the data line DL of each column at a predetermined timing. On the other hand, in the case where the display data are non-light emitting display data which are not accompanied by the light emitting operation of the organic EL element (the optical element) OEL, a predetermined non-light emitting display voltage Vzero is output to the data line DL of the column at a predetermined timing.

The non-light emitting display voltage Vzero is set to an arbitrary voltage value which is required for setting (or approximating to 0 V) the voltage Vgs (both-end potential Vc of the capacitor Cs) between the gate and the source to 0 V by discharging the electric charges accumulated in between the gate and the source (in the capacitor Cs) of the switching element (the thin film transistor Tr13) for drive provided on the drive circuit DC constituting the display pixel PX by the pre-charge operation, as described in the drive control method (non-light emitting display operation). Here, the non-light emitting display voltage Vzero and the gradation reference voltage for generating the gradation current Idata are supplied, for example, from a power source supply circuit or the like (not shown).

The detection voltage ADC 140 outputs the threshold data to the threshold data latch unit 160 by measuring simultaneously in parallel with the detection voltage Vdec or sequentially as the detection voltage Vdec the threshold voltage (or the voltage component corresponding to the threshold voltage) at the time of the execution of the threshold voltage detection operation in the switching element (the thin film transistor Tr13) for drive provided on the display pixel PX of each column in a row set in a selection state via each of the data lines DL, and converting the threshold voltage into threshold voltage detection data including the digital signal voltage in the threshold voltage detection operation prior to the display operation (the display drive operation of the display pixel PX) of the image information in the display panel 210.

The compensation voltage DAC 150 outputs a predetermined detecting voltage Vpv simultaneously in parallel or sequentially via each of the data lines DL to the display pixel PX (the switching element for drive provided on the drive circuit DC) of each column in a row set in a selection state in the threshold voltage detection operation prior to the display operation (the display drive operation of the display pixels PX) of the image information in the display panel 210.

Further, the compensation voltage DAC 150 generates a pre-charge voltage Vpre on the basis of threshold compensation data for compensating for the threshold voltage peculiar to the switching element provided on the display pixel PX of each column in a row set in a selection state and outputs the pre-charge voltage simultaneously in parallel or sequentially to the display pixel PX of each column via each of the data lines DL in the display operation (the display drive operation of the display pixel PX) of the image information in the display panel 210.

The threshold data latch unit 160 fetches and holds the threshold detection data which are converted and generated by the detection voltage ADC 140 for each display pixel PX of each column in a row set in a selection state in the threshold voltage detection operation prior to the display operation of the image information (the display drive operation of the display pixel PX) in the display panel 120 followed by allowing the shift register/data register unit 110 to fetch the one row portion of the threshold detection data which are sequentially transferred to the frame memory 170.

Moreover, the threshold data latch unit 160 fetches and holds the threshold compensation data corresponding to the threshold detection data for each display pixel PX of each column in a row set in a selection state and transfers the threshold compensation data to the compensation voltage DAC 150 for each column, the threshold compensation data being sequentially fetched from the frame memory 170 by the shift register/data register unit 110 in the display operation (the display drive operation of the display pixel PX) of the image information in the display panel 210.

(System Controller)

The system controller 250 generates and outputs the selection control signal, the power control signal, and the data control signal for controlling the operation state with respect to the selection driver 220, the power source driver 230 and the data driver 240 to operate respective driver at a predetermined timing. Consequently, the selection signal Ssel having a predetermined voltage level, the power supply voltage Vsc, the gradation signal (the gradation current Idata or the non-light emitting voltage Vzero) are generated and output to allow the threshold voltage detection operation (a voltage application operation, a voltage convergence operation and a voltage reading operation) and the display drive operation (a pre-charge operation, a writing operation, and a light emitting operation) in each of the display pixels (the drive circuit DC) to be performed, thereby performing a control for displaying predetermined image information based on the image signal on the display panel 210.

(Display Signal Generation Circuit)

The display signal generation circuit 260 extracts a luminance gradation signal component from an image signal supplied, for example, from the outside of the display apparatus 200, and supplies for each one row of the display panel 210 the luminance gradation signal component as display data (luminance gradation data) including digital signals to the shift register/data register unit of the data driver 240. Here, in the case where the image signal includes a timing signal component for regulating the display timing of the image information like a television broadcast signal (a composite image signal), the display signal generation circuit 260 may have a function of extracting a timing signal component and supplying the component to the system controller 250 in addition to a function of extracting the luminance gradation signal component. In this case, the system controller 250 generates control signals which are respectively supplied to the selection driver 220, the power source driver 230 and the data driver 240 on the basis of the timing signal supplied from the display signal generation circuit 260.

Incidentally, in the display apparatus according to the embodiment, there is shown a configuration in which the selection driver 220 connected with the selection lines SL and the power source driver 230 connected with the power supply voltage lines VL are individually provided in the periphery of the display panel 210. However, as has been explained in the drive control method (refer to FIGS. 7 and 12) of the above-described display drive apparatus (corresponding to the data driver 240), the selection signal Ssel applied to the selection line SL (from the selection driver 220) and the power supply voltage Vsc applied to the power supply voltage line VL (from the power source driver 230) are set to a state in which signal levels have a reverse relation with each other with respect to the display pixel PX in a specific row. Consequently, in the case where each of the display pixels PX which are arranged on the display panel 210 is allowed to perform a display drive operation (particularly, a light emitting operation) independently in a row unit (specifically, in the case of a first example of the drive control method of the display apparatus which will be described later), a configuration which is deprived of the power source driver 230 can be applied by providing a configuration in which the signal level of the selection signal Ssel generated by the selection driver 220 is reversed (a level reverse treatment), and furthermore the level of the signal is converted so as to have a predetermined voltage level to apply the level of the signal to the power supply voltage line VL in the specific row.

<Display Drive Control Method of Display Apparatus>

Next, there will be explained the drive control method (the display drive operation) in the display apparatus according to the embodiment.

The timing for performing the series of threshold voltage detection operation is controlled on the basis of the respective control signals output from the system controller 250.

First, there will be explained first to fourth examples and variations thereof of the display drive control method of the display apparatus in which the threshold voltage detection operation is controlled so that the operation is performed at an arbitrary timing prior to the display drive operation, for example, at the time of the start-up of the system (the display apparatus) and at the time of the recess thereof.

First Example

Figure 17:
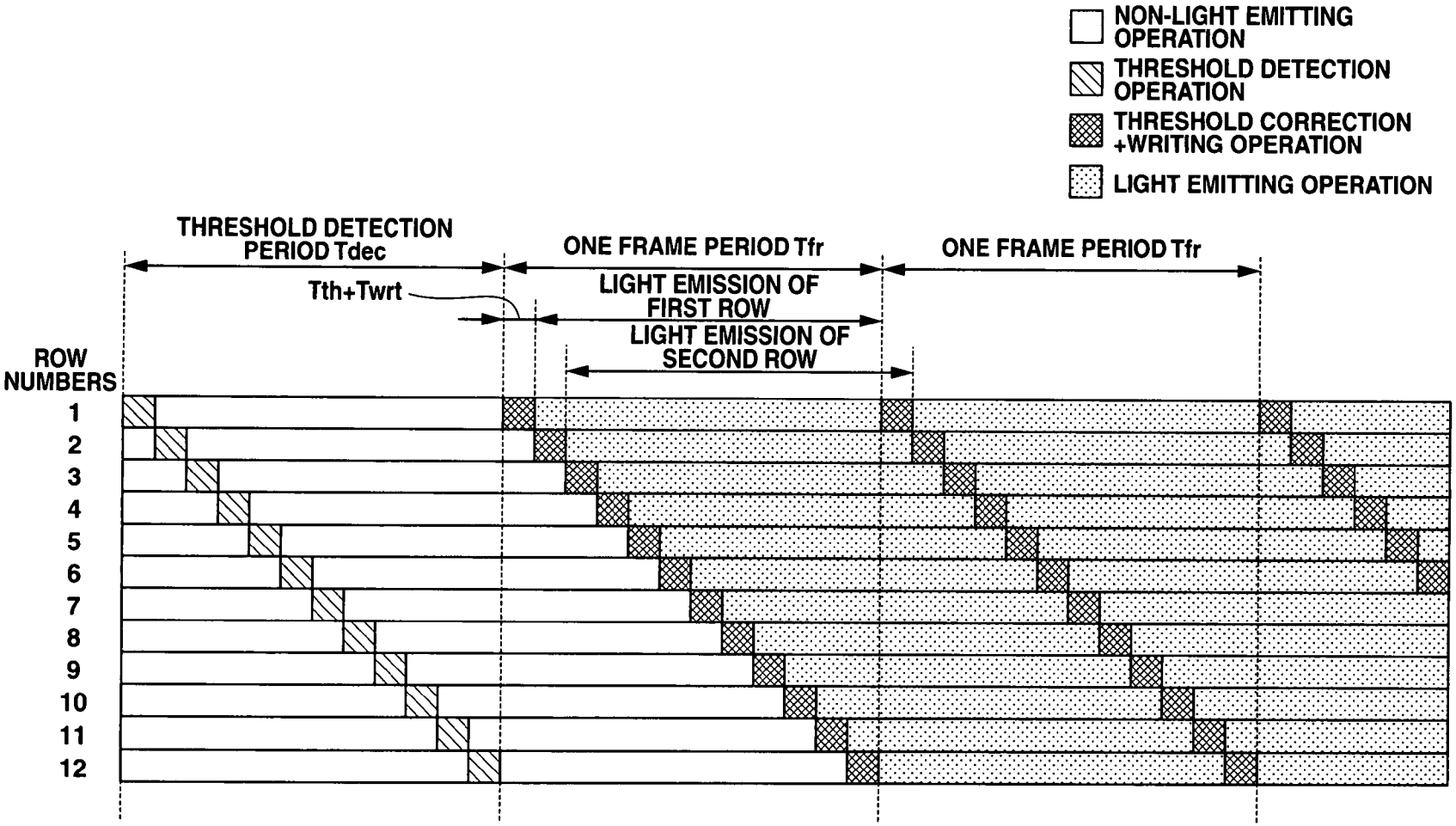
FIG. 17 is a timing chart illustratively showing a first example of the drive control method of the display apparatus according to the embodiment.

FIG. 17 is a timing chart illustratively showing a first example of the display drive method of the display apparatus according to the embodiment.

Here, an explanation will be omitted with respect to the drive control method (refer to FIGS. 2 and 7) which is the same as the case in the display drive apparatus and the display pixel (the drive circuit) shown in the above-described embodiment.

Incidentally, for the sake of explanation, the present embodiment has conveniently explained that a configuration is provided in which twelve rows (the first to twelfth rows) of display pixels are arranged. However, it goes without saying that the present invention is not limited thereto.

In the first example of the drive control operation of the display apparatus 200 according to the embodiment, generally, as shown in FIG. 17, a threshold voltage detection operation (a threshold voltage detection period Tdec) is first performed for detecting a threshold voltage (or a voltage component corresponding to the threshold voltage) of the drive switching element (the thin film transistor) for controlling the light emitting state of the organic EL element (optical element) OEL in the drive circuit DC provided on each display pixel PX with respect to all the display pixels PX arranged on the display panel 210 prior to the display drive operation (the display drive period) of displaying the image information on the display panel 210. Thereafter, the voltage component corresponding to the threshold voltage of the switching element is held (the threshold voltage is compensated) in the display pixel PX for each row of the display panel 210 within one frame period Tfr (about 16.7 msec) followed by writing a gradation signal (a gradation current Idata, or a non-light emitting display voltage Vzero) corresponding to display data and sequentially repeating with respect to all the rows the display drive operation (the display drive period Tcyc) of allowing the display pixel PX (the organic EL element OEL) in each row to perform the light emitting operation with a luminance gradation corresponding to the display data (the gradation signal), thereby displaying one screen portion of image information of the display panel 210.

Here, with respect to the threshold voltage detection operation (the threshold voltage detection period Tdec), in the same manner as the embodiment described above, a series of the drive control is sequentially performed with respect to the display pixels PX for each row of the display panel 210 at a predetermined timing for each row, the control comprising: a voltage application operation (a voltage application period Tpv) of applying a predetermined detecting voltage Vpv; a voltage convergence operation (a voltage convergence period Tcv) of converging a voltage component based on the detecting voltage Vpv to the threshold voltage at the detection time of each switching element (the thin film transistor Tr13); and a voltage reading operation (a voltage reading period) of measuring (reading) a threshold voltage Vth13 after the voltage convergence in each display pixel PX and storing the threshold voltage as threshold detection data for each display pixel PX.

Here, in the timing chart shown in FIG. 17, a hatching portion of each row of the threshold voltage detection period Tdec shown by slant lines denotes the series of threshold voltage detection operation shown in the embodiment. Each operation includes the voltage application operation, the voltage convergence operation and the voltage reading operation. The threshold voltage detection operation is sequentially performed by shifting the timing in such a manner that the threshold voltage detection is not overlapped on each other for each row in terms of time.

Furthermore, with respect to the display drive operation (the display drive period Tcyc) as well, in the same manner as the embodiment described above, a series of drive control is sequentially performed with respect to display pixels PX (the drive circuit DC) for each row of the display panel 210 in one frame period Tfr at a predetermined timing for each row. The drive control includes a pre-change operation, a writing operation, and a light emitting operation. The pre-charge operation (a pre-charge period) writes a pre-charge voltage Vpre for compensating for a threshold voltage of each display pixel PX on the basis of the threshold detection data (threshold compensation data) detected and stored with respect to each display image PX (a switching element for drive) by the threshold voltage detection operation. The writing operation (a writing operation period Twrt) writes a gradation signal (a gradation current Idata, or a non-light emitting voltage charge period Tth) corresponding to display data. The light emitting operation (a light emitting operation period Tem) allows each display pixel PX (the organic EL element OEL) to emit light with a luminance gradation corresponding to the display data (the gradation signal) at a predetermined timing.

Here, in the timing chart shown in FIG. 17, a hatching portion (denoted as "Tth+Twrt") of each row of the display drive period Tcyc shown by a cross mesh denotes the pre-charge operation and writing operation shown in the embodiment described above. In particular, in the embodiment, the pre-charge operation and the writing operation for each row are sequentially performed with a time shift so that the pre-charge operation and the writing operation for each are not overlapped on each other, whereby the light emitting operation is performed in order from the display pixel PX in a row with which the writing operation is completed. That is, only the light emitting operation out of the display drive operation for each row is performed so that only the light emitting operation is overlapped on each other (partially in parallel) in terms of time among respective rows.

Hereinafter, the first example of the display drive operation according to the embodiment will be further explained in detail.

As shown in FIG. 17, in the pre-charge period Tth and the writing operation period Twrt (shown by the cross mesh in the figure) of the display drive operation (the display drive period Tcyc), an ON level (a high level) selection signal Ssel is applied to the selection line SL in a specific row (for example, the i-th row; $1 \leqq i \leqq 12$) of the display panel 210 from the selection driver 220 as shown in FIGS. 7 and 12 with the result that the display pixel PX in the i-th row is selectively set in a selection state. Furthermore, in the pre-charge period Tth and the writing operation period Twrt, a low-potential power supply voltage Vsc (=Vs) is applied to the power supply voltage line VL of the i-th row from the power source driver 230.

Then, in synchronization with this timing (denoted conveniently as "selection timing"), an individual pre-charge voltage Vpre for compensating for the threshold voltage of the switching element (the thin film transistor) provided on each display pixel PX (the drive circuit DC) is first applied to each of the data lines DL from the compensation voltage DAC 150 provided on the data driver 240 in the pre-charge period Tth. As a result, a voltage component corresponding to the threshold voltage peculiar to the switching element (the thin film transistor Tr13) is held (electric charges are accumulated) to the control terminal (specifically, between the gate and source terminals of the thin film transistor Tr13; the both ends of the capacitor Sc) of the switching element of each display pixel PX in the i-th row.

Subsequently, in synchronization with the selection timing, a gradation signal (a gradation current Idata, or a non-light emitting display voltage Vzero) corresponding to display data of each display pixel PX (the driving current DC) is individually applied to the data line DL of each column from the gradation signal generation unit 130 provided on the data driver 240 in the writing operation period Twrt. Consequently, the voltage component corresponding to the gradation signal (the display data) is held (electric charges are accumulated or discharged) in the control terminal (specifically, between the gate and source terminals of the thin film transistor Tr13; the both ends of the capacitor Cs) of the switching element of the display pixel PX of each column in the i-th row.

Here, in the same manner as the drive control method described above, in the case where the display data supplied from the display signal generation circuit 260 to the data driver 240 are gradation display data (a gradation value except for 0 bit; the gradation display operation) which are accompanied by the light emitting operation of the organic EL element (the optical element) OEL, a gradation current Idata corresponding to the display data is generated by the data driver 240 (the gradation signal generation unit 130) to be supplied to the display pixel PX of the corresponding column. On the other hand, in the case where the display data are non-light emitting display data (a gradation value having 0 bit; the non-light emitting operation) which are not accompanied by the light emitting operation of the organic EL element (the optical element) OEL, a predetermined non-light emitting display voltage Vzero is generated by the data driver 240 to be supplied to the display pixel PX of the corresponding column.

Accordingly, with respect to the display pixel PX which is supplied with the gradation current Idata as the gradation current, a voltage component (an effective voltage Vdata) based on the gradation current Idata is charged by being added to the voltage component corresponding to the threshold voltage Vth13 which is charged in each display pixel PX in the row (between the gate and the source of the driving thin film transistor) by the pre-charge operation.

Furthermore, in the display pixel which is supplied with the non-light emitting display voltage Vzero as the gradation signal, the voltage component (the electric charges) corresponding to the threshold voltage Vth13 charged in each display pixel PX in the row is substantially completely discharged with the result that the voltage (0 V) corresponding to the display data is set to the switching element for drive (between the gate and the source of the thin film transistor).

Next, as shown in FIG. 17, in the light emitting operation period Tem (denoted by a dot hatch in the figure) of the display drive operation (the display drive period Tcyc), an OFF level (a low level) selection signal Ssel is applied to the selection line SL in the i-th row from the selection driver 220 as shown in FIGS. 7 and 12, whereby each of the display pixels PX in the i-th row is set to a no-selection state. Furthermore, the application of the gradation signal to each data line DL from the gradation signal generation unit 130 provided on the data driver 240 is blocked.

In synchronization with this timing, a high-potential power supply voltage Vsc (=Ve) is applied to the power supply voltage line VL of the i-th row from the power source driver 230. Consequently, a driving current Iem corresponding to display data (the gradation signal) is supplied to the organic EL element OEL on the basis of the voltage component charged in the display pixel PX in the i-th row, thereby performing a light emitting operation or non-light emitting operation with a predetermined luminance gradation.

Here, in the case where the gradation signal written in each of the display pixels PX is based on the gradation display data (the gradation value except for 0 bit) accompanied by the light emitting operation of the organic EL element OEL, a driving current Iem which is equal to the gradation current Idata is supplied to the organic EL element OEL, and the organic EL element OEL performs a light emitting operation (a gradation display operation) with a predetermined luminance gradation corresponding to the display data. On the other hand, in the case where the gradation signal is based on the non-light emitting display data (the 0 bit gradation value) which is not accompanied by the light emitting operation of the organic EL element OEL, the driving current Iem is not supplied to the organic EL element OEL and the light emitting operation is not performed (a non-light emitting display operation; a black display operation).

Such a light emitting operation (or non-light emitting operation) is started in synchronization with the completion timing of the pre-charge operation and the writing operation (immediately after the timing thereof) with respect to the display pixel PX in the i-th row, and the light emitting operation is continuously performed with respect to the i-th row until the start timing (immediately before the start thereof) of the next pre-charge operation and writing operation, for example, in one frame period Tfr.

Furthermore, in synchronization with the completion timing of the pre-charge operation and the writing operation (immediately after the timing thereof) with respect to the display pixel PX in the i-th row, the same pre-charge operation and writing operation as those described above are started with respect to the display pixel PX in the adjacent (i+1)-th row, so that a light emitting operation with respect to the (i+1)-th row is started in synchronization with the completion timing of the pre-charge operation and the writing operation (immediately after the timing thereof).

As a result, as shown in FIG. 17, an operation of charging an appropriate voltage component corresponding to display data (the gradation signal) to each display pixel PX by the pre-charge operation and the writing operation is sequentially performed with a shift of timing with respect to the display pixel PX (the drive circuit DC) for each row of the display panel 210 in one frame period Tfr so that the respective rows are not overlapped on each other. In the meantime, there is realized a drive control operation in which the light emitting operation (or non-light emitting operation) is performed so as to be overlapped partially in time on each other between respective rows with a predetermined luminance gradation in order from the display pixels PX in the row with which the pre-charge operation and the writing operation are completed.

In this manner, according to the display apparatus of the embodiment and the drive control method thereof, there is provided a configuration in which the display drive apparatus and the display pixel corresponding to the drive control method of the normal gradation specification mode are applied to each data driver and display panel. As a consequence, at the normal gradation display operation (except for the time of the non-light emitting operation), a driving current to be supplied to the optical element (the organic EL element) can be controlled on the basis of a current value of a gradation current corresponding to the display data. In addition, a current level of the gradation current is converted into a voltage level by a single switching element (a driving thin film transistor) provided on each display pixel, and the current value of the driving current can be set on the basis of the voltage level. Consequently, it is possible to stably realize desired light emitting characteristics for a long time without being affected by a variation in element characteristics (the threshold voltage) of the switching element (the thin film transistor) for drive provided on each display pixel (the drive circuit) and change with the lapse of time.

Furthermore, with respect to the display apparatus according to the embodiment and the drive control method thereof, prior to the writing operation of the display data (the gradation signal) to each display pixel and the light emitting operation of the optical element (the organic EL element), a threshold voltage of a switching element (a driving thin film transistor) provided on a display pixel (a drive circuit) is first detected and stored with respect to all the display pixels arranged on the display panel (the threshold voltage detection operation) followed by applying a pre-charge voltage corresponding to the detected threshold voltage to the switching element provided on the display pixel (the drive circuit) provided on the display pixel immediately before the writing operation of the display data to each display pixel (the pre-charge operation). Consequently, it is possible to provide a setting of a state in which the voltage component (the electric charges) corresponding to the threshold voltage peculiar to the switching element is held in the control terminal (between the gate and the source of the driving thin film transistor) of the switching element provided on each display pixel (a state in which the threshold voltage which is changed with the Vth shift is individually compensated). Thus, in the writing operation of the display data, the voltage component may be charged by adding only the voltage component corresponding to the display data thereto, so that the voltage component based on the display data can be swiftly and appropriately written.

Therefore, in the drive control method of the current gradation specification mode, the voltage component corresponding to the display data can be swiftly and appropriately written even at the time of the display operation with a low luminance gradation at which the gradation current corresponding to the display data becomes very small. Accordingly, the generation of the writing insufficiency in each display pixel can be suppressed, and an influence of the Vth shift of the switching element (the driving thin film transistor) provided on each display pixel can be eliminated. As a result, desired image information can be favorably displayed for a long period with an appropriate luminance gradation corresponding to the image signal.

Furthermore, at the time of the non-light emitting display, a predetermined non-light emitting display voltage corresponding to the display data (a 0 bit gradation value) is supplied to each display pixel, whereby substantially all the voltage components held in the switching element for drive (between the gate and the source of the thin film transistor) can be swiftly charged. As a consequence, the supply of the driving current to the optical element (organic EL element) can be securely blocked, and the non-light emitting display operation can be stably realized.

Further, according to the display apparatus according to the embodiment and the drive control method thereof, the apparatus is driven and controlled so that the light emitting operation continues until the start timing of the next pre-charge period and writing operation period in a period except for the pre-charge period and the writing operation period out of one frame period in each row of the display panel. Consequently, the light emitting time of each display pixel (optical element) can be set to a long time, and the image information can be displayed at a high light emitting luminance. In other words, this means that even in the case where the light emitting luminance of each display pixel is decreased, the image information can be displayed at a sufficient luminance. Accordingly, the consumed power associated with the display of the image information can be decreased.

Second Example

Next, by referring to the drawings, there will be explained a second example of the drive control method which is applicable to the display apparatus according to the embodiment.

Figure 18:
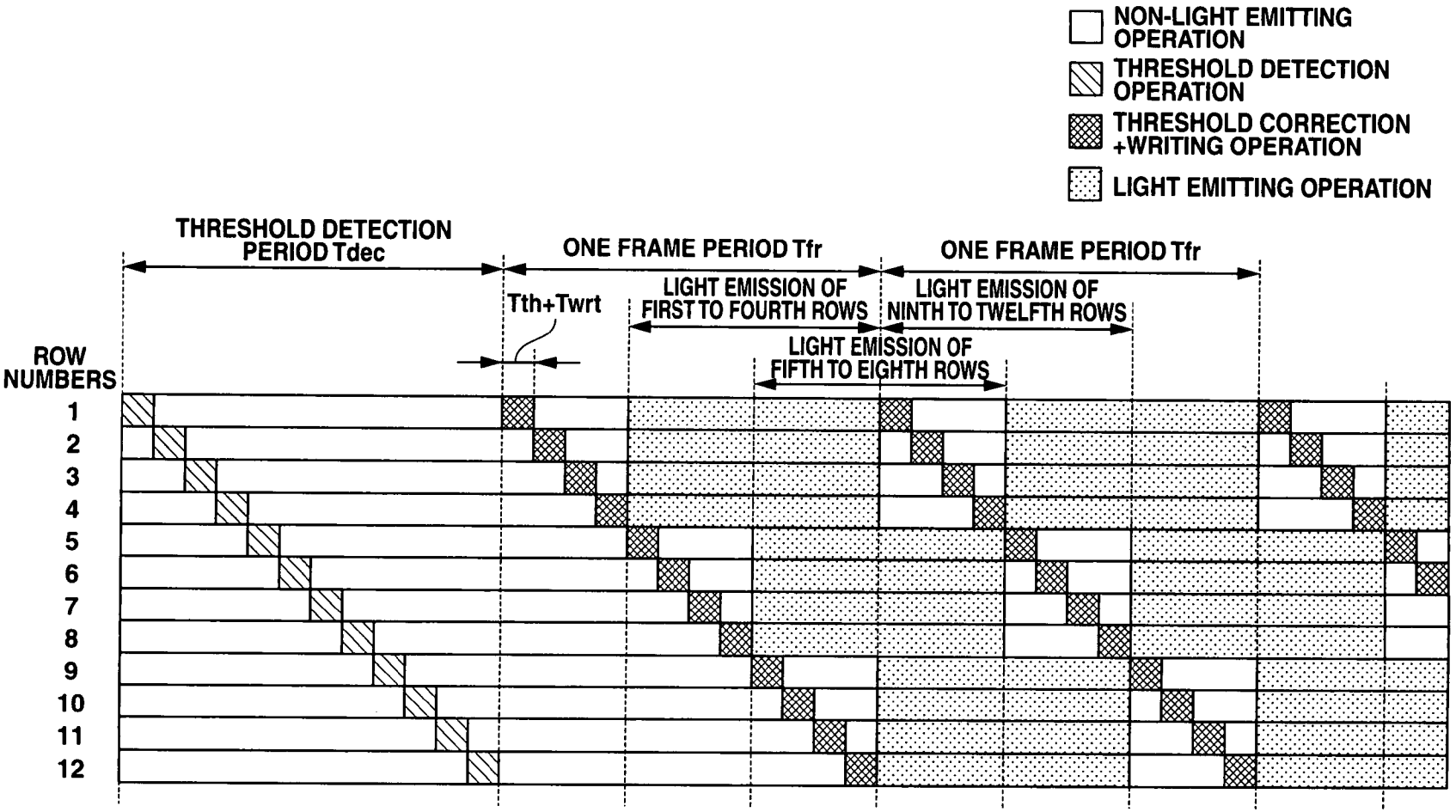
FIG. 18 is a timing chart illustratively showing a second example of the drive control method of the display apparatus according to the embodiment.

FIG. 18 is a timing chart illustratively showing the second example of the drive control method of the display apparatus according to the embodiment.

Here, an explanation is simplified with respect to the drive control method which is the same as the first example (refer to FIG. 17) described above. In addition, the hatching portion in the figures shows the same operation state as the first example described above.

Figure 19:
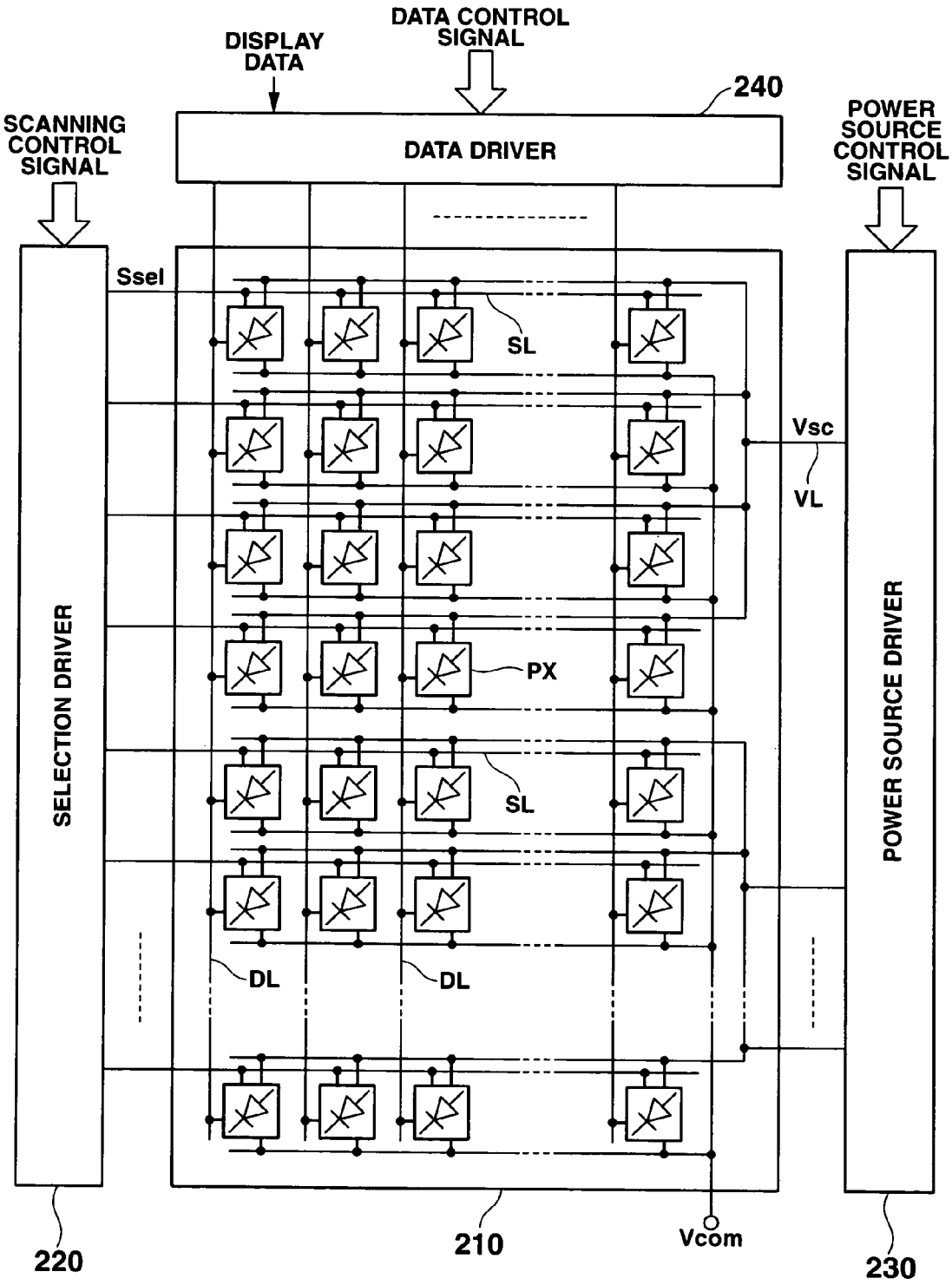
FIG. 19 is a structural diagram of a primary part showing one example of a display apparatus for realizing the second example of the drive control method of the display apparatus according to the embodiment.

In addition, FIG. 19 is a structural diagram of a primary part showing one example of a display apparatus for realizing the second example of the drive control method of the display apparatus according to the embodiment.

Here, the same components as those of the display apparatus shown in the embodiment described above will be explained by attaching the same reference numerals and symbols.

In the second example of the drive control operation of the display apparatus 200 according to the embodiment, in the same manner as the first example, the threshold voltage detection operation is sequentially performed on all the display pixels PX arranged on the display panel 210 at a predetermined timing for each row followed by compensating for the threshold voltage with respect to the display pixel PX (the drive circuit DC) for each row of the display panel 210 in one frame period Tfr (about 16.7 msec). Thereafter, an operation ("Tth+Twrt" in the drawing) of writing the gradation signal (the gradation current Idata or the non-light emitting display voltage Vzero) corresponding to display data is sequentially repeated with respect to all the rows, and the display drive operation (the display drive period Tcyc) of allowing a plurality of rows of the display pixels PX (the organic EL elements OEL) which are previously divided into groups to perform a light emitting operation simultaneously with a luminance gradation corresponding to the display data (the gradation signal) is performed to display image information in one screen portion of the display panel 210.

Here, in the second example of the display drive operation according to the embodiment, specifically, all the display pixels PX arranged on the display panel 210 are first divided into groups for the plurality of rows in advance. For example, as shown in FIG. 18, twelve rows of display pixels PX constituting the display panel 210 are divided into groups with setting four rows of display pixels PX to one group like the adjacent first to fourth rows, the adjacent fifth to eighth rows and the adjacent ninth to twelfth rows.

Then, in one frame period Tfr, the pre-charge operation and the writing operation are sequentially performed with respect to the display pixel PX (the drive circuit DC) for each row of the display panel 210 with the shift of timing. Next, in each of the groups, the light emitting operation is performed with respect to the group for which the writing operation to the display pixels PX in all the rows which are included in the group is completed.

For example, in the group in which the display pixels PX in the first to fourth rows are set to one set of group, the pre-charge operation and the writing operation are performed in order from the display pixels PX in the first row. At a timing at which the writing operation is completed with respect to the display pixels PX in the fourth row, the four rows of the display pixels PX in the group simultaneously perform the light emitting operation on the basis of the display data (gradation signal) written in each of the display pixels PX. This light emitting operation continues until the timing at which the next pre-charge operation and the writing operation continue.

Furthermore, at a timing at which the writing operation is completed with respect to the display pixels PX in the fourth row, the pre-charge operation and the writing operation are performed in order from the display pixels PX in the fifth row of a group in which the display pixels PX in the fifth to eighth rows are set to one set of group. Hereinafter, the same operations are repeatedly performed until the writing operation is completed with respect to the display pixels PX in the twelfth row of the next group.

In this manner, the display apparatus is driven and controlled in such a manner that the pre-charge operation and the writing operation are sequentially performed at a predetermined timing for each row, and the light emitting operation is simultaneously performed with respect to all the display pixels PX of the group at the time when the writing operation to the display pixels PX in all the rows included in the group is completed with respect to each of the preset group. Consequently, in the display drive operation according to the second example, the display apparatus is controlled in such a manner that all the display pixels in the group perform the non-light emitting operation to set all the display pixels to a non-light emitting state (a black display state) in a period in which the pre-charge operation and the writing operation are performed with respect to the display pixels PX in another row of the same group.

In such a display drive operation can be realized, for example, as shown in FIGS. 7 and 12, by controlling the display apparatus in such a manner that a low-potential power supply voltage Vsc (=Vs) applied to the power supply voltage line VL in the row by the power source driver 230 at the time of the pre-charge operation and the writing operation is continuously applied in a period in which the pre-charge operation and the writing operation are performed to the display pixels PX in all the rows included in the same group followed by applying a high-potential power supply voltage Vsc (=Ve) to the power supply voltage lines VL in all the rows of the group after the completion of the pre-charge operation and the writing operation to all the rows included in the group.

Furthermore, the same drive control, for example, as shown in FIG. 19, can be realized by applying a configuration in which a single power supply voltage line VL is branched and commonly connected with the display pixels PX in the first to fourth rows (or the fifth to eighth rows, and the ninth to twelfth rows) so that the single power supply voltage Vsc is simultaneously applied for each of the groups, and applying the single power supply voltage Vsc applied from the power source driver 230 to the display pixels in all the rows included in the same group. Incidentally, in the present embodiment as well, in the same manner as the case shown in FIG. 16, individual selection lines SL are arranged for each row of the display panel 210 with the result that the individual selection signals Ssel are applied from the selection driver 220 at different timings.

Therefore, according to the drive control method (the display drive operation) of the display apparatus, an operation and an advantage same as those of the drive control method according to the first example described above can be obtained. In addition, the light emitting operation of the display pixel (the optical element) is not performed and the non-light emitting operation (the black display operation) is performed in a period in which the pre-charge operation and the writing operation are performed to the display pixel in each row of the same group. Consequently, the flickering of moving images can be suppressed and the clarity thereof can be improved at the time of the display operation of the moving images by means of the continuous display of a plurality of image information items (static images)

Here, in the timing chart shown in FIG. 18, twelve rows of the display pixels PX constituting the display panel 210 are divided into three sets of groups, and the display apparatus is controlled in such a manner that the light emitting operation is simultaneously performed at timings different from one group to another. As a result, the ratio of the black display period (the black insertion ratio) by the non-light emitting operation in one frame period Tfr becomes approximately 33%. Here, in human sense of vision, generally, the presence of approximately 30% or more of the black insertion ratio constitutes an indication for a visual recognition of moving images which is clear and free from flickering thereof. Consequently, according to the present drive control method, there can be realized a display apparatus having a favorable image quality.

Third Example

Next, there will be explained a third example of the drive control method which is applicable to the display apparatus according to the embodiment with reference to the drawings.

Figure 20:
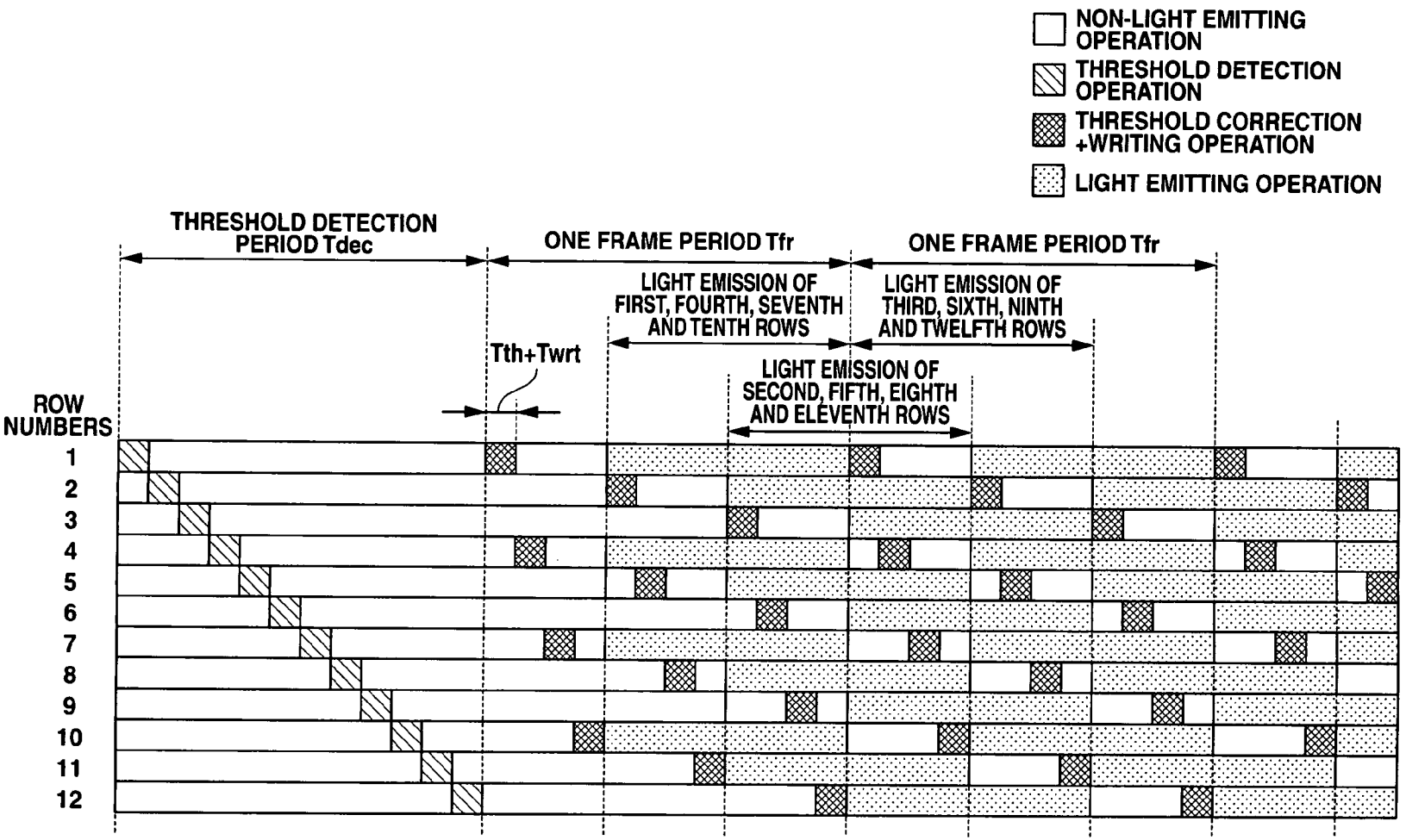
FIG. 20 is a timing chart illustratively showing a third example of the drive control method of the display apparatus according to the embodiment.

FIG. 20 is a timing chart illustratively showing the third example of the display control method of the display apparatus according to the embodiment.

Here, an explanation on the drive control method same as that of the second example (refer to FIG. 18) described above will be simplified.

As shown in FIG. 20, the third example of the drive control method of the display apparatus 200 according to the embodiment is configured in the same manner as the second example described above, such that the threshold voltage detection operation is sequentially performed at a predetermined timing for each row with respect to all the display pixels PX arranged on the display panel 210 prior to the display drive operation followed by sequentially performing for each group for sequentially performing, within one frame period Tfr (about 16.7 msec), the pre-charge operation and the writing operation with a shift of time with respect to the display pixels PX for each row included in a specific group, in each group in which a plurality of rows of the display pixels PX which are not mutually adjacent are set to one set of group which pixels are arranged on the display panel 210.

Here, in the display drive operation according to the embodiment, for example as shown in FIG. 20, all the display pixels PX arranged on the display panel 210 are divided into three groups in which the display pixels PX in respective four rows are set to one set such as a set of the first, fourth, seventh and tenth rows, a set of the second, fifth, eighth and eleventh rows and a set of the third, sixth, ninth and twelfth rows.

For example, in the group in which the display pixels PX in the first, fourth, seventh and tenth rows are set to one set of group, the pre-charge operation and the writing operation are performed in order from the display pixels PX in the first row. At a timing at which the writing operation is completed with respect to the display pixels PX in the tenth row, the four rows of the display pixels PX in the group perform simultaneously a light emitting operation on the basis of the display data (the gradation signal) written in each of the display pixels PX. This light emitting operation continues until the timing at which the next pre-charge operation and the next writing operation are started with respect to the display pixels PX in the first row.

Furthermore, at a timing at which the writing operation is completed with respect to the display pixels PX in the tenth row, the pre-charge operation and the writing operation are performed in order from the display pixels PX in the second row in the group in which the display pixels PX in the second, fifth, and eight and eleventh rows are set to one set of group. Hereinafter, the same operation is repeatedly performed until the pre-change operation and the writing operation are completed with respect to the display pixels PX in the twelfth row of the next group.

In this manner, for each row of each group, the pre-charge operation and the writing operation are sequentially performed at a predetermined timing. At the time when the writing operation to the display pixels PX in all the rows included in the group is completed, all the display pixels PX in the group are driven and controlled so as to simultaneously perform a light emitting operation. Consequently, in the drive control operation according to the third example, in the same manner as the second example, the display apparatus is controlled in such a manner that all the display pixels in the group perform a non-light emitting operation (a black display operation) in a period in which the pre-charge operation and the writing operation are performed with respect to the display pixels PX in other rows of the same group.

Furthermore, in the same manner as the second example described above, such a display drive operation can be realized, for example, by controlling the display apparatus in such a manner that, in a period in which the pre-charge operation and the writing operation are performed with respect to the display pixels PX in other rows of the same group, the power supply voltage Vsc applied to each of the power supply voltage lines VL in the group from the power source driver 230 is held to a low potential state (Vsc), and a high-potential power supply voltage Vsc (=Ve) is applied to the power supply voltage lines VL in all the rows included in the group after the completion of the pre-charge operation and the writing operation to the display pixels PX in all the rows included in the group. Incidentally, in the same manner as the second example (refer to FIG. 19) described above, a configuration may be applied in which the power supply voltage line VL is branched and arranged in such a manner that a single power supply voltage Vsc is applied to the display pixels PX in all the rows included in each group.

Therefore, according to the drive control method (the display drive operation) of the display apparatus, in the same manner as the drive control method according to the second example described above, the display apparatus is controlled in such a manner that twelve rows of the display pixels PX constituting the display panel 210 are divided into a plurality of groups of display pixels and the light emitting operation is performed simultaneously at timings different from one group to another. Consequently, a non-light emitting operation (a black display operation) is performed in a predetermined period in one frame period Tfr. In particular, since, in the present drive control method, the ratio of the black display period (the black insertion ratio) by the non-light emitting operation can be set approximately to 33%, a display apparatus having improved clearness can be realized by suppressing the flickering of the moving images.

Incidentally, in the drive control method according to the second and third examples, there has been explained a case in which the display pixels PX constituting the display panel 210 are divided into three sets of groups. However, the present invention is not limited thereto. For example, it goes without saying that the number of the groups can be appropriately increased or decreased to be set.

Modified Examples of Second and Third Examples

Hereinafter, there will be described modified examples of the drive control method according to the second and third examples.

Figure 21:
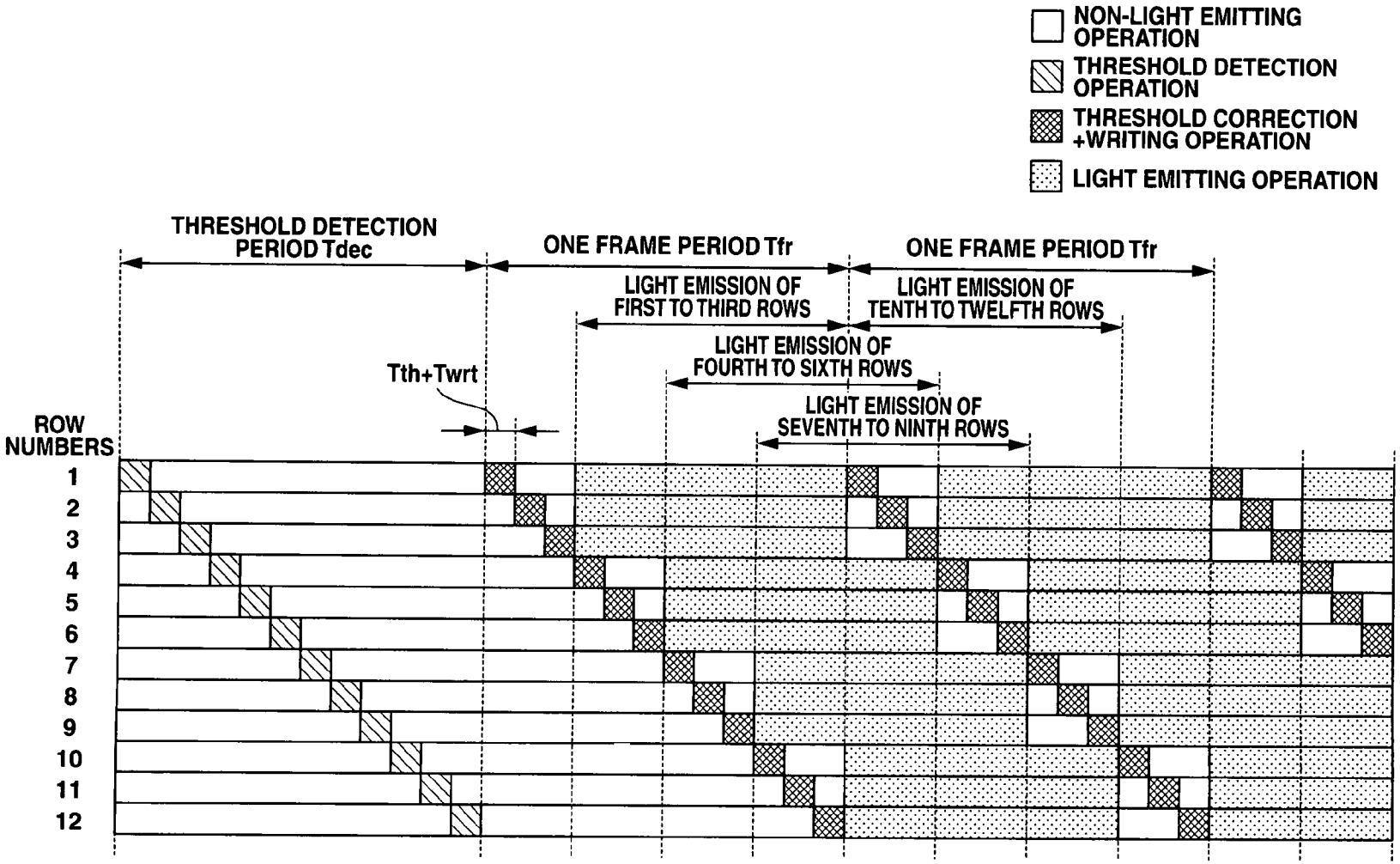
FIG. 21 is a timing chart illustratively showing a first modified example of the second example of the drive control method of the display apparatus according to the embodiment.

FIG. 21 is a timing chart illustratively showing a first modified example of the second example of the drive control method of the display apparatus according to the embodiment.

Figure 22:
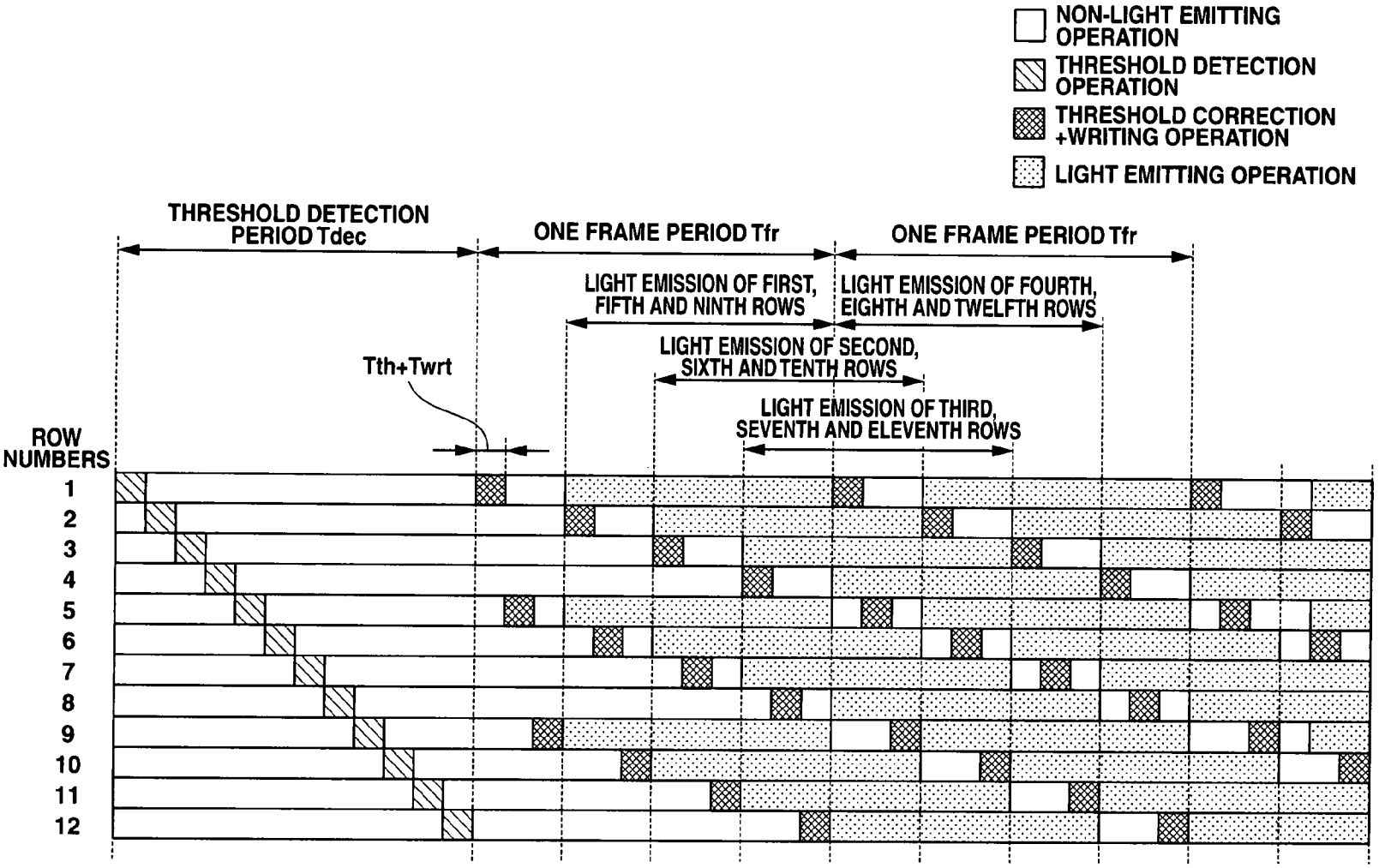
FIG. 22 is a timing chart illustratively showing a first modified example of the third example of the drive control method of the display apparatus according to the embodiment.

FIG. 22 is a timing chart illustratively showing a first modified example of the third example of the drive control method of the display apparatus according to the embodiment.

Figure 23:
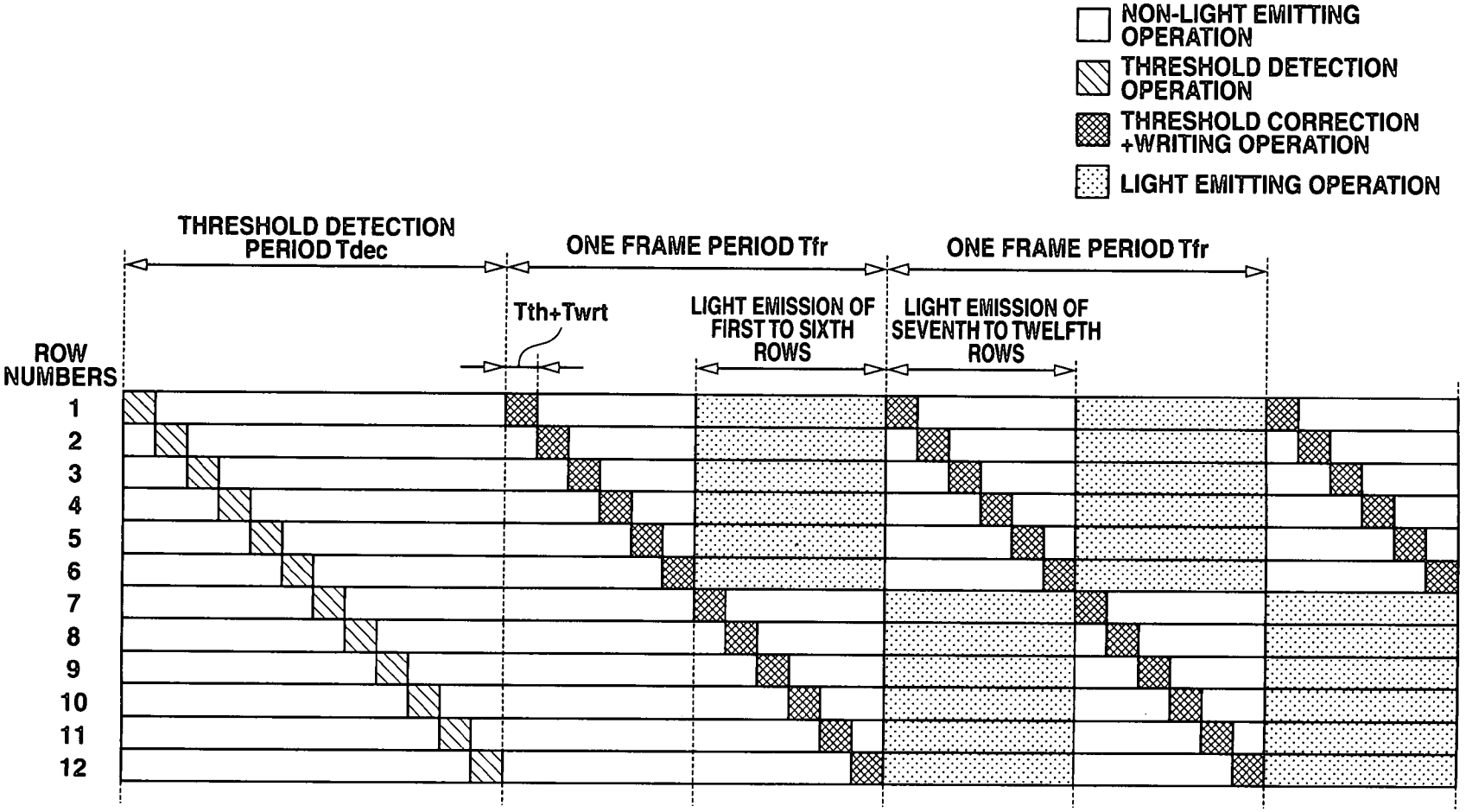
FIG. 23 is a timing chart illustratively showing a second modified example of the second example of the drive control method of the display apparatus according to the embodiment.

FIG. 23 is a timing chart illustratively showing a second modified example of the second example of the drive control method of the display apparatus according to the embodiment.

Figure 24:
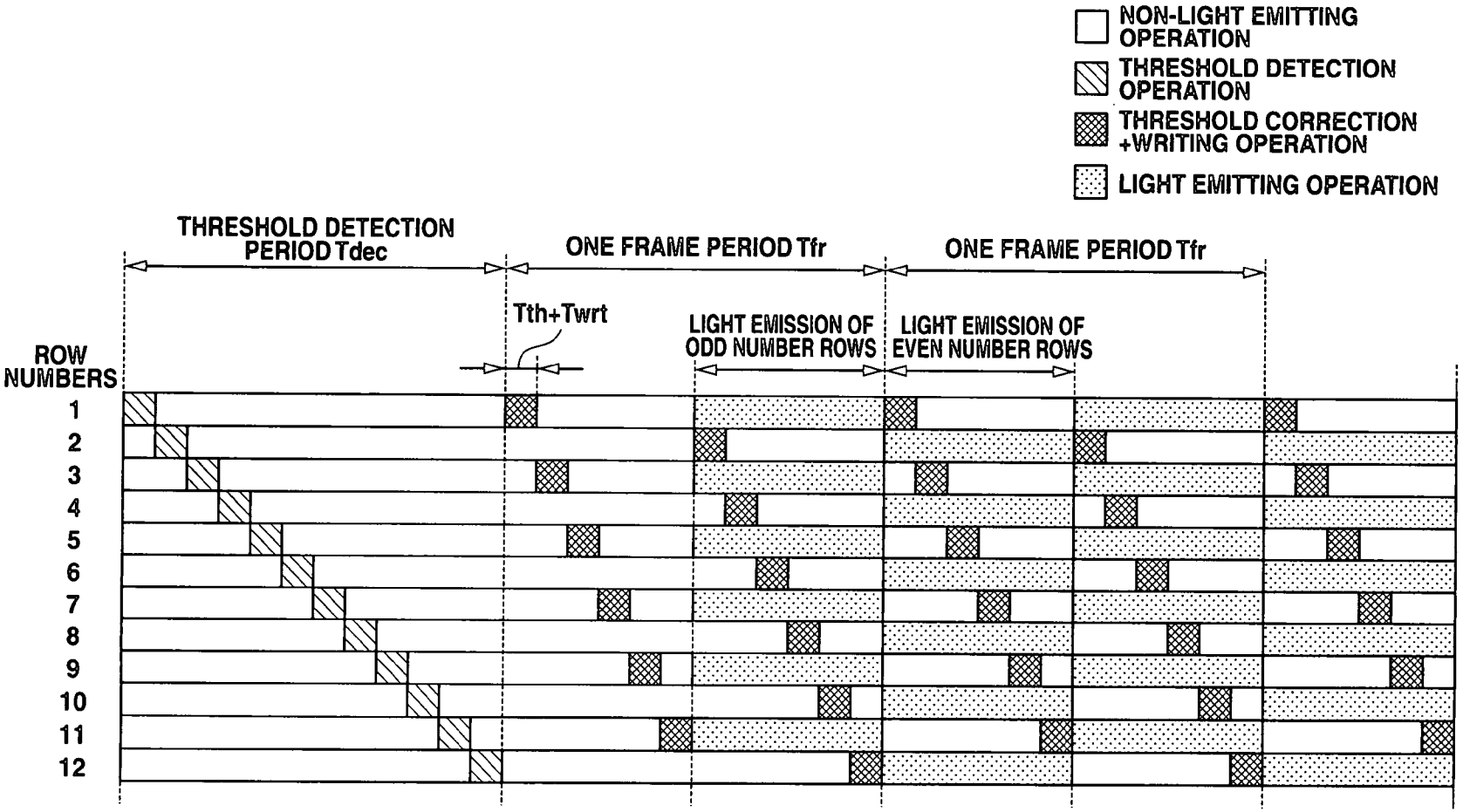
FIG. 24 is a timing chart illustratively showing a second modified example of the third example of the drive control method of the display apparatus according to the embodiment.

FIG. 24 is a timing chart illustratively showing a second modified example of the third example of the drive control method of the display apparatus according to the embodiment.

In the modified example (the first modified example) of the drive control method of the display apparatus according to the second and third examples, as shown in FIGS. 21 and 22, the display pixels PX constituting the display panel 210 are divided into four sets of groups (four groups: a set of the first to third rows, a set of the fourth to sixth rows, a set of the seventh to ninth rows, and a set of the tenth to twelfth rows in FIG. 21; and four groups: a set of the first, fifth and ninth rows, a set of the second, sixth and tenth rows, a set of the third, seventh and eleventh rows, and a set of the fourth, eighth and twelfth rows in FIG. 22). The display apparatus is controlled in such a manner that the light emitting operation is performed simultaneously at timings different from one group to another. In this case, the ratio of the black display period (the black insertion ratio) owing to the non-light emitting operation in one frame period Tfr becomes 25%. As a result, the flickering of the moving images becomes a little less than 30% that is an indication at which no flickering of the moving images as described above can be observed, but a display apparatus having a relatively favorable image quality can be realized.

Furthermore, in the second modified example of the drive control method of the display apparatus according to the second and third examples, for example, as shown in FIGS. 23 and 24, the display pixels PX constituting the display panel 210 are divided into two sets of groups (in FIG. 23, two groups of a set of the first to sixth rows and a set of the seventh to twelfth rows; in FIG. 24, two groups of a set of the odd number rows and a set of the even number rows). The display apparatus is controlled in such a manner that a light emitting operation is simultaneously performed at timings different from one group to the other. In this case, the ratio of the black display period (the black insertion ratio) by the non-light emitting operation in one frame period Tfr becomes 50% which exceeds 30% that is an indication at which no flickering of the moving images as described above can be observed, but the light emitting operation period becomes only a half of one frame period Tfr, which makes it impossible to display the image information at a sufficient luminance. Then, the image information can be provided at a sufficient luminance and with a favorable image quality.

Fourth Example

Next, there will be explained a fourth example of the drive control method which is applicable to the display apparatus according to the embodiment with reference to the drawings.

Figure 25:
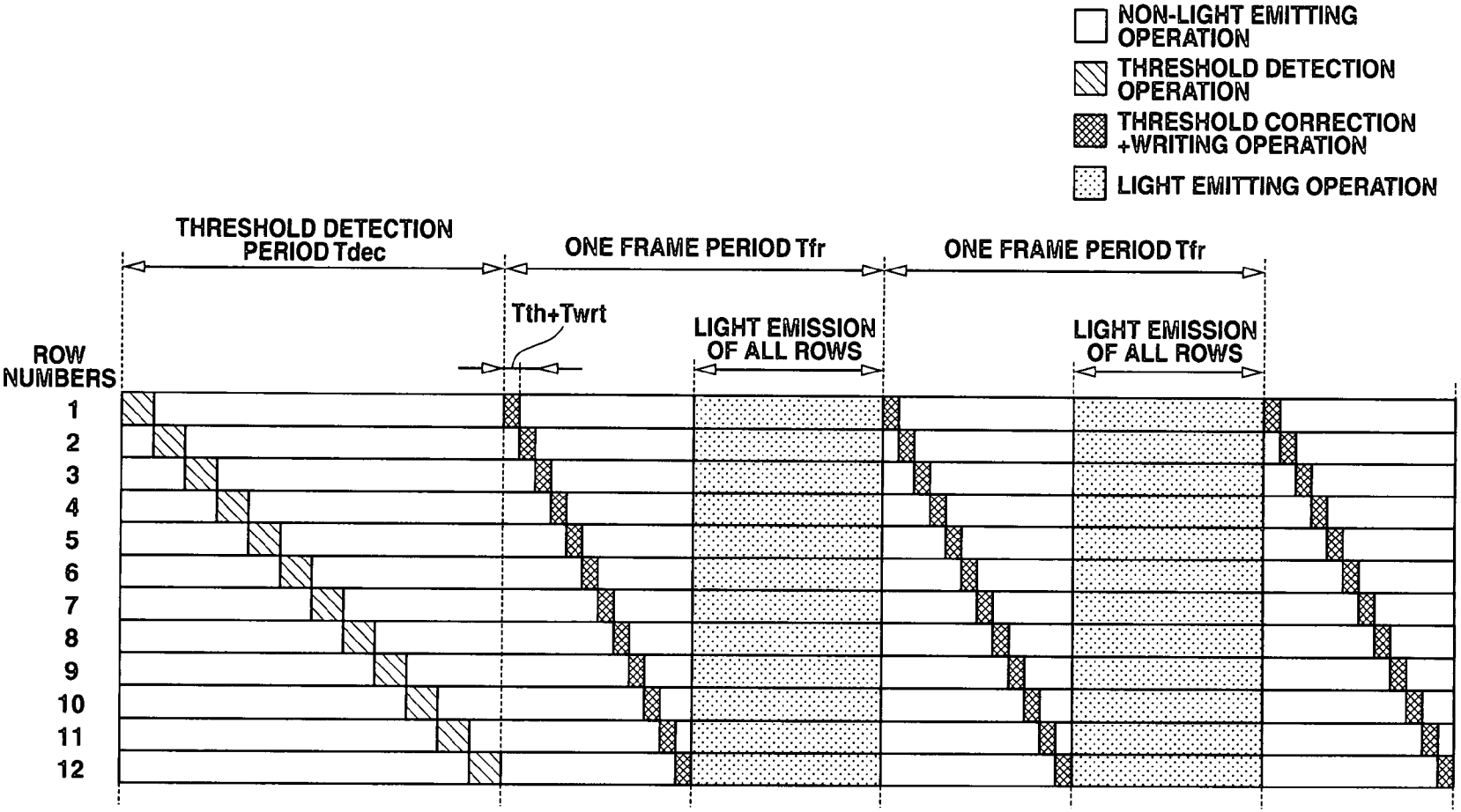
FIG. 25 is a timing chart illustratively showing a fourth example of the drive control method of the display apparatus according to the embodiment.
Figure 26:
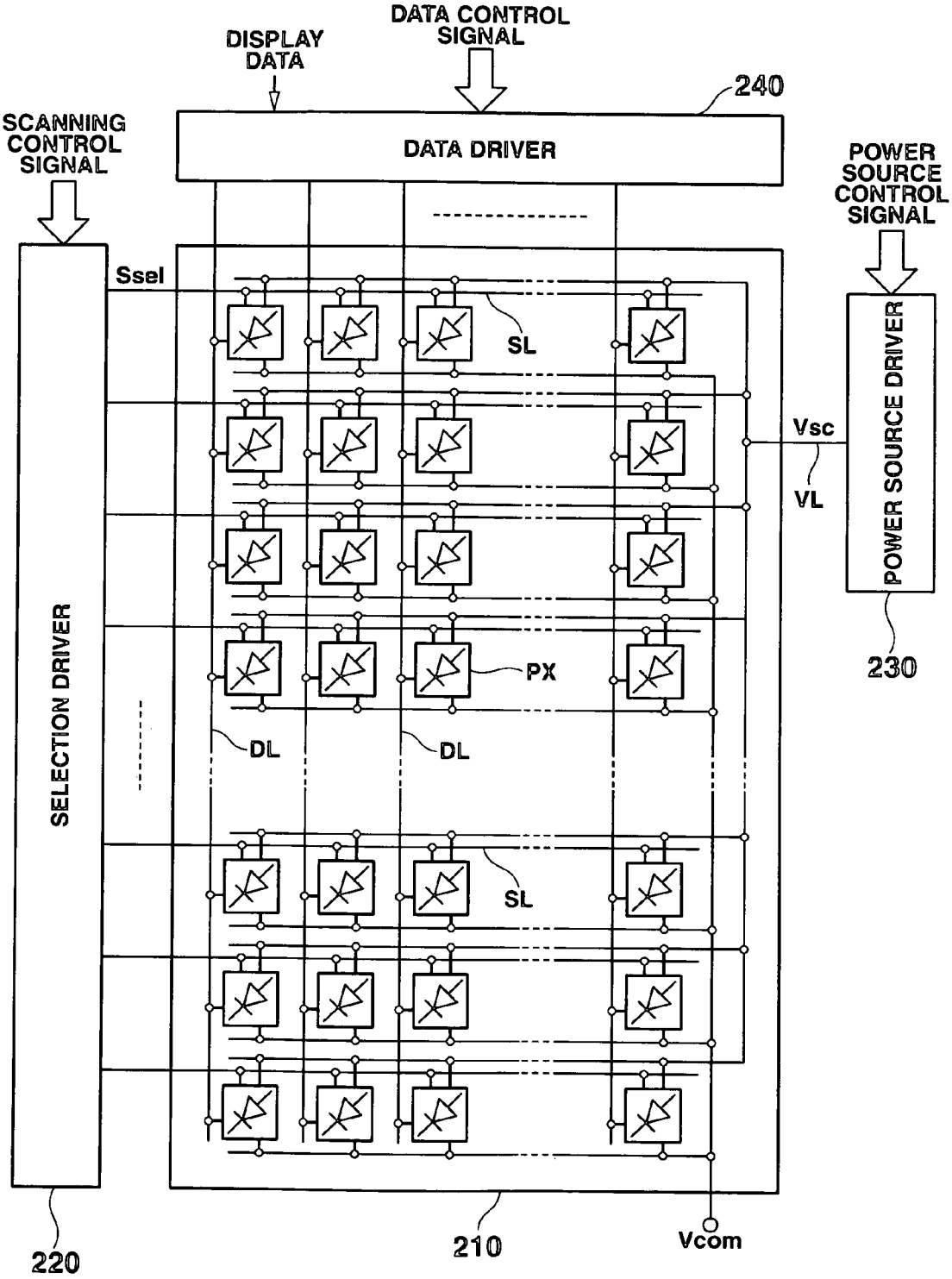
FIG. 26 is a structural diagram of a primary part showing one example of a display apparatus for realizing the fourth example of the drive control method of the display apparatus according to the embodiment.

FIG. 25 is a timing chart illustratively showing the fourth example of the drive control method of the display apparatus according to the embodiment. Here, an explanation of the drive control method which is the same as the first to third examples (refer to FIGS. 17 to 24) described above will be simplified. In addition, FIG. 26 is a structural diagram of a primary part showing one example of a display apparatus for realizing the fourth example of the drive control method of the display drive apparatus according to the embodiment. Here, the same components as those of the display apparatus according to the embodiment described above will be explained by attaching the same reference numerals and symbols.

In the fourth example of the drive control operation of the display apparatus 210 according to the embodiment, as shown in FIG. 25, in the same manner as the first to third examples described above, the display drive operation is performed in which the threshold voltage detection is sequentially performed at a predetermined timing with respect to all the display pixels PX arranged on the display panel 210 prior to the display drive operation followed by sequentially performing with a shift of time the pre-charge operation and the writing operation with respect to the display pixels PX for each row arranged on the display panel 210 in a first half (½ period of the one frame period Tfr) of one frame period Tfr (about 16.7 msec), and allowing the display pixels PX in all the rows arranged on the display panel 210 to simultaneously perform a light emitting operation with a luminance gradation corresponding to the display data in a second half (½ period of one frame period Tfr) of one frame period Tfr.

In this manner, the display apparatus is controlled in such a manner that the light emitting operation is not performed with respect to the display pixels PX in any row and all the display pixels PX perform the non-light emitting operation (the black display operation) in a period in which the pre-charge operation and the writing operation are performed by drive-controlling the display apparatus so as to allow all the display pixels PX to simultaneously perform the light emitting operation at the time when the writing operation to the display pixels PX in all the rows is performed.

Such a display drive operation can be realized, for example, by controlling the display apparatus in such a manner that the power supply voltage Vsc (=Ve) applied to the power supply voltage lines VL of all the rows from the power source driver 230 is held to a low potential (Vs) in a period in which the pre-charge operation and the writing operation are performed with respect to the display pixels PX in each row and a high-potential power supply voltage Vsc (=Ve) is applied to the power supply voltage lines VL of all the rows after the completion of the pre-charge operation and the writing operation with respect to the display pixels PX in all the rows.

The same drive control operation can also be realized by applying a configuration in which a single power supply voltage line VL is branched in correspondence to all the rows, for example, as shown in FIG. 26, and is commonly connected with all the display pixels PX arranged on the display panel 210 in order to simultaneously apply the single power supply voltage Vsc to all the display pixels PX, and applying the single power supply voltage Vsc applied from the power source driver 230 to the display pixels PX in all the rows. The configuration of the power source driver 230 in such a case may have a function of selectively outputting a high-potential power supply voltage Vsc (=Ve) and a low-potential power supply voltage Vsc (=Vs), for example, at a predetermined timing based on the power source control signal supplied from the system controller 250. For this reason, at least the shift register circuit as shown in FIG. 16 may not be provided. Incidentally, in the present embodiment as well, individual selection lines SL are arranged for each row of the display panel 210, so that the individual selection signals Ssel are applied from the selection driver 220 at different timings, in the same manner as the case shown in FIG. 16.

Consequently, according to the drive control method (the drive control operation) of the display apparatus, the display drive period (one frame period Tfr) is divided into two periods, the first half period and the second half period, thereby making a control such that the pre-charge operation and the writing operation are sequentially performed to the display pixels in each row in the first half period and all the display pixels simultaneously perform the light emitting operation in the second half period. Consequently, the ratio of the black display period (the black insertion ratio) with the light emitting operation in one frame period Tfr becomes 50%, which exceeds 30% that is an indication at which no flickering of the moving images can be visually recognized. However, since the light emitting operation is only a half of one frame period Tfr, the image information cannot be displayed at a sufficient luminance. Furthermore, since the pre-charge period and the writing operation period (particularly, the writing operation period) in each row are shortened, there arises a possibility that the time for sufficiently writing the display data (the gradation signal) cannot to be secured. However, image information can be displayed at a sufficient luminance and with a favorable image quality by appropriately increasing the light emitting luminance of each display pixel and further increasing the current value of the gradation current.

Next, there will be explained fifth to eighth examples and modified examples thereof of the drive control method of the display apparatus, in which the threshold voltage detection operation is controlled so as to be performed with respect to a specific row for each period of the frame period in the display drive operation.

Fifth Example

Figure 27:
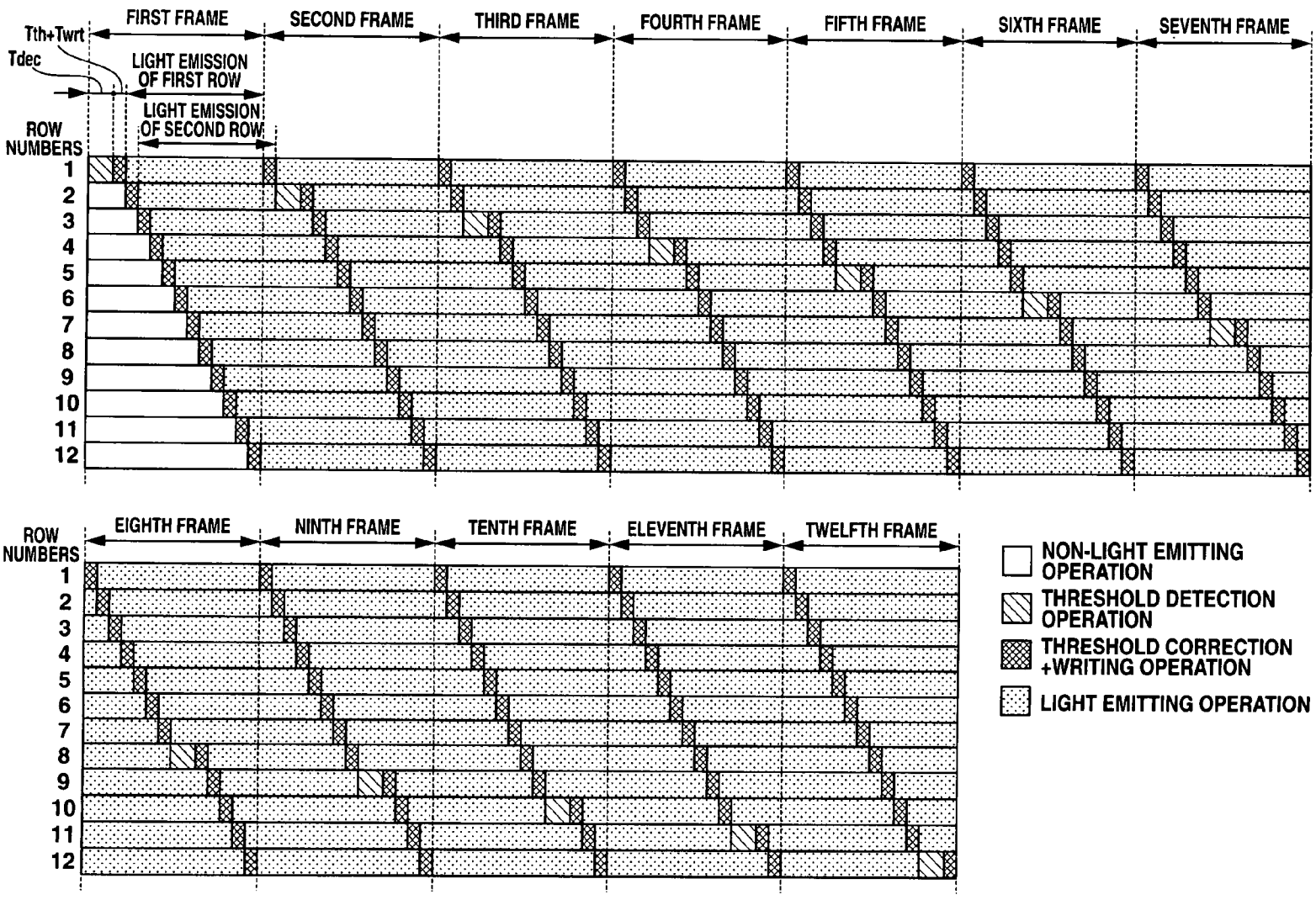
FIG. 27 is a timing chart illustratively showing a fifth example of the drive control method of the display apparatus according to the embodiment.

FIG. 27 is a timing chart illustratively showing the fifth example of the drive control method of the display apparatus according to the embodiment.

Here, an explanation on the drive control method (refer to FIGS. 2 and 7) which is the same as the case in which the display drive apparatus 100 and the display pixels PX (the light emitting drive circuit DC) described above will be simplified.

In the fifth example of the drive control operation of the display apparatus 200 according to the embodiment, generally, as shown in FIG. 27, the following two operations are sequentially repeated over all the rows to display the image information in one screen portion of the display panel 210: a threshold voltage detection operation (a threshold voltage detection period Tdec) of detecting a threshold voltage (or a voltage component corresponding to the threshold voltage) of a switching element (a thin film transistor; a light emitting drive element) for light emitting drive for controlling a light emission state of an organic EL element (a light emitting element) OEL in a light emitting drive circuit DC provided on each display pixel PX with respect to the display pixels in a specific row out of the display images PX arranged on the display panel 210 in one frame period (about 16.7 msec; a definite operation period); and an display drive operation (a display drive period Tcyc) of compensating for the threshold voltage of the switching element (holding the voltage component corresponding to the threshold voltage) with respect to the display pixel PX (the light emitting drive circuit DC) for each row of the display panel 210 followed by writing a gradation signal (a gradation signal Idata, or a non-light emitting display voltage Vzero) corresponding to display data to allow the display pixels PX (the organic EL elements OEL) in each row to perform a light emitting operation with a luminance gradation corresponding to the display data (the gradation signal).

Here, in the threshold voltage detection operation (the threshold voltage detection period Tdec), a series of drive control is performed which comprises: a voltage application period (a voltage application period Tpv) for applying a predetermined detecting voltage Vpv to a display pixel PX (a light emitting circuit DC) in a specific row of the display panel 210; a voltage convergence operation (a voltage convergence period Tcv) of converging a voltage component based on the detecting voltage Vpv to a threshold voltage at the detection time of each switching element (thin film transistor Tr13); and a voltage reading operation (a voltage reading period) of measuring (reading) a threshold voltage Vth13 after the voltage convergence for each display pixel PX and storing the threshold voltage as threshold voltage data for each display pixel PX.

In particular, in the display drive operation of the display apparatus according to the fifth example, a threshold voltage detection operation is sequentially performed which comprises the series of drive control described above with respect to the display pixels PX in specific one row for each frame period in a continuous frame period.

Specifically, as shown in FIG. 27, in the display panel 210 having twelve rows of display pixels PX arranged thereon, the threshold voltage detection operation is performed with respect to the display pixels PX in the first row in the first frame, and the threshold voltage detection data are stored in the corresponding memory area of the frame memory. In the first frame, after the completion of the threshold voltage detection operation with respect to the display pixels PX in the first row, the display drive operation described later for each row from the first row to the twelfth row is sequentially performed with respect to all the display pixels PX arranged on the display panel 210.

Next, in the second frame, the threshold voltage detection operation is performed with respect to the display pixels PX in the second row after the display drive operation is performed with respect to the display pixels PX in the first row, and the threshold detection data are stored in the corresponding memory area of the frame memory. Thereafter, the display drive operation is sequentially performed for each row with respect to the display pixels from the second row to the twelfth row of the display panel 210.

Next, in the third frame, the threshold voltage detection operation is performed with respect to the display pixels PX in the third row after the display drive operation is performed with respect to the display pixels PX in the first and second rows, and the threshold detection data are stored in the corresponding memory area of the frame memory. Thereafter, the display drive operation is performed for each row with respect to the display pixels PX from the third row to the twelfth row of the display panel 210.

Hereinafter, in the same manner, the threshold voltage detection operation is sequentially repeatedly performed with respect to the display pixels PX in the corresponding row up to the twelfth frame, whereby the threshold data (the threshold voltage) is stored in the frame memory with respect to the whole display pixels PX arranged in one screen portion of the display panel 210.

That is, in the drive control method (the threshold voltage detection operation) of the display apparatus according to the embodiment, the threshold voltage detection operation is performed with respect to the display pixels PX in any row of the display panel 210 in each frame period, and the latest threshold voltage is detected (monitored) by setting the frame period in the number of rows of the display panel to one cycle.

In the drive control method of the display apparatus according to the embodiment, a threshold voltage of a switching element (a thin film transistor) for light emitting drive which is provided on the display pixel (the light emitting drive circuit) is detected and stored with respect to the display pixels in the specific row for each frame period (a threshold voltage detection operation) prior to the writing operation of the display data (the gradation signal) to the display pixels in each row arranged on the display panel and the light emitting operation of the light emitting element (the organic EL element) followed by applying a pre-charge voltage corresponding to the detected threshold voltage to the switching element (the thin film transistor) for the light emitting drive immediately before the writing operation of the display data to each display pixel (a pre-charge operation). Accordingly, the threshold voltage (in the Vth shift) of the switching element for the light emitting drive at the time of the execution of the threshold voltage detection operation can be always monitored with respect to the display pixels in any row arranged on the display panel. In addition, it is possible to provide a setting of a state in which a voltage component (electric charges) corresponding to the threshold voltage (the threshold voltage changed due to the Vth shift) peculiar to the switching element is held in the control terminal (between the gate and the source of the thin film transistor) of the switching element for the light emitting drive of each display pixel (a state in which the threshold voltage is individually compensated). Consequently, only the voltage component corresponding to the display data may be added to charge the display pixels in the writing operation of the display data, and the voltage component based on the display data can be swiftly and appropriately written.

Sixth Example

Next, there will be explained a sixth example of the drive control method of the display apparatus according to the embodiment with reference to the drawings.

Figure 28:
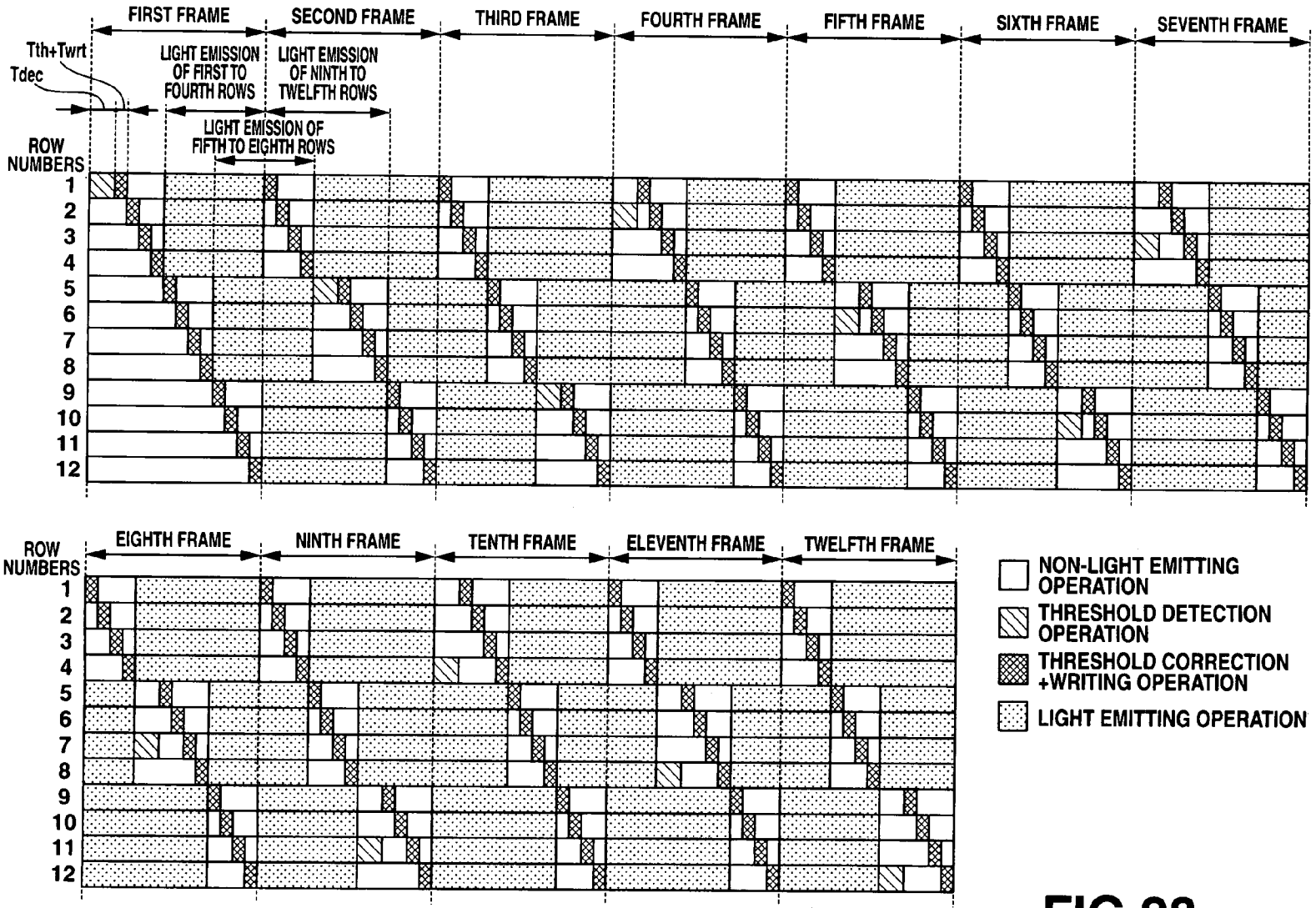
FIG. 28 is a timing chart illustratively showing a sixth example of the drive control method of the display apparatus according to the embodiment.

FIG. 28 is a timing chart illustratively showing the sixth example of the drive control method of the display device according to the embodiment.

Here, an explanation on the drive control method same as the fifth example (refer to FIG. 27) described above will be simplified. Furthermore, the hatching portion in FIG. 27 shows the operation state which is the same as the fifth example described above. Here, as a configuration of a display apparatus for realizing the sixth example of the drive control method of the display apparatus according to the embodiment, for example, a configuration shown in FIG. 19 described above can be applied.

In the sixth example of the drive control operation of the display apparatus according to the present embodiment, as shown in FIG. 28, the following two operations are performed to display image information in one screen portion of the display panel 210: a threshold voltage detection operation (a threshold voltage detection period Tdec) of first dividing in advance the display pixels PX arranged on the display panel 210 into groups of a plurality of mutually adjacent rows of display pixels, and detecting a threshold voltage with respect to a switching element (a thin film transistor) for light emitting drive of the display pixels PX in a specific row of a specific group in one frame period; and a display drive operation of sequentially repeating over all the rows an operation (a pre-charge period Tth, a writing operation period Twrt) of writing a gradation signal (a gradation current Idata, or a no-light emitting display voltage Vzero) corresponding to display data after compensating for the threshold voltage to the display pixels PX for each row of the display panel 210 to allow a plurality of rows of the display pixels PX for each row to simultaneously perform a light emitting operation with a luminance gradation corresponding to the display data (the gradation signal).

Here, in the drive control operation according to the sixth example, specifically, all the display pixels PX arranged on the display panel 210 are first divided into groups of a plurality of rows in advance. For example, as shown in FIG. 28, twelve rows of the display pixels PX constituting the display panel 210 are divided into groups by setting four rows of display pixels PX to one set like mutually adjacent rows such as the first to fourth rows, the fifth to eighth rows, and the ninth to twelfth rows.

Then, in the first frame, the threshold voltage detection operation (the threshold voltage detection period Tdec) is performed with respect to the display pixels PX in the first row of the group in which the display pixels PX in the first to fourth rows are set to one set, and the threshold detection data are stored in the corresponding memory area of the frame memory. In the first frame, the display drive operation (the pre-charge operation and the writing operation; Tth+Twrt) is sequentially performed for each row from the first row to the twelfth row with respect to all the display pixels PX arranged on the display panel 210 after the completion of the threshold voltage detection operation with respect to the display pixels PX in the first row.

In the display drive operation for each row, the light emitting operation is performed with respect to the group with which the writing operation with respect to the display pixels PX in all the rows included in each group is completed. For example, in the group in which the display pixels PX in the first to fourth rows are set to one set of group, the pre-charge operation and the writing operation are performed in order from the display pixels PX in the first row. At a timing at which the writing operation is completed with respect to the display pixels PX in the fourth row, the four rows of the display pixels PX in the group simultaneously perform a light-emitting operation on the basis of the display data (the gradation signal) written in each of the display pixels PX. This light emitting operation continues until the timing at which the next pre-charge operation and the writing operation are started with respect to the display pixels PX in the first row or until the timing at which the threshold voltage detection operation is started with respect to any of the first to the fourth rows.

Furthermore, at a timing at which the writing operation is completed with respect to the display pixels PX in the fourth row, the pre-charge operation and the writing operation are performed in order from the display pixels PX in the fifth row in the group in which the display pixels in the fifth to eighth rows are set to one set of group. At a timing at which the writing operation is performed with respect to the display pixels PX in the eighth row, the four rows of the display pixels PX in the group simultaneously perform a light emitting operation. Hereinafter, the same operation is repeatedly performed with respect to the display pixels PX in each row of the next group.

Next, in the second frame, the pre-charge operation and the writing operation are sequentially performed in the group in which the display pixels PX in the first to fourth rows are set to one set of group. At a timing at which the four rows of the display pixels PX in the group perform simultaneously perform a light emitting operation, the threshold voltage detection operation (the threshold voltage detection period Tdec) is performed with respect to the display pixels PX in the fourth row (corresponding to the first row in the group) in the group in which the display pixels PX in the fifth to eighth rows are set to one set of group. Consequently, the pre-charge operation and the writing operation are sequentially performed in the group after the completion of the threshold voltage detection operation.

Next, the pre-charge operation and the writing operation are completed in the group in which the display pixels PX in the fifth to eighth rows are set to one set of group. At a timing at which the four rows of the display pixels PX in the group simultaneously perform a light emitting operation, the pre-charge operation and the writing operation are sequentially performed in the group in which the display pixels PX in the ninth to twelfth rows are set to one set of group. Thereafter, the four rows of the display pixels PX in the group simultaneously perform a light emitting operation.

Hereinafter, in the same manner, with respect to each group previously set for each frame period, the threshold detection operation is performed with respect to the display pixels PX in a specific row included in the group. Furthermore, at the time when the writing operation is completed with respect to the display pixels PX in all the rows included in each group, the display drive operation is repeatedly performed for allowing all the display pixels PX included in the group to simultaneously perform a light emitting operation.

In this manner, the threshold voltage detection operation is repeatedly performed with respect to the display pixels PX in a specific row for each frame period, whereby the threshold voltage detection operation is performed with respect to the display pixels PX in any row of the display panel 210. Consequently, the latest threshold voltage is always detected (monitored) by setting the frame period in the number of rows of the display panel to one cycle.

Furthermore, in the display drive operation according to the sixth example, in a period in which the threshold voltage detection operation, the pre-charge operation and the writing operation are performed with respect to the display pixels PX in other rows in the same group, the display apparatus is controlled in such a manner that all the display pixels in the group perform a non-light emitting operation to be set in a non-light emitting display state (a black display state).

Such a display drive operation can be realized, for example, as shown in FIGS. 7 and 12, by controlling the display apparatus in such a manner that, at the time of the threshold voltage detection operation, the pre-charge operation and the writing operation, a low-potential power supply voltage Vsc (=Vs) applied to the power supply voltage line VL in the row from the power source driver 230 is continuously applied in a period in which the threshold voltage detection, the pre-charge operation and the writing operation are sequentially performed with respect to the display pixel in a row included in the same group followed by applying a high-potential power supply voltage Vsc (=Ve) to the power supply voltage lines VL of all the rows in the group after the completion of the threshold voltage detection operation, the pre-charge operation, and the writing operation with respect to all the rows included in the same group.

Furthermore, the same drive control can be also realized, for example, as shown in the FIG. 19, by applying a configuration in which a single power supply voltage line VL is branched and is commonly connected with the display pixels PX in the first to fourth rows (or the fifth to eighth rows, and the ninth to twelfth rows) in order to simultaneously apply the single power supply voltage Vsc for each group. Thus, the single power supply voltage Vsc applied from the power source driver 230 is applied to the display pixels PX in all the rows included in the same group. Incidentally, also in the present drive control method, the individual selection lines SL are arranged for each row, and the individual selection signals Ssel are applied from the selection driver 220 at different timings, in the same manner as the case shown in FIG. 16.

Therefore, according to the drive control method (the display drive operation) of the display apparatus, there can be obtained an operation and an advantage which are the same as those of the drive control method according to the fifth example described above. In addition, in a period in which the threshold voltage detection operation, the pre-charge operation and the writing operation are performed with respect to the display pixels in each row in the same group, the light emitting operation of the display pixel (the light emitting element) is not performed, but the non-light emitting operation (the black display operation) is performed. As a consequence, at the time of the display operation of the moving images by means of the continuous display of a plurality of image information (static images), the flickering of the moving images can be suppressed, and the clarity thereof can be improved.

Here, in the timing chart shown in FIG. 28, the display apparatus is controlled in such a manner that twelve rows of the display pixels PX constituting the display panel 210 are divided into three sets of groups, and the light emitting operation is simultaneously performed at timings different from one group to another. For this reason, the ratio of the black display period (the black insertion ratio) by the non-light emitting operation becomes approximately 33% in one frame period. Here, in order to allow the moving images to be clearly observed in human sense of vision without the flickering of the moving images, generally, the presence of the black insertion ratio of 30% or more constitutes an indication which enables visual recognition of moving images. Thus, in the drive control method according to the present invention, a display apparatus having a favorable display image quality can be realized.

Seventh Example

Next, there will be explained a seventh example of the drive control method of the display apparatus according to the embodiment with reference to the drawings.

Figure 29:
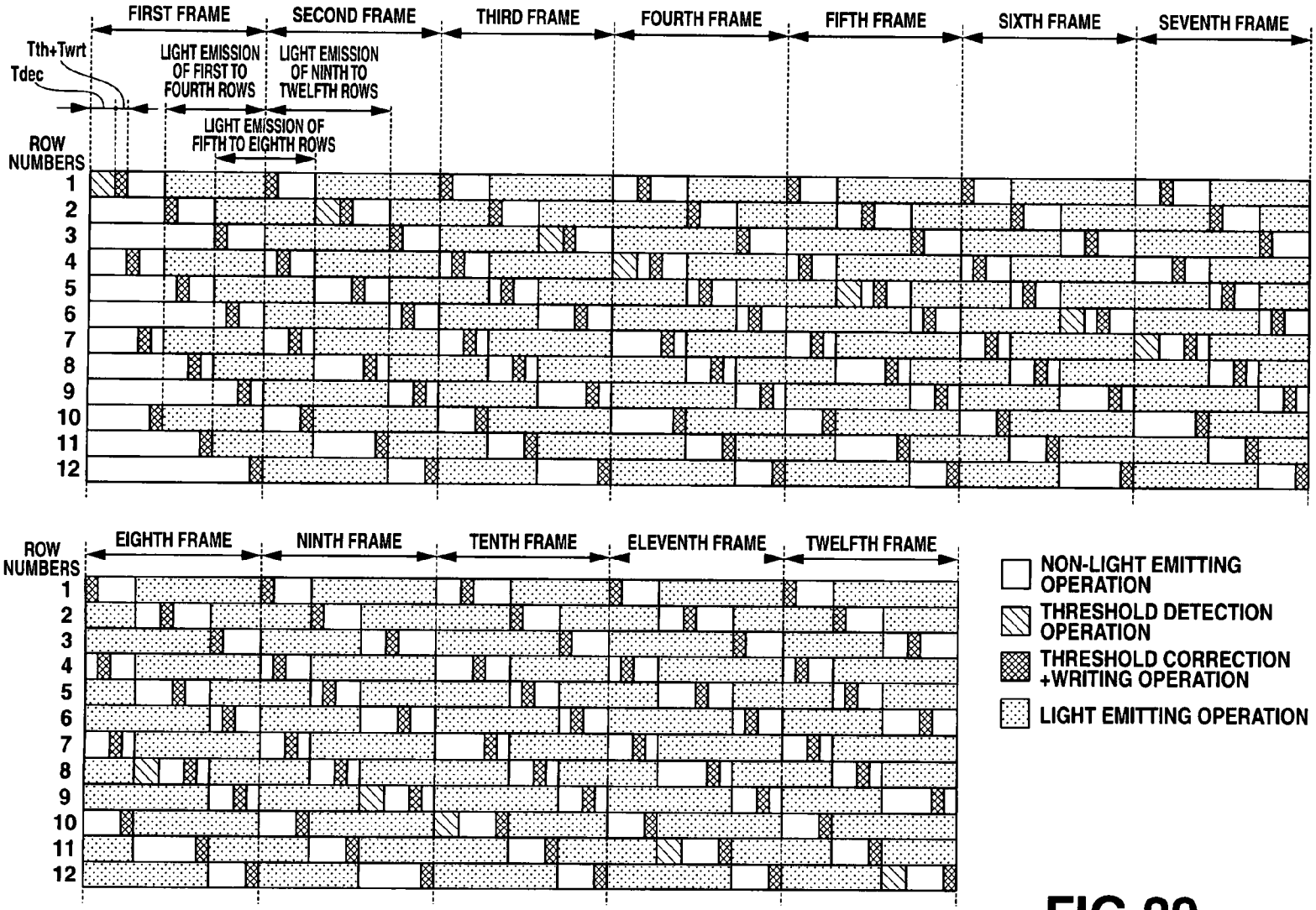
FIG. 29 is a timing chart illustratively showing a seventh example of the drive control method of the display apparatus according to the embodiment.

FIG. 29 is a timing chart illustratively showing the seventh example of the drive control method of the display apparatus according to the embodiment.

Here, an explanation on the drive control method which is the same as the sixth example (refer to FIG. 28) will be simplified.

In the seventh example of the drive control operation of the display apparatus 210 according to the embodiment, as shown in FIG. 20, the following two operations are sequentially performed to display image information of one screen portion of the display panel 210: a threshold voltage detection operation (a threshold voltage detection period Tdec) of first dividing in advance the display pixels PX in rows which are not mutually adjacent into groups, and detecting a threshold voltage with respect to a switching element (a thin film transistor) for light emitting drive of a display pixel PX in a specific row of a specific group within one frame period; and a display drive operation of sequentially performing an operation (a pre-charge period Tth, a writing operation period Twrt) of writing a gradation signal (a gradation current Idata, or a non-light emitting display voltage Vzero) corresponding to display data after compensating for the threshold voltage with respect to the display pixels PX in a row included in the group for each group to allow a plurality of rows of the display pixels PX (the organic EL elements) for each group to simultaneously perform a light emitting operation with a luminance gradation corresponding to the display data (the gradation signal) at a predetermined timing.

Here, in the drive control operation according to the seventh example, specifically, all the display pixels PX arranged on the display panel 210, for example, as shown in FIG. 29, twelve rows of the display pixels PX constituting the display panel 210 are first divided into three sets of groups by setting to one set respectively four rows of the display pixels PX such as a set of the first, fourth, seventh and tenth rows, a set of the second, fifth, eighth and eleventh rows, and a set of the third, sixth, ninth and twelfth rows.

Then, in the first frame, the threshold voltage detection operation (the threshold voltage detection period Tdec) is performed with respect to the display pixels PX in the first row in the group in which the display pixels PX in the first, fourth, seventh and tenth rows are set to one set of group. Thereafter, the display drive operation (the pre-charge operation and the writing operation; Tth+Twrt) is performed in an order starting from a smaller row number for each group with respect to all the display pixels PX arranged on the display panel 210.

In the display drive operation for each row, a light emitting operation is performed with respect to the group with which the writing operation is completed to the display pixels PX in all the rows included in each group. For example, in a group in which the display pixels PX in the first, fourth, seventh and tenth rows are set to one set of group, the pre-charge operation and the writing operation are performed in order from the display pixels PX in the first row. At a timing at which the writing operation is completed with respect to the display pixels PX in the tenth row, the four rows of the display pixels PX simultaneously perform a light emitting operation on the basis of the display data (the gradation signal) written in each of the display pixels PX. This light emitting operation continues until the next pre-charge operation and the writing operation are started with respect to the display pixels PX in first row, or until the timing at which the threshold voltage detection operation is started with respect to any row out of the first, fourth, seventh and tenth rows.

Furthermore, at a timing at which the writing operation is completed with respect to the display pixels PX in the tenth row, the pre-charge operation and the writing operation are performed in order from the display pixels PX in the second row in the group in which the display pixels in the second, fifth, eighth and eleventh rows are set to one set of group. Then, at a timing at which the writing operation is completed with respect to the display pixels PX in the eleventh row, the four rows of the display pixels PX in the group simultaneously performs a light emitting operation. Hereinafter, the same operation is repeatedly performed with respect to the display pixels PX in each row in the next group.

Next, in the second frame, the pre-charge operation and the writing operation are sequentially performed in the group in which the display pixels PX in the first, fourth, seventh and tenth rows are set to one set of group. At a timing at which the four rows of the display pixels PX in this group simultaneously perform a light emitting operation, the threshold voltage detection operation (the threshold voltage detection period Tdec) is performed with respect to the display pixels PX in the second row (corresponding to the first row in this group) in the group in which the display pixels in the second, fifth, eighth and eleventh rows are set to one set of group. Consequently, the pre-charge operation and the writing operation are performed in the group after the completion of the threshold voltage detection operation.

Next, the pre-charge operation and the writing operation are completed in the group in which the display pixels PX in the second, fifth, eighth and eleventh rows are set to one set of group. Then, at the timing at which the four rows of the display pixels PX in the group simultaneously perform the light emitting operation, the pre-charge operation and the writing operation are sequentially performed, which is followed by the simultaneous a light emitting operation of the four rows of the display pixels PX in the group.

Hereinafter, in the same manner, the threshold detection operation is performed with respect to the display pixels PX in a specific row included in the group, with respect to each preset group for each of the frame periods. Furthermore, at the time when the writing operation is completed with respect to the display pixels PX in all the rows included in each group, the display drive operation is repeatedly performed for allowing all the display pixels PX in the group to simultaneously perform a light emitting operation.

In this manner, the threshold voltage detection operation is performed with respect to the display pixels PX in any row of the display panel 210 in each frame period by sequentially and repeatedly performing the threshold voltage detection operation with respect to the display pixels PX in a specific row for each frame period. Consequently, the latest threshold voltage is always detected (monitored) by setting the frame period in the number of rows of the display panel to one cycle.

Furthermore, in the same manner as the display drive operation according to the sixth example, in a period in which the threshold voltage detection operation, the pre-charge operation and the writing operation are performed with respect to the display pixels PX in other rows in the same group, the display apparatus is controlled in such a manner that all the display pixels in the group perform a non-light emitting operation to be set in a non-light emitting display state (a black display state).

Furthermore, in the same manner as the display drive according to the sixth example, for example, such a drive operation can be realized by controlling the display apparatus in such a manner that the power supply voltage Vsc applied to the power supply voltage line VL of each row of the group from the power source driver 230 is held to a low potential (Vs) in a period in which the threshold voltage detection operation, the pre-charge operation, and the writing operation are performed with respect to the display pixels PX in other rows in the same group, and a high-potential power supply voltage Vsc (=Ve) is applied to the power supply voltage lines VL of all the rows included in the group after the completion of the threshold voltage detection operation, the pre-charge operation, and the writing operation with respect to the display pixels PX in all the rows in the same group. Incidentally, in the same manner as the second example (refer to FIG. 19), a configuration may be applied in which the power supply voltage line VL is branched and arranged such that a single power supply voltage Vsc is applied to the display pixels PX in all the rows included in each group.

Consequently, according to the display drive control method (the display drive operation) of the display apparatus, an operation and an advantage which are the same as those of the drive control method according to the fifth example can be obtained. In the meantime, in the same manner as the drive control method according to the sixth example, the display apparatus is controlled in such a manner that the twelve rows of the display pixels PX constituting the display panel 210 are divided into a plurality of sets of groups and the light emitting operation is simultaneously performed at timings different from one group to another. Therefore, the non-light emitting operation (the black display operation) is performed in a predetermined period in one frame period. In particular, in the present drive control method as well, the ratio of the black display period (the black insertion ratio) by the non-light emitting operation can be set to approximately 33%, and as a result, a display apparatus can be realized in which the flickering of the moving images is suppressed, and the clarity thereof is improved.

Incidentally, in the drive control method according to the sixth and seventh examples, there is explained a case in which the display pixels PX constituting the display panel 210 are divided into three sets of groups. However, the present invention is not limited thereto. For example, it goes without saying that the number of the groups is appropriately increased and decreased.

Modified Examples of Sixth and Seventh Examples

Hereinafter, there are shown modified examples of the drive control method according to the second and third examples.

Figure 30:
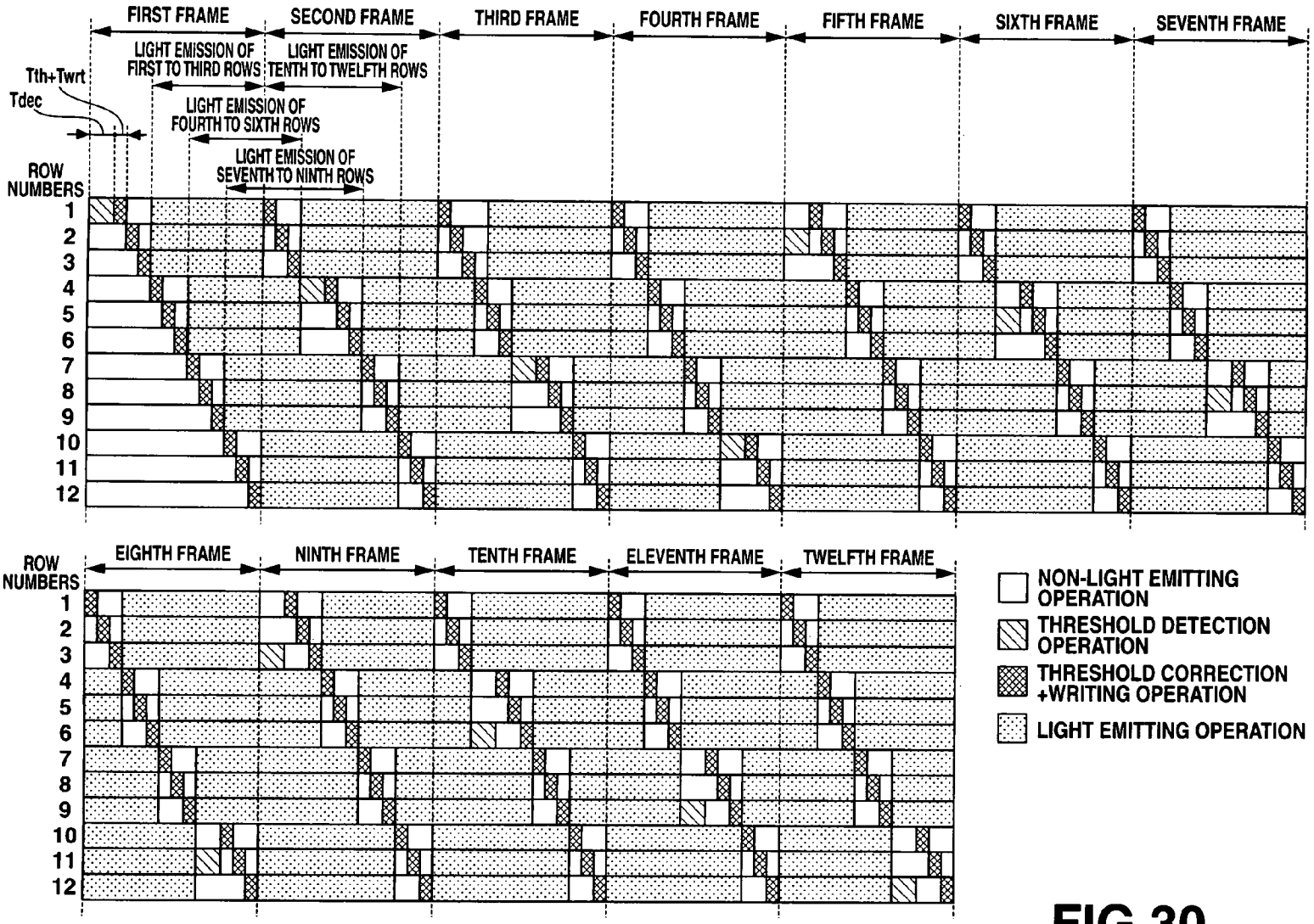
FIG. 30 is a timing chart illustratively showing a first modified example of the sixth example of the drive control method of the display apparatus according to the embodiment.

FIG. 30 is a timing chart illustratively showing a first modified example of the sixth example of the drive control method of the display apparatus according to the embodiment.

Figure 31:
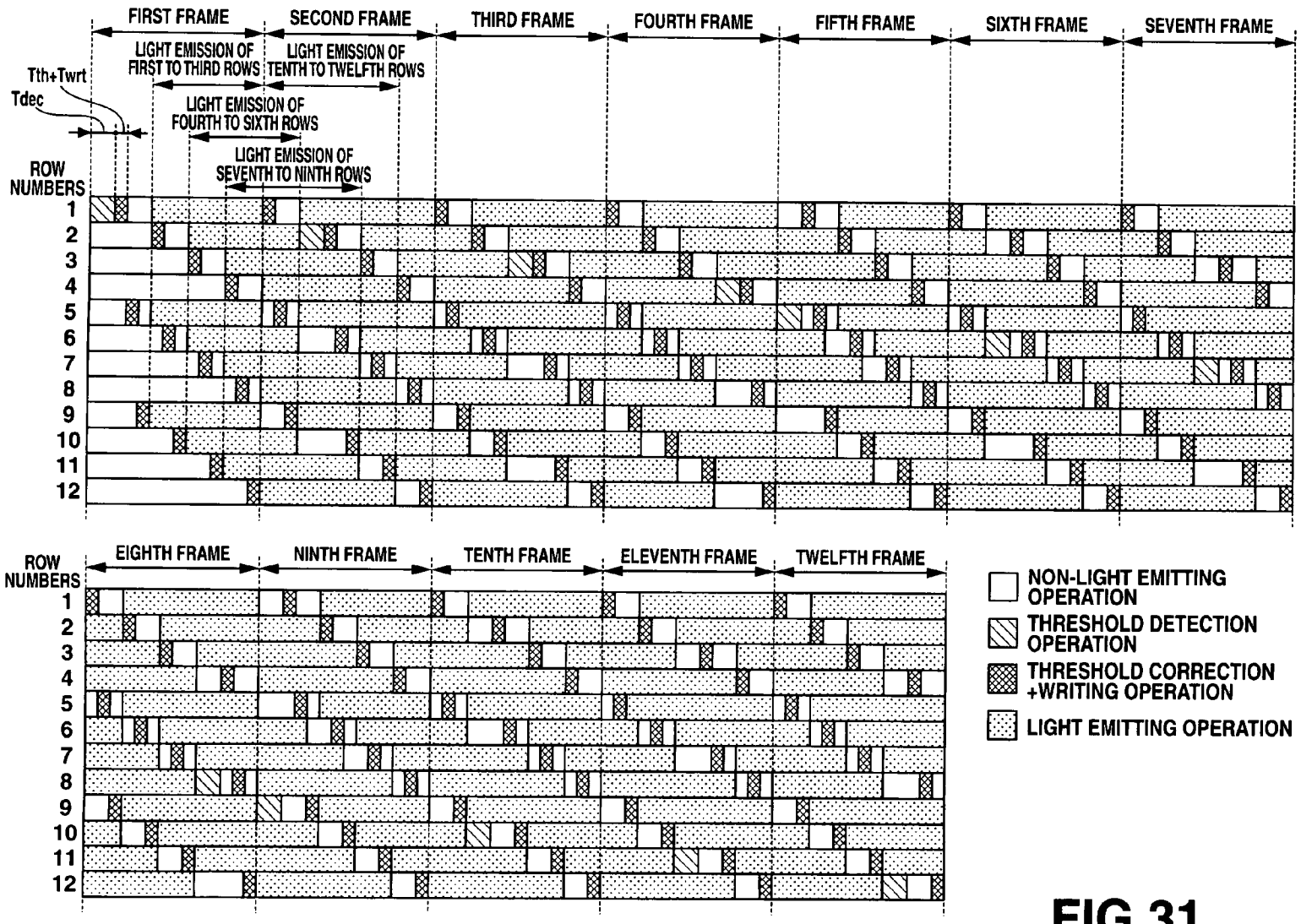
FIG. 31 is a timing chart illustratively showing a first modified example of the seventh example of the drive control method of the display apparatus according to the embodiment.

FIG. 31 is a timing chart illustratively showing a first modified example of the seventh example of the drive control method of the display apparatus according to the embodiment.

Figure 32:
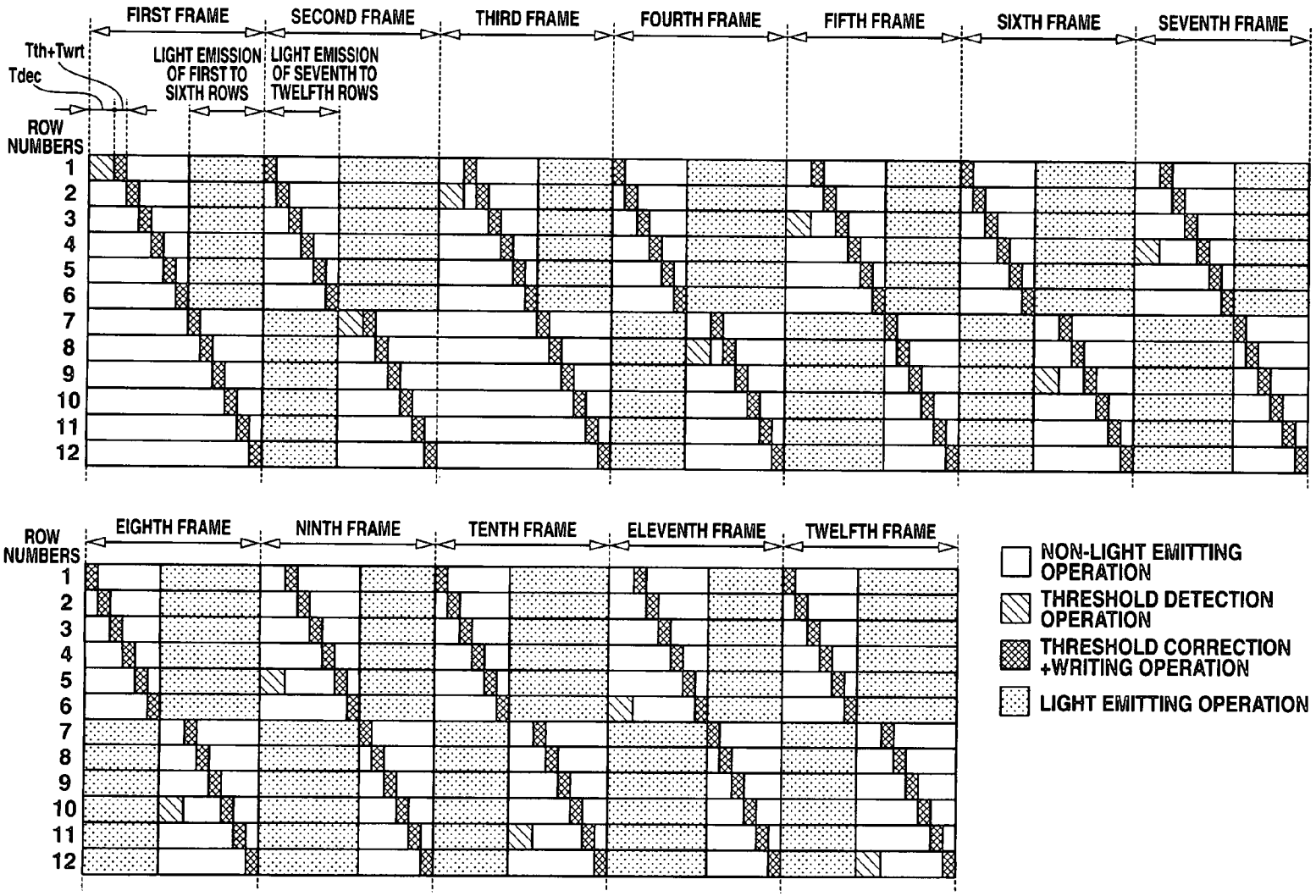
FIG. 32 is a timing chart illustratively showing a second modified example of the sixth example of the drive control method of the display apparatus according to the embodiment.

FIG. 32 is a timing chart illustratively showing a second modified example of the sixth example of the drive control method of the display apparatus according to the embodiment.

Figure 33:
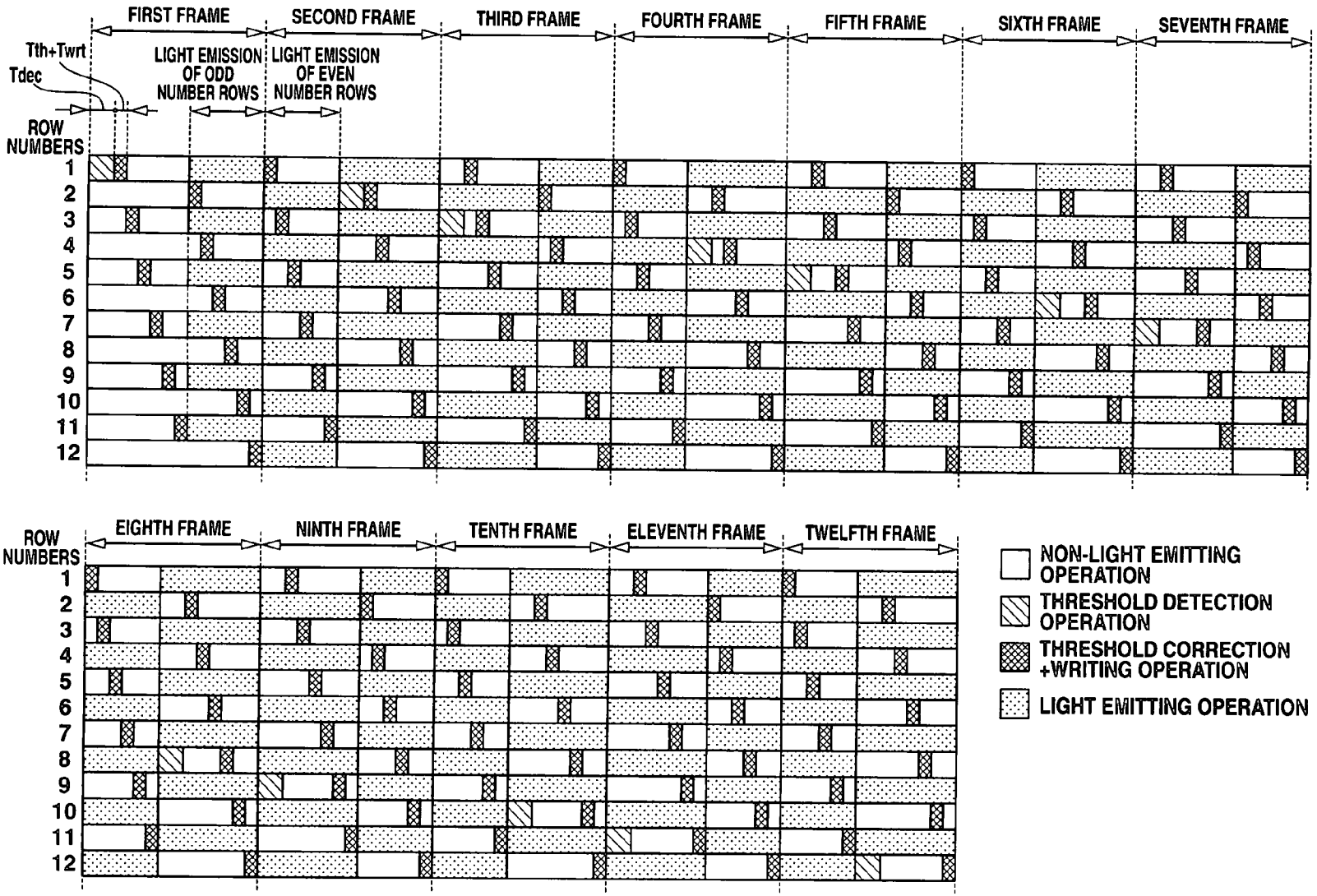
FIG. 33 is a timing chart illustratively showing a second modified example of the seventh example of the drive control method of the display apparatus according to the embodiment.

FIG. 33 is a timing chart illustratively showing a second modified example of the seventh example of the drive control method of the display apparatus according to the embodiment.

In the first modified example of the drive control method of the display apparatus according to the sixth and seventh examples, as shown in, for example, FIGS. 30 and 31, the display apparatus is controlled in such a manner that the display pixels PX constituting the display panel 210 are divided into four sets of groups (four sets of groups of the first to third rows, the fourth to sixth rows, the seventh to ninth rows, and the tenth to twelfth rows in FIG. 30; and four sets of groups of the first, fifth and ninth rows, the second, sixth and tenth rows, the third, seventh and eleventh rows, and the fourth, eighth and twelfth rows in FIG. 31), and the threshold voltage detection operation is performed with respect to the display pixels PX in a specific row for each frame period while the pre-charge operation and the writing operation are performed with respect to the display pixels PX in each row at timings different from one group to another followed by simultaneously performing a light emitting operation. In this case, the ratio of the black display period (the black insertion ratio) by the non-light emitting operation in one frame period becomes approximately 25%. Although the ratio becomes a little less than 30% which is an indication at which the flickering cannot be visually observed, a display apparatus having a relatively favorable display quality can be realized.

Furthermore, in the second modified example of the drive control method of the display apparatus according to the sixth and seventy examples, as shown in, for example, FIGS. 32 and 33, the display apparatus is controlled in such a manner that the display pixels PX constituting the display panel 210 are divided into two sets of groups (two sets of groups: the first to sixth rows, and the seventh to twelfth rows in FIG. 32; and two sets of groups; odd number rows and even number rows in FIG. 33), so that the threshold voltage detection operation is performed with respect to the display pixels PX in a specific row for each frame period while the pre-charge operation and the writing operation are performed with respect to the display pixels PX in each row at timings different from one group to another followed by simultaneously performing a light emitting operation.

In this case, the ratio of the black display period (the black insertion ratio) by the non-light emitting operation in one frame period becomes approximately 50%. The ratio exceeds 30% which is an indication at which the flickering of moving images are not visually observed. However, since the light emitting operation period becomes only half of one frame period, the image information cannot be displayed at a sufficient luminance gradation. Then, image information can be displayed at a sufficient light emitting luminance and with a favorable display quality by appropriately increasing the light emitting luminance of each display pixel.

Eighth Example

Next, there will be explained an eighth example of the drive control method of the display apparatus according to the embodiment with reference to the drawings.

Figure 34:
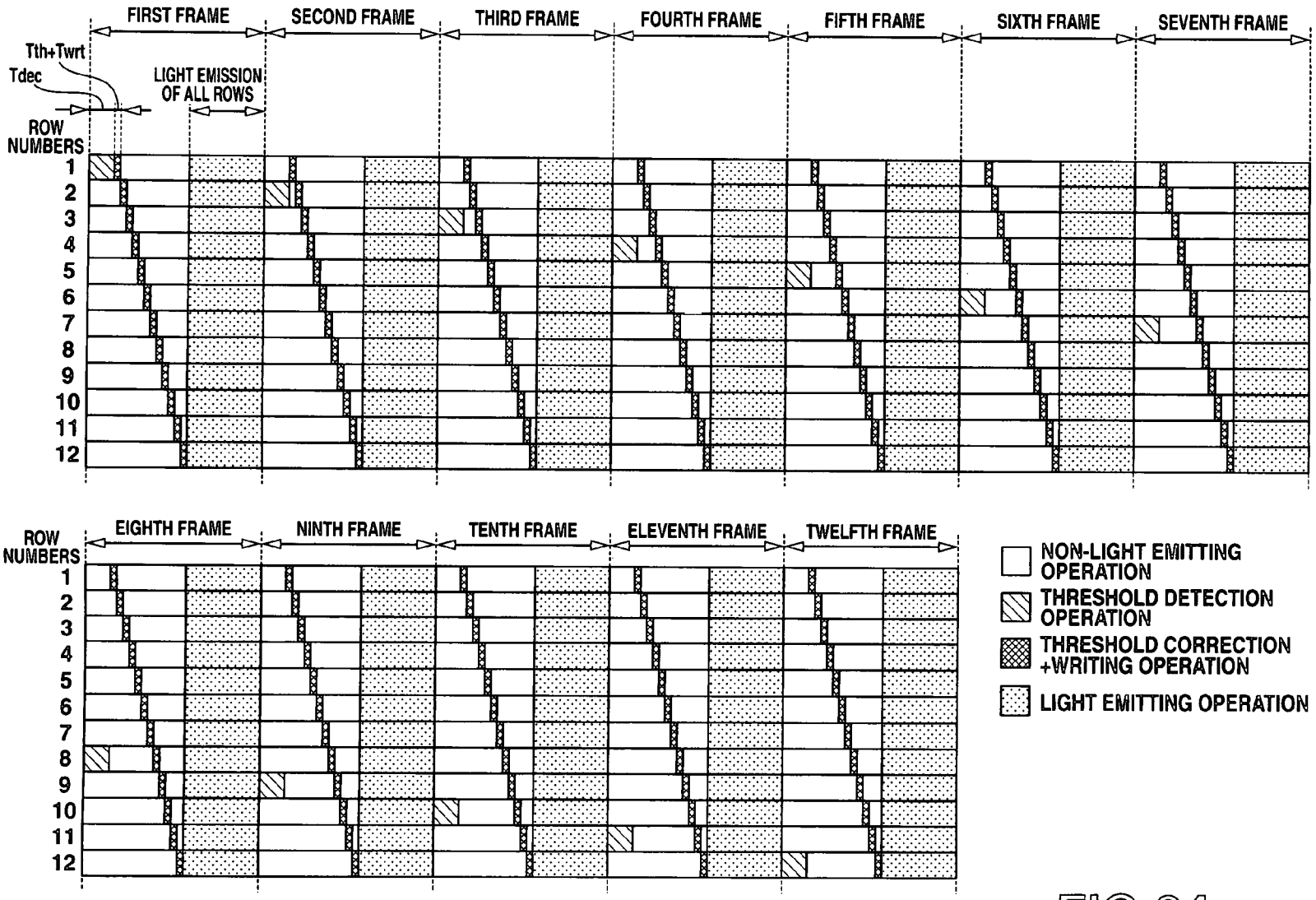
FIG. 34 is a timing chart illustratively showing an eighth example of the drive control method of the display apparatus according to the embodiment.
Figure 35:
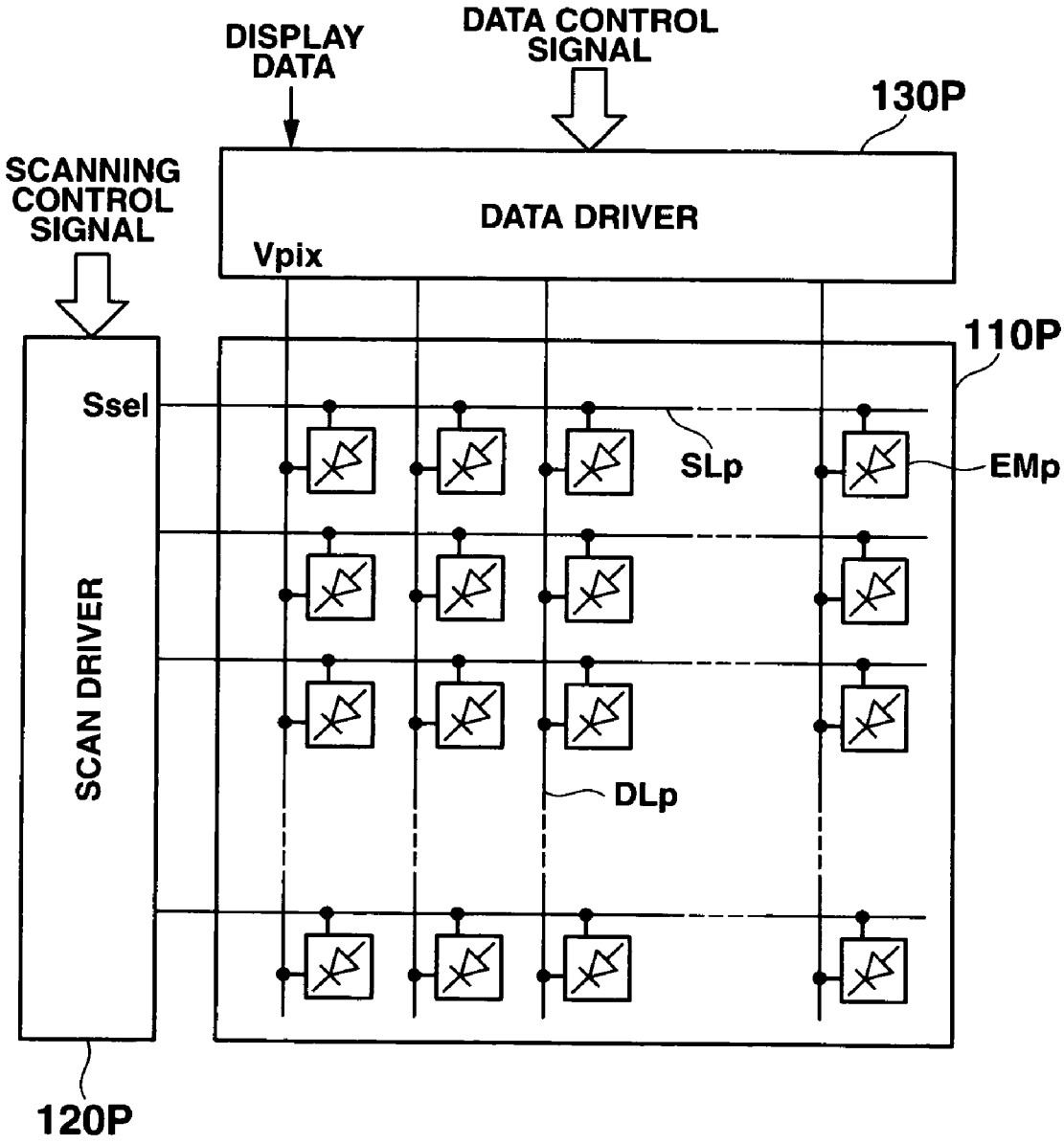
FIG.35 PRIOR ART
FIG. 35 is a schematic structural diagram showing a primary part of a conventional self-luminous type display which is of a voltage control active matrix type.
Figure 36:
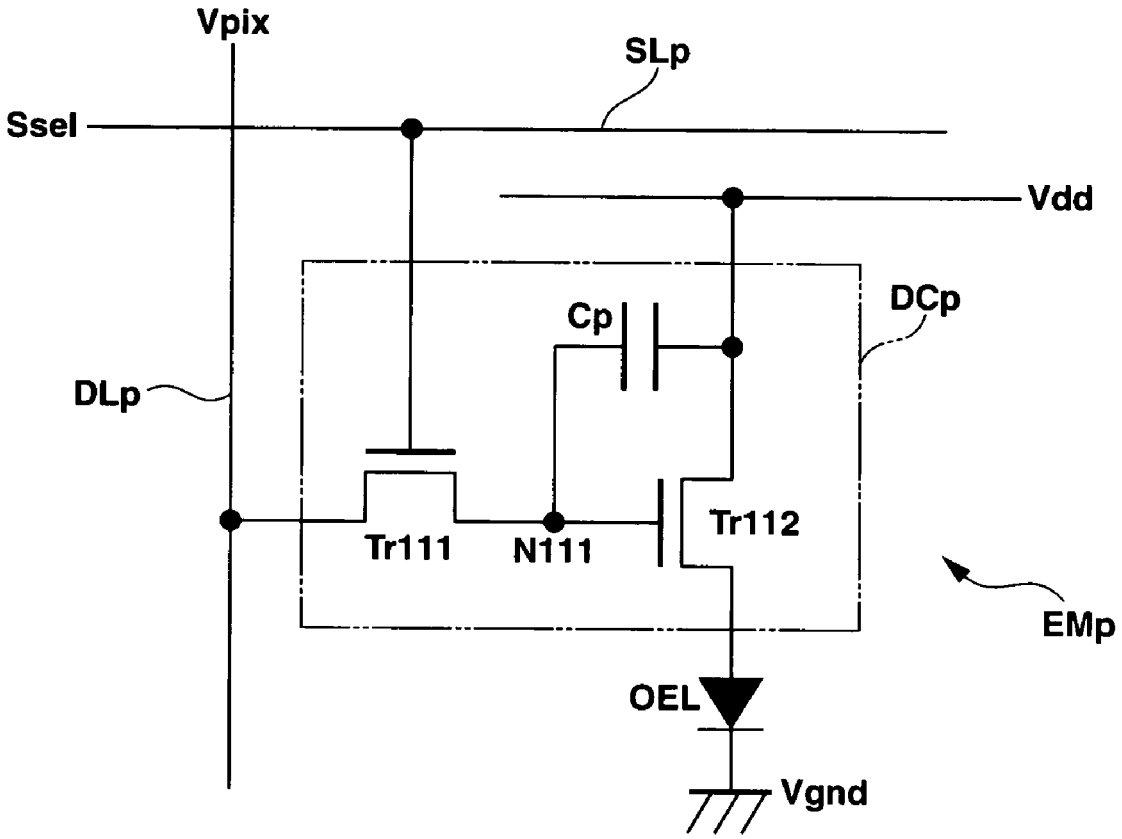
FIG.36 PRIOR ART
FIG. 36 is an equivalent circuit diagram showing a structural example of a display pixel which is applicable to the conventional self-luminous type display.

FIG. 34 is a timing chart illustratively showing the fourth example of the drive control method of the display apparatus according to the embodiment.

Here, an explanation on the drive control method same as the fifth to seventh examples (refer to FIGS. 27 to 33) will be simplified. Here, as a configuration of a display apparatus for realizing the eighth example of the drive control method of the display apparatus according to the embodiment, a configuration shown in the FIG. 26 can be applied, for example.

In the eighth example of the drive control method of the display apparatus 200 according to the embodiment, as shown in FIG. 34, a threshold voltage detection (a threshold voltage detection period Tdec) for detecting a threshold voltage with respect to a switching element (a thin film transistor)

for light emitting drive of a display pixel PX in a specific row arranged on the display panel 210 is first performed in the first half of one frame period (½ period of one frame period). Thereafter, the pre-charge operation and the writing operation are sequentially performed with respect to the display pixels PX in all the rows arranged on the display panel 210 for each row with a shift of time to perform the display drive operation for allowing the display pixels PX in all the rows arranged on the display panel 210 to simultaneously perform a light emitting operation with a luminance gradation corresponding to the display data in the second half of one frame period (½ period of one frame period). Consequently, image information in one screen portion of the display panel 210 is displayed.

In this manner, the threshold voltage detection operation is performed with respect to the display pixels PX in a specific row for each frame period while the drive control of the display apparatus is performed such that all the display pixels PX are allowed to simultaneously perform a light emitting operation in the second half of each frame period. As a consequence, the display apparatus is controlled so that, in the first half of each frame period in which the threshold voltage detection operation, the pre-charge operation and the writing operation are performed, the light emitting operation is not performed with respect to the display pixels PX in any row, but all the display pixels PX perform the non-light emitting operation (the black display operation).

Such a display drive operation can be realized by controlling the display apparatus in such a manner that a high-potential power supply voltage Vsc (=Ve) is applied to the power supply voltage lines VL of all the rows after the completion of the threshold voltage detection operation, the pre-charge operation and the writing operation with respect to the display pixels PX in all the rows while holding the power supply voltage Vsc applied to the supply power source lines VL of all the rows from the power source driver 230 in a period in which the threshold voltage detection operation, the pre-charge operation and the writing operation are performed with respect to the display pixels PX in each row.

The same drive control can be realized, for example, as shown in FIG. 26, by applying a configuration in which a single power supply voltage line VL is branched in correspondence to all the rows and is commonly connected with all the display pixels PX arranged on the display panel 210 in order to apply the single power supply voltage Vsc simultaneously to all the display pixels PX, thereby applying a single power supply voltage applied from the power source driver 230 to the display pixels PX in all the rows.

The configuration of the power source driver 230 in this case may be a function of selectively outputting a high-potential power supply voltage Vsc (=Ve) and a low power supply voltage Vsc (=Vs) for example, at a predetermined timing based on the power source control signal supplied from the system controller 250. For this reason, at least the shift register circuit as shown in FIG. 16 may not be provided. Incidentally, in the present drive control method, in the same manner as shown in FIG. 16, individual selection lines SL are arranged for each row of the display panel 210, and individual selection signals Ssel are applied from the selection driver 220 at different timings.

Consequently, according to the drive control method (the display drive operation) of the display apparatus, the display apparatus is controlled in such a manner that each frame period is divided into two; a first half period and a second half period, and a threshold voltage detection operation is performed with respect to the display pixels in a specific row followed by sequentially performing the pre-charge operation and the writing operation in a first half period while allowing all the pixels to simultaneously perform a light emitting operation in the second half period. Consequently, the ratio of the black display period (the black insertion ratio) by the light emitting operation in one frame period becomes approximately 50%. Thus, the ratio exceeds an indication of 30% at which no flickering of the moving images can be visually observed. The image information cannot be displayed at a sufficient light emitting luminance, and the pre-charge operation and the writing operation (in particular, the writing operation) in each row are shortened. For this reason, there is a possibility that the time for writing the display data cannot be secured. Furthermore, the image information can be displayed at a sufficient light emitting luminance and with a favorable image quality by appropriately increasing the light emitting luminance of each display pixel and further increasing a current value of the gradation current.

What is claimed is:

1. A drive control method of a display apparatus which displays image information corresponding to display data, the apparatus comprising a display panel having a plurality of display pixels arranged therein, each of the pixels comprising a current control type optical element and a drive element which supplies a driving current to the optical element, at respective intersections of a plurality of selection lines and a plurality of data lines arranged to respectively extend in a row direction and in a column direction, the method comprising:

detecting a threshold voltage peculiar to the drive element of each said display pixel through the data lines;

generating a compensation voltage for compensating for the threshold voltage of the drive element of each said display pixel based on each said threshold voltage, applying the compensation voltage to the drive element of each said display pixel through the data lines, and allowing the drive element to hold the compensation voltage as a voltage component;

supplying, as a gradation signal to each said display pixel through the data lines, after the drive element of the display pixel holds the voltage, a gradation current having a current value for allowing the optical element of the display pixel to perform a light emitting operation at a luminance corresponding to a luminance gradation of the display data, adding a voltage component based on the gradation signal to the voltage component based on the compensation voltage, and allowing the drive element of each said display pixel to hold the voltage component; and supplying the driving current created based on the voltage component held in the drive element of each said display pixel to the optical element, and allowing the optical element to be operated in accordance with the gradation signal.

2. The drive control method of the display apparatus according to claim 1, wherein the detecting the threshold voltage includes:

applying a voltage for threshold detection which has a higher potential than the threshold voltage to the drive element of each said display pixel through the data lines; and detecting through the data lines, as the threshold voltage, a voltage after part of electric charges corresponding to the voltage for threshold detection is discharged and converged.

3. The drive control method of the display apparatus according to claim 1, wherein the detecting the threshold voltage includes:

storing threshold data corresponding to the threshold voltage, and the storing the threshold data is performed with respect to all of said plurality of display pixels arranged on the display panel at a timing prior to the application of the compensation voltage and the holding of the voltage component based on the gradation signal.

4. The drive control method of the display apparatus according to claim 3, wherein the storing the threshold data is sequentially performed with respect to said plurality of display pixels for each row of display pixels.

5. The drive control method of the display apparatus according to claim 1, wherein the detecting the threshold voltage includes:

storing threshold data corresponding to the threshold voltage; and the storing the threshold data is performed with respect to the drive elements of the display pixels in different rows of the display panel for each of operation periods in which the gradation signal is supplied to all of said plurality of display pixels arranged on the display panel.

6. The drive control method of the display apparatus according to claim 1, wherein the detecting the threshold voltage includes:

storing threshold data corresponding to the threshold voltage, and the storing the threshold voltage is performed with respect to the drive elements of the display pixels in adjacent rows of the display panel for each of operation periods in which the gradation signal is supplied to all of said plurality of display pixels arranged on the display panel.

7. The drive control method of the display apparatus according to claim 1, wherein the adding a voltage component based on the gradation signal to the voltage component based on the compensation voltage and allowing the drive element of each said display pixel to hold the voltage component is sequentially performed with respect to said plurality of display pixels for each row of display pixels, and wherein the allowing the optical element to be operated in accordance with the gradation signal is sequentially performed from a row at which the adding a voltage component based on the gradation signal to the voltage component based on the compensation voltage is completed.

8. The drive control method of the display apparatus according to claim 1, wherein the adding a voltage component based on the gradation signal to the voltage component based on the compensation voltage and allowing the drive element of each said display pixel to hold the voltage component is sequentially performed for each group which is obtained by grouping said plurality of display pixels arranged on the display panel into groups of a plurality of rows, and wherein the allowing the optical element to be operated in accordance with the gradation signal is sequentially performed from the group in which the adding a voltage component based on the gradation signal to the voltage component based on the compensation voltage is completed.

9. The drive control method of the display apparatus according to claim 1, wherein, when the light emitting element of one of the display pixels is allowed to perform a non-light emitting operation, a non-light emitting display voltage having a predetermined voltage for allowing the optical element to perform a non-light emitting operation is generated as the gradation signal, and the non-light emitting display voltage is supplied to the display pixel.

10. A display drive apparatus which operates, in accordance with display data, a current control type optical element of each display pixel of a display, wherein each display pixel is provided with the optical element and a drive element which supplies a driving current to the optical element, the display drive apparatus comprising:

a gradation signal generation circuit which generates a gradation current having a current value for allowing the optical element to perform a light emitting operation at a luminance corresponding to a luminance gradation of the display data, as a gradation signal corresponding to the luminance gradation of the display data, and supplies the gradation current to the display pixel through a data line connected to the display pixel;

a threshold voltage detection circuit which detects a threshold voltage peculiar to the drive element of the display pixel through the data line; and a compensation voltage application circuit which generates a compensation voltage for compensating for the threshold voltage of the drive element based on the threshold voltage and applies the compensation voltage to the drive element through the data line before the gradation signal generation circuit supplies the gradation current to the display pixel.

11. The display drive apparatus according to claim 10, further comprising a memory circuit which stores threshold data corresponding to the threshold voltage detected by the threshold voltage detection circuit, wherein the compensation voltage application circuit generates the compensation voltage based on the threshold data stored in the memory circuit.

12. The display drive apparatus according to claim 10, further comprising a detecting voltage application circuit which applies to the drive element, through the data line, a voltage for threshold detection which has a higher potential than the threshold voltage, wherein the threshold voltage detection circuit detects through the data line, as the threshold voltage, a voltage after the voltage for threshold voltage detection is applied to the drive element by the detecting voltage application circuit and part of electric charges corresponding to the voltage for threshold voltage detection is discharged and converged.

13. The display drive apparatus according to claim 12, wherein the drive element includes a current path which allows the driving current to flow to the optical element, and a control terminal which controls a supply state of the driving current, wherein the detecting voltage application circuit applies the voltage for threshold detection to between the control terminal of the drive element and one end side of the current path through the data line, and wherein the threshold voltage detection circuit detects through the data line, as the threshold voltage, a potential difference between the control terminal of the drive element and the one end side of the current path at a time of absence of current flow in the current path.

14. The display drive apparatus according to claim 13, further comprising a memory circuit which stores threshold data based on the threshold voltage detected by the threshold voltage detection circuit, and wherein the compensation voltage application circuit applies the compensation voltage based on the threshold data stored in the memory circuit to between the control terminal of the drive element and the one end side of the current path.

15. The display drive apparatus according to claim 10, wherein the gradation signal generation circuit includes a circuit which generates, as the gradation signal, a non-light emitting display voltage having a predetermined voltage value for allowing the optical element to perform a non-light emitting operation.

16. The display drive apparatus according to claim 10, further comprising a signal path switching circuit which selectively switches and controls a connection between the data line, which is a single data line provided in correspondence to the display pixel, and each of a signal path which detects the threshold voltage with the threshold voltage detection circuit, a signal path which applies the compensation voltage with the compensation voltage application circuit, and a signal path which supplies the gradation signal with the gradation signal generation circuit.

17. The display drive apparatus according to claim 12, further comprising a signal path switching circuit which selectively switches and controls a connection between the data line, which is a single data line provided in correspondence to the display pixel, and each of a signal path which detects the threshold voltage with the threshold voltage detection circuit, a signal path which applies the compensation voltage with the compensation voltage application circuit, a signal path which supplies the gradation signal with the gradation signal generation circuit, and a signal path which applies the voltage for threshold detection with the detecting voltage application circuit.

18. A display apparatus which displays image information corresponding to display data, the apparatus comprising:

a display panel having a plurality of display pixels arranged therein, each of the pixels including a current control type optical element and a drive element which supplies a driving current to the optical element, at each of respective intersections of a plurality of selection lines and a plurality of data lines arranged to respectively extend in a row direction and in a column direction;

a selection drive unit which sequentially supplies a selection signal to each of the plurality of selection lines of the display panel, thereby setting the display pixels in each row sequentially in a selection state; and a data drive unit comprising:

a gradation signal generation circuit which supplies a gradation current, as a gradation signal, to each said display pixel via a corresponding one of the data lines, wherein the gradation signal generation circuit generates each said gradation current to have a current value for allowing the optical element of the display pixel to perform a light emitting operation at a luminance corresponding to a luminance gradation of the display data;

a threshold voltage detection circuit which detects a threshold voltage peculiar to the drive element of each said display pixel via the corresponding one of the data lines; and a compensation voltage application circuit which generates a compensation voltage for compensating for the threshold voltage of each said display pixel based on each said threshold voltage, and applies the compensation voltage to each said display pixel via the corresponding one of the data lines before the gradation signal generation circuit supplies the gradation current to the display pixel.

19. The display apparatus according to claim 18, wherein the data drive unit further comprises a memory circuit which stores threshold data corresponding to each said threshold voltage detected by the threshold voltage detection circuit, and wherein the compensation voltage application circuit generates each said compensation voltage based on the threshold data stored in the memory circuit.

20. The display apparatus according to claim 18, wherein the data drive unit further comprises a detecting voltage application circuit which supplies a voltage for threshold detection which has a higher potential than the threshold voltage to the drive element of each said display pixel via the corresponding one of the data lines, and wherein the threshold voltage detection circuit detects as the threshold voltage peculiar to the drive element a voltage after the voltage for threshold voltage detection is applied to the drive element via the corresponding one of the data lines and part of electric charges corresponding to the voltage for threshold voltage detection is discharged and converged.

21. The display apparatus according to claim 20, wherein the drive element of each said display pixel comprises a current path which allows the driving current to flow to the optical element, and a control terminal which controls a supply state of the driving current, wherein the detecting voltage application circuit applies a voltage for threshold detection to between the control terminal of the drive element and one end side of the current path, and wherein the threshold voltage detection circuit detects a potential difference between the control terminal of the drive element and the one end side of the current path at a time of absence of current flow in the current path as the threshold voltage via the corresponding one of the data lines.

22. The display apparatus according to claim 21, wherein the data drive unit further comprises a memory circuit which stores threshold data based on each said threshold voltage detected by the threshold voltage detection circuit, and wherein the compensation voltage application circuit applies the compensation voltage based on the threshold data stored in the memory circuit to between the control terminal of the drive element and the one end side of the current path via the corresponding one of the data lines.

23. The display apparatus according to claim 18, wherein the optical element of each said display pixel includes an organic electroluminescent element.

24. The display apparatus according to claim 18, wherein the gradation signal generation circuit comprises a circuit which generates, as the gradation signal, a non-light emitting display voltage having a predetermined voltage value for allowing the optical element to perform a non-light emitting operation.

25. The display apparatus according to claim 19, wherein the data drive unit further comprises:

a threshold acquiring circuit which individually fetches the threshold data corresponding to each said threshold voltage detected from each of said plurality of display pixels via the data lines and sequentially transfers each said threshold data; and a data acquiring circuit which sequentially and individually fetches and holds luminance gradation data for generating the gradation signal with respect to each of the display pixels, wherein the memory circuit individually stores each of the threshold data transferred from the threshold acquiring circuit in correspondence to each of said plurality of display pixels, and wherein the gradation signal generation circuit generates the gradation signal corresponding to the luminance gradation data held in the data acquiring circuit and supplies the gradation signal to each said display pixel via the corresponding one of the data lines.

26. The display apparatus according to claim 25, wherein a configuration for sequentially and individually fetching the luminance gradation data in the data acquiring circuit and a configuration for fetching the threshold data and sequentially transferring the threshold data in the threshold acquiring circuit are shared.

27. The display apparatus according to claim 18, wherein the data drive unit comprises a signal path switching circuit which selectively switches and controls a connection between one of the data lines and each of a signal path which detects the threshold voltage with the threshold voltage detection circuit, a signal path which applies the compensation voltage with the compensation voltage application circuit, and a signal path which supplies the gradation signal with the gradation signal generation circuit.

28. The display apparatus according to claim 20, wherein the data drive unit comprises a signal path switching circuit which selectively switches and controls a connection between one of the data lines and each of a signal path which detects the threshold voltage with the threshold voltage detection circuit, a signal path which applies the compensation voltage with the compensation voltage application circuit, a signal path which supplies the gradation signal with the gradation signal generation circuit, and a signal path which applies the voltage for threshold with the detecting voltage application circuit.

29. The display apparatus according to claim 18, further comprising a power source drive unit which applies a predetermined power supply voltage to each of said plurality of display pixels, wherein the power source drive unit sequentially applies the power supply voltage to the display pixels in each row of the display panel at a predetermined timing, thereby setting the display pixels in each row in an operation state.

30. The display apparatus according to claim 18, further comprising a power source drive unit which applies a predetermined power supply voltage to each of said plurality of display pixels, wherein the power source drive unit sequentially applies the power supply voltage at a predetermined timing to the display pixels for each group which is obtained by dividing said plurality of display pixels arranged on the display panel into sets of a plurality of rows, thereby setting the display pixels in each group in an operation state.

31. The display apparatus according to claim 18, further comprising a drive control unit which generates a timing control signal for controlling a timing of the operation of detecting the threshold voltage by the threshold voltage detection circuit.

32. The display apparatus according to claim 31, wherein the drive control unit performs control with the timing control signal so as to cause the threshold voltage detection circuit to detect the threshold voltage of the drive elements of the display pixels in different rows of the display panel for each of operation periods in which the gradation signal is supplied to all of said plurality of display pixels arranged on the display panel by means of the selection drive unit and the data drive unit.

33. The display apparatus according to claim 31, wherein the drive control unit performs control with the timing control signal so as to cause the threshold voltage detection circuit to detect the threshold voltage of the drive elements of the display pixels in adjacent rows of the display panel for each of operation periods in which the gradation signal is supplied to all of said plurality of display pixels arranged on the display panel by means of the selection drive unit and the data drive unit.

34. The display apparatus according to claim 20, wherein each of the display pixels comprises a drive circuit which controls an operation of the optical element, and the drive circuit comprises:

a first switch circuit including a current path having a first end to which a power supply voltage is applied and a second end that is connected with a connection point with the optical element;

a second switch circuit including a control terminal that is connected with one of the selection lines, and including a current path having a first end to which the power supply voltage is applied and a second end that is connected with a control terminal of the first switch circuit; and a third switch circuit including a control terminal that is connected with the one of the selection lines, and including a current path having a first end that is connected with the corresponding one of the data lines and a second end that is connected with the connection contact point, wherein said drive element comprises the first switch circuit, wherein the detecting voltage application circuit applies the voltage for threshold detection to between the control terminal of the first switch circuit and the connection contact point, wherein the threshold voltage detection circuit detects, as the threshold voltage, a potential between the control terminal of the first switch circuit and the connection contact point, and wherein the compensation voltage application circuit applies the compensation voltage to between the control terminal of the first switch circuit and the connection contact point.

35. The display apparatus according to claim 34, wherein each of the first to third switch circuits includes a field effect transistor provided with a semiconductor layer comprising amorphous silicon.

36. A drive control method of a display drive apparatus which operates a current control type optical element of a display pixel provided with the optical element and a drive element which supplies a driving current to the optical element, the method comprising:

detecting a threshold voltage peculiar to the drive element through a data line connected to the display pixel;

generating a compensation voltage for compensating for the threshold voltage of the drive element based on the threshold voltage and applying the compensation voltage to the drive element through the data line so as to allow the drive element to hold the voltage as a voltage component; and supplying, after the drive element holds the voltage, a gradation current having a current value for allowing the optical element to perform a light emitting operation at a luminance corresponding to a luminance gradation of display data, as a gradation signal to the display pixel through the data line, adding a voltage component based on the gradation signal to the voltage component based on the compensation voltage, and allowing the drive element to hold the voltage component.

37. The drive control method of the display drive apparatus according to claim 36, wherein the detecting the threshold voltage includes an operation of storing threshold data corresponding to the threshold voltage, and wherein the operation of storing the threshold data is performed at a timing prior to the application of the compensation voltage to the drive element and holding of the voltage component based on the gradation signal.

38. The drive control method of the display drive apparatus according to claim 36, wherein the detecting the threshold voltage includes:

applying a voltage for threshold detection which has a higher potential than the threshold voltage; and detecting, as the threshold voltage, a voltage after part of electric charges corresponding to the voltage for threshold voltage detection is discharged and converged.

39. The drive control method of the display drive apparatus according to claim 36, wherein, when the optical element is allowed to perform a non-light emitting operation, a non-light emitting display voltage having a predetermined voltage value for allowing the optical element to perform a non-light emitting operation is generated as the gradation signal, and the non-light emitting display voltage is supplied to the display pixel.

* * * * *